US007116289B2

(12) United States Patent
Yamada

(10) Patent No.: US 7,116,289 B2
(45) Date of Patent: Oct. 3, 2006

(54) PLASMA DISPLAY DRIVING METHOD AND DEVICE

(75) Inventor: Kazuhiro Yamada, Takatsuki (JP)

(73) Assignee: Matsushita Electric Industrial Co., Ltd., Osaka-Fu (JP)

( * ) Notice: Subject to any disclaimer, the term of this patent is extended or adjusted under 35 U.S.C. 154(b) by 217 days.

(21) Appl. No.: 10/362,693

(22) PCT Filed: Aug. 28, 2001

(86) PCT No.: PCT/JP01/07350

§ 371 (c)(1),
(2), (4) Date: Feb. 26, 2003

(87) PCT Pub. No.: WO02/19305

PCT Pub. Date: Mar. 7, 2002

(65) Prior Publication Data

US 2004/0095294 A1 May 20, 2004

(30) Foreign Application Priority Data

Aug. 28, 2000 (JP) ..... 2000-256913
Sep. 18, 2000 (JP) ..... 2000-281547
Jan. 23, 2001 (JP) ..... 2001-14124

(51) Int. Cl.
*G09G 3/28* (2006.01)

(52) U.S. Cl. ..... 345/60; 345/37; 345/63; 345/67; 345/68; 345/208

(58) Field of Classification Search ..... 345/60, 345/63, 68, 67, 208, 37
See application file for complete search history.

(56) References Cited

U.S. PATENT DOCUMENTS 6,043,605 A * 3/2000 Park ..... 313/586
6,384,531 B1 * 5/2002 Park et al. ..... 313/584
6,597,334 B1 * 7/2003 Nakamura ..... 345/68
6,825,606 B1 * 11/2004 Schermerhorn et al. .... 313/484

FOREIGN PATENT DOCUMENTS

| | | |
|---|---|---|
| JP | 06-214525 | 8/1994 |
| JP | 10-074059 | 3/1998 |
| JP | 10-177365 | 6/1998 |
| JP | 10-222119 | 8/1998 |
| JP | 11-133912 | 5/1999 |
| JP | 2000-322026 | 11/2000 |
| JP | 2001-142430 | 5/2001 |

* cited by examiner

*Primary Examiner*—Richard Hjerpe
*Assistant Examiner*—Leonid Shapiro

(57) ABSTRACT

Technology that enables writing in a PDP to be conducted effectively, even when a time period of the writing is shortened. In a PDP driven by a method in which a write discharge is selectively generated in a plurality of cells by applying a scan pulse sequentially to a plurality of first electrodes and a data pulse selectively to a plurality of third electrodes in a write period, the technology provides for a write auxiliary discharge to be generated at least in a cell selected for writing or in a vicinity of the selected cell when the scan pulse is applied in the write period, the write auxiliary discharge being smaller in magnitude than the write discharge. The write auxiliary discharge results in the generation of priming particles in or in a vicinity of the selected cell, and these priming particles facilitate the generation of a write discharge in the selected cell. Consequently, the occurrence of defective writing is reduced and effective writing can be conducted, even when a width of the scan pulse is shortened.

30 Claims, 48 Drawing Sheets

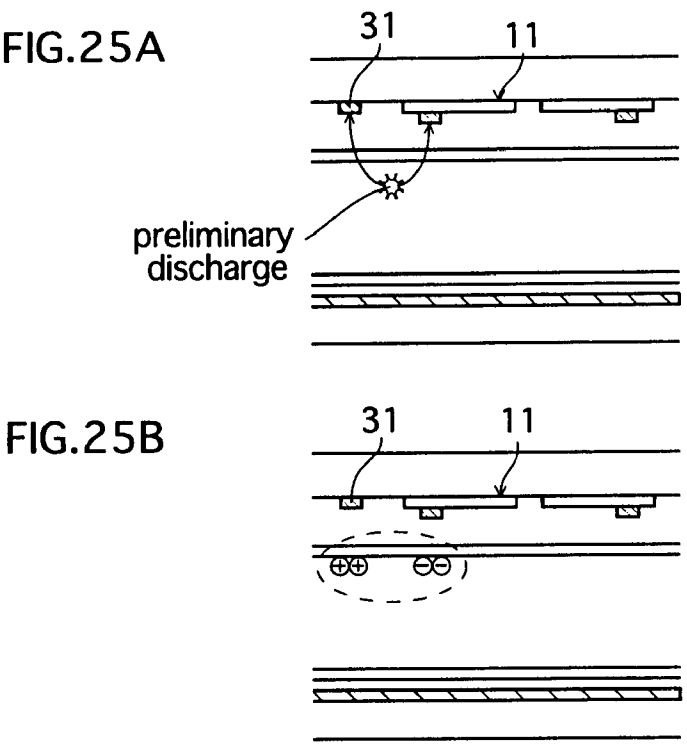
FIG.25A
FIG.25B
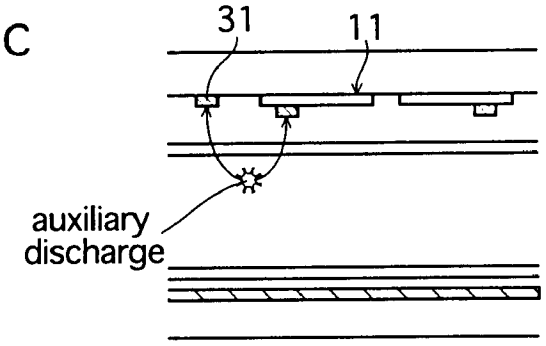
FIG.25C
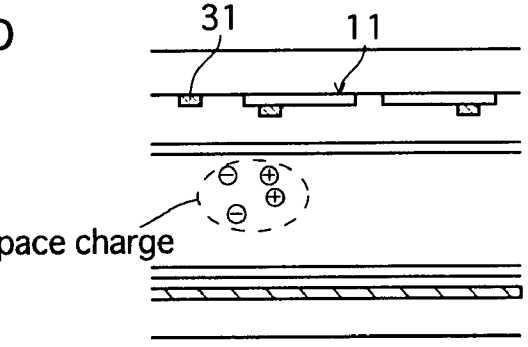
FIG.25D
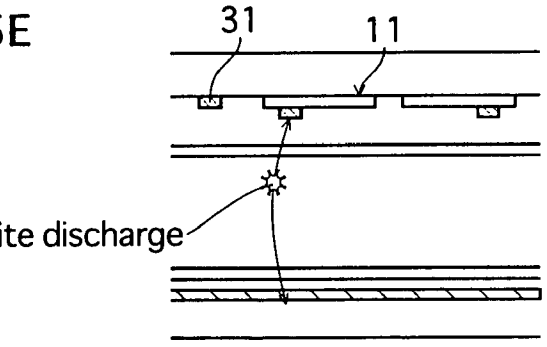
FIG.25E

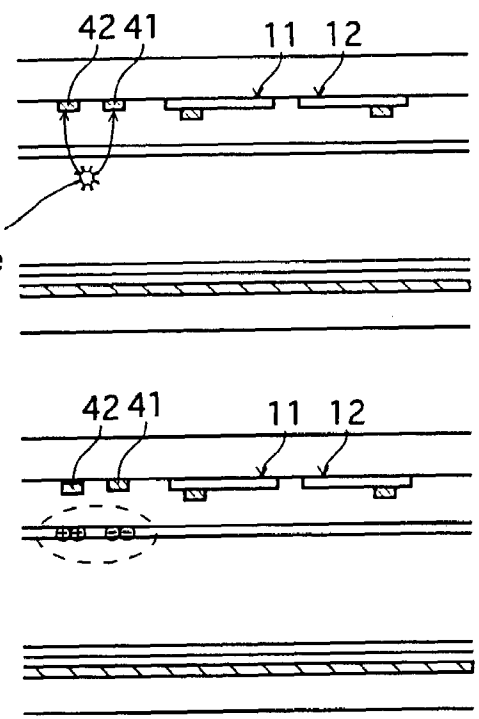
FIG.41A
FIG.41B
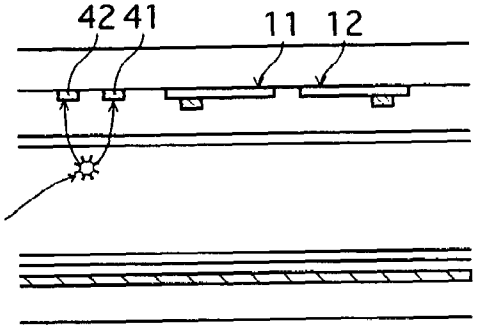
FIG.41C
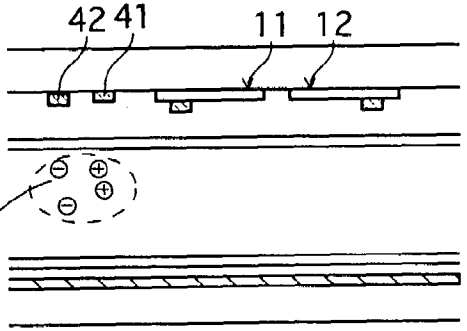
FIG.41D
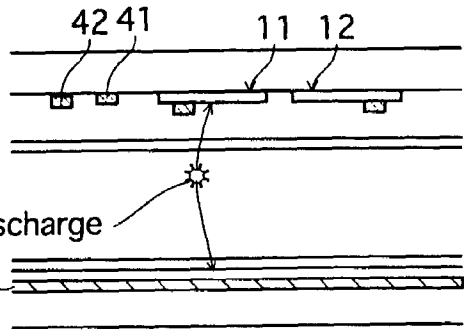
FIG.41E

PLASMA DISPLAY DRIVING METHOD AND DEVICE

TECHNICAL FIELD

The present invention relates to a flat-panel plasma display panel and a drive method that are used in display devices of information terminals, personal computers and the like, as well as in image display devices of televisions and the like.

BACKGROUND ART

Plasma display panels (PDPs) can be broadly divided into direct current (DC) and alternating current (AC) types. However, AC PDPs are currently the major focus of attention due to their suitability for large-screen application.

Conventional AC-type surface discharge PDPs that conduct RGB color image display, as well as related drive methods are disclosed, for example, in Japanese publication of unexamined applications No. 6-186927 and No. 5-307935. The disclosed technology is basically as follows.

A conventional PDP is structured from a front cover plate and a back plate that are disposed parallel to each other and with a gap therebetween. On the front cover plate, display electrodes (i.e. scan electrodes and sustain electrodes) are arranged in a stripe pattern, and a dielectric layer is provided so as to cover these electrodes. On the back panel, data electrodes and barrier ribs are arranged in a stripe pattern that is orthogonal to the display electrodes, and between the barrier ribs are arranged ultraviolet light excitation phosphor layers corresponding to the colors red, green and blue. Between the two plates, cells are formed where the electrodes extend across each other orthogonally, and a discharge space within each cell is filled with a discharge gas.

According to a conventional drive method, firstly, in an initialization period, an initialization discharge is generated in all of the cells within the panel by applying an initialization pulse to the scan electrodes. The initialization discharge serves to equilibrize the space charge throughout the panel, and to accumulate wall charge (i.e. effective when a write discharge is subsequently generated) in a vicinity of the data electrodes.

Next, in a write period, a write discharge is generated in cells to be turned on (hereafter, "on-cells") by applying a positive data pulse selectively to the scan electrodes at the same time that a negative scan pulse is applied sequentially to the scan electrodes. Here, the write discharge generally induces a write sustain discharge to generate between the scan electrode and the sustain electrode in the on-cells, thus completing the writing.

Next, in a sustain period, a high voltage sustain pulse is applied alternately to the scan electrode and the sustain electrode in the on-cells. In this way a discharge is selectively repeated in the written cells, and image display is achieved as a result of the luminescence that arises from this sustain discharge. Then, in an erase period, the wall charge stored on the dielectric as a result of the sustain discharge is erased by erase pulses applied to the sustain electrodes.

With respect to PDP design, the present task is to improve the luminescence brightness in a PDP having the above structure.

However, in order to improve luminescence brightness, it is desirable to lengthen the sustain period as much as possible by shortening the initialization, write and erase periods, since the sustain period is the only period that actually contributes to luminescence in the cells.

To shorten the write period, a pulse width of the scan pulse applied to the scan electrodes and the data pulse applied to the data electrodes is preferably shortened as much as possible. Currently, there is an increasing demand for display devices capable of high definition image display, and attempts are being made to keep the aforementioned pulse widths to around 1.0 μsecs or less in order to conduct effective writing without having to extend the length of the write period.

However, a certain amount of dispersion occurs from the time that application of the scan and data pulses is commenced until the time that a discharge is generated, and thus shortening the pulse widths of the scan and data pulses increases the possibility that defective writing will occur.

Since the occurrence of defective writing results in the on-cells not being turned on, the quality of the displayed image is consequently reduced.

DISCLOSURE OF THE INVENTION

An object of the present invention is to provide technology that allows for writing to be conducted effectively in a PDP, even when a time period of the writing is shortened.

A drive method provided to achieve this object drives a PDP by applying a scan pulse sequentially to first electrodes and a data pulse selectively to third electrodes in a write period, in order to selectively generate a write discharge in a plurality of cell, and illuminating a written cell in a sustain period that succeeds the write period. Here, when the scan pulse is applied to the first electrodes in the write period, a write auxiliary discharge of smaller magnitude than the write discharge is generated at least in a cell selected for writing or in a vicinity of the selected cell.

According to this structure, priming particles resulting from the write auxiliary discharge are generated at least in cells selected for writing or in a vicinity of the selected cells, and thus a state within these cells becomes conducive to the generation of a write discharge. Consequently, it is possible to achieve a significant reduction in the time required to generate a discharge after application of the scan and data pulses has been commenced. The chance of defective writing occurring is thus reduced and writing can be conducted effectively, even if the pulse width of the scan and data pulses is shortened.

Furthermore, since the discharge magnitude of the write auxiliary discharge is less than that of the write discharge, the write auxiliary discharge does not expand to become a write discharge. Moreover, since the luminescence levels resulting from the write auxiliary discharge are low, the write auxiliary discharge has almost no detrimental effect on contrast.

The methods given below in (1) to (4) may be used to generate the write auxiliary discharge in the write period as described above.

(1) In the write period, an auxiliary pulse may be applied to third electrodes in cells other than the selected cells (i.e. the off-cells), at the same time that the scan pulse is applied to the first electrodes, the auxiliary pulse having the same polarity as the data pulse.

According to this structure, a write discharge is generated in on-cells corresponding to the first electrode to which the scan pulse is being applied, and a write auxiliary discharge is generated in the off-cells. Priming particles generated from the write discharge or the write auxiliary discharge flow into cells corresponding to the first electrode to which the scan pulse is next applied (i.e. the first electrode next in the sequence of first electrodes), and thus a state within these cells becomes conducive to the generation of a discharge.

(2) In the write period, the voltage between a first electrode to which the scan pulse is being applied and a third electrode to which the data pulse is not being applied may be adjusted such that the voltage exceeds a discharge sparking voltage between the first electrode and the third electrode.

As with (1) above, according to this structure a write discharge is generated in on-cells corresponding to the first electrode to which the scan pulse is being applied, and a write auxiliary discharge is generated in the off-cells. The priming particles generated as a result of the write discharge or the write auxiliary discharge flow into the cells corresponding to the first electrode to which the scan pulse is next applied, and thus a state within these cells becomes conducive to the generation of a discharge.

(3) An auxiliary discharge electrode may be provided adjacent to each first electrode in the plasma display panel, and in the write period a write auxiliary discharge may be generated between a first electrode to which the scan pulse is being applied and an auxiliary discharge electrode positioned adjacent to the first electrode.

According to this structure, in cells corresponding to the first electrode to which the scan pulse is being applied, priming particles are generated from the write auxiliary discharge occurring between the first electrode and the auxiliary discharge electrode positioned adjacent thereto, and thus a state within these cells becomes conducive to the generation of a discharge.

(4) In the plasma display panel, a first auxiliary discharge electrode may be provided adjacent to each first electrode, and a second auxiliary discharge electrode may be provided adjacent to each first auxiliary discharge electrode, and in the write period the write auxiliary discharge may be generated between the first auxiliary discharge electrodes and the second auxiliary discharge electrodes.

According to this structure, a write auxiliary discharge can be generated in cells corresponding to a first electrode to which the scan pulse is being applied, and/or a write auxiliary discharge can be generated in cells corresponding to the first electrode to which the scan pulse is next applied. In either case, priming particles are generated from the write auxiliary discharge that occurs between the first and second auxiliary discharge electrodes, and thus a state within these cells becomes conducive to the generation of a discharge.

In (1) and (2) above, the generation of the write auxiliary discharge may cause a surplus or a deficiency in the amount of wall charge that accumulates on the dielectric layer over the scan electrodes. However, in (3) and (4) above, because auxiliary discharge electrodes for use in generating the write auxiliary discharge are provided in addition to the scan and data electrodes, any detrimental effect the write auxiliary discharge may have on the formation of wall charge by the write discharge is reduced. Particularly in (4), because the write auxiliary discharge is generated between the first and second auxiliary discharge electrodes, the write auxiliary discharge has very little effect on the formation of wall charge by the write discharge.

The luminescence level of the write auxiliary discharge is preferably in a range of 1/10 to 1/100 of the discharge generated during the write period in cells to be written.

Although described in detail in embodiments 1-1 to 1-5, according to a drive method and a drive circuit relating to (1) above, an auxiliary pulse is preferably applied in the write period to third electrodes in cells other than selected cells, at the same time that the scan pulse is applied to the first electrodes, the auxiliary pulse having the same polarity as the data pulse.

The auxiliary pulse may be set such that a pulse width is shorter than that of the data pulse, or such that an absolute value of the average voltage is lower than that of the data pulse. Moreover, a wave height of the auxiliary pulse may be set to be lower than that of the data pulse, or a shape of a waveform of the auxiliary pulse may be set to be one of a triangular wave and a pulse train.

When the auxiliary pulse is applied, a cell in a vicinity of the selected cell may be detected, and the auxiliary pulse may be applied selectively in the detected cell.

When the PDP is driven using a time-division gray scale display method according to which a single field has a plurality of subfields, an auxiliary write discharge may be generated in the write period of a subfield having a specific brightness weight, or it may be judged for each field whether the number of cells for illuminating within a period of the field satisfies a predetermined reference value, and the write auxiliary discharge may be selectively generated in fields judged to satisfy the predetermined reference value.

Although described in detail in embodiments 2-1 to 2-3, according to a drive method and a drive circuit relating to (2) above, a write auxiliary discharge can be generated by adjusting a voltage between a first electrode to which the scan pulse is being applied and a third electrode to which the data pulse is not being applied to exceed the discharge sparking voltage between the first electrode and the third electrode.

Here, in the write period, a first base pulse having the same polarity as the data pulse may be applied to all of the third electrodes, and the data pulse may then be applied over the first base pulse, or a second base pulse having the same polarity as the scan pulse may be applied to all of the first electrodes, and the scan pulse may then be applied over the second base pulse. Alternatively, in the write period, a wave height of the scan pulse applied to the first electrodes may be such that a voltage between a first electrode to which the scan pulse is being applied and a third electrode to which the data pulse is not being applied exceeds a discharge sparking voltage between the first electrode and the third electrode.

A voltage of the second electrodes in the write period is preferably maintained in a range that (i) allows for a write sustain discharge to be induced by the write discharge and generated between the first and second electrodes in cells in which the write discharge is generated, and (ii) prevents a write sustain discharge from being generated between first and second electrodes in cells in which the write auxiliary discharge is generated.

Although described in detail in embodiments 3-1 to 3-6, according to a drive method and a drive circuit relating to (3) above, when the scan pulse is being applied to a first electrode in the write period, a voltage applied to an auxiliary discharge electrode positioned adjacent to the first electrode is adjusted such that a voltage between the first electrode and the auxiliary discharge electrode exceeds a discharge sparking voltage.

The drive circuit may be structured by a sustain pulse generation circuit for generating a sustain pulse to be applied to the first electrodes in the sustain period; an initialization pulse generation circuit that operates using an output voltage of the sustain pulse generation circuit as a reference potential, and applies an initialization pulse to the first electrodes in an initialization period that precedes the write period; a scan pulse generation circuit that operates using an output voltage of the initialization pulse generation circuit as a reference potential, and applies a scan pulse sequentially to the first electrodes; and a discharge inducing pulse generation circuit that operates using an output voltage of one of the initialization pulse generation circuit and the sustain pulse generation circuit as a reference potential, and applies a discharge inducing pulse to the auxiliary discharge electrodes so as to generate an auxiliary discharge between the first electrodes and the auxiliary discharge electrodes.

Alternatively, the drive circuit may be structured by a sustain pulse generation circuit for generating a sustain pulse to be applied to the first electrodes in the sustain period; an initialization pulse generation circuit that operates using an output voltage of the sustain pulse generation circuit as a reference potential, and applies an initialization pulse to the first electrodes in the initialization period preceding the write period; a scan pulse generation circuit that operates using an output voltage of the initialization pulse generation circuit as a reference potential, and applies a scan pulse sequentially to the first electrodes; a second initialization pulse generation circuit that operates using the output voltage of the sustain pulse generation circuit as a reference potential, and applies to the auxiliary discharge electrodes a second initialization pulse that has a lower voltage than the initialization pulse applied to the first electrodes; and a discharge inducing pulse generation circuit that operates using an output voltage of the second initialization pulse generation circuit as a reference potential, and applies a discharge inducing pulse to the auxiliary discharge electrodes so as to generate an auxiliary discharge between the first electrodes and the auxiliary discharge electrodes.

Alternatively, the drive circuit may be structured from a sustain pulse generation circuit for generating a sustain pulse to be applied to the first electrodes in the sustain period; an initialization pulse generation circuit that operates using an output voltage of the sustain pulse generation circuit as a reference potential, and applies an initialization pulse to the first electrodes in the initialization period preceding the write period; a scan pulse generation circuit that operates using an output voltage of the initialization pulse generation circuit as a reference potential, and applies a scan pulse sequentially to the first electrodes; a discharge inducing pulse generation circuit that operates using an output voltage of the sustain pulse generation circuit as a reference potential, and applies a discharge inducing pulse to the auxiliary discharge electrodes so as to generate an auxiliary discharge between the first electrodes and the auxiliary discharge electrodes; and a second initialization pulse generation circuit that operates using the output voltage of the discharge inducing pulse generation circuit as a reference potential, and applies to the auxiliary discharge electrodes a second initialization pulse that has a lower voltage than the initialization pulse applied to the first electrodes.

In the sustain period, sustain pulses having the same waveform may be applied to the first electrodes and the auxiliary discharge electrodes, or in the initialization period preceding the write period, initialization pulses having the same waveform may be applied to the first electrodes and the auxiliary discharge electrodes.

In the initialization period preceding the write period, a potential of the auxiliary discharge electrodes may be adjusted to be lower than a potential of the first electrodes. In this case, a positive initialization pulse may be applied to the first electrodes in the initialization period and the auxiliary discharge electrodes may be maintained at a ground potential, or alternatively a positive initialization pulse may be applied to the first electrodes in the initialization period and a negative pulse may be applied to the auxiliary discharge electrodes.

In the sustain period, the auxiliary discharge electrodes may be maintained in a high impedance state, or a potential of the auxiliary discharge electrodes may be maintained in a range within which a potential of the first electrodes and second electrodes fluctuates.

In order to achieve this, the discharge inducing pulse generation circuit or the second initialization pulse generation circuit may be set such that the auxiliary discharge electrodes are maintained in a high impedance state, or such that a potential of the auxiliary discharge electrodes is maintained in a range within which a potential of the first electrodes and second electrodes fluctuates.

In the write period, the write auxiliary discharge may be generated at the same time or prior to application of the data pulse to the third electrodes being commenced. Here, application of the data pulse to the third electrodes may be commenced approximately 500 ns or less after application of the scan pulse to the first electrodes is commenced.

With respect to the panel structure, a width of a gap between a first electrode and an auxiliary discharge electrode positioned adjacent thereto may be set such that when a voltage equivalent to half or more of an amplitude of the scan pulse is applied between the first electrode and the auxiliary discharge electrode, a discharge is generated between the first electrode and the auxiliary discharge electrode.

Furthermore, the width of this gap may be such that when a voltage equivalent to an amplitude of the scan pulse is applied between the first electrode and the auxiliary discharge electrode, the voltage exceeds a discharge sparking voltage between the first electrode and the auxiliary discharge electrode.

Furthermore, the width of this gap is preferably in a range of 10 μm to 50 μm inclusive.

Furthermore, the width of this gap may be less than a width of a gap between the first electrode and a second electrode positioned adjacent thereto. A width of a gap in an electrode extension area between a first electrode and an auxiliary discharge electrode positioned adjacent thereto may be set so that a discharge is not generated in the electrode extension area when a voltage equivalent to an amplitude of the scan pulse is applied between the first electrode and the auxiliary discharge electrode. Here, the width of this gap is preferably in a range of 10 μm to 300 μm inclusive.

In a vicinity of the auxiliary discharge electrodes, a shading film is preferably formed that prevents light generating from the auxiliary discharge from reaching a panel surface.

In each cell, at least one of the first electrode and the auxiliary discharge electrode may have a projection that extends toward the other electrode.

Although described in detail in embodiments 4-1 to 4-6, according to a drive method and a drive circuit relating to (4) above, when the scan pulse is being applied to a first electrode in the write period, a volt-age between a first auxiliary discharge electrode positioned adjacent to the first electrode and a second auxiliary discharge electrode positioned adjacent to the first auxiliary discharge electrode is adjusted to exceed a discharge sparking voltage between the first and second auxiliary discharge electrodes.

The drive circuit may be structured by a sustain pulse generation circuit for generating a sustain pulse to be applied to the first electrodes in the sustain period; an initialization pulse generation circuit that operates using an output voltage of the sustain pulse generation circuit as a reference potential, and applies an initialization pulse to the first electrodes and the first auxiliary discharge electrodes in the initialization period preceding the write period; a scan pulse generation circuit that operates using an output voltage of the initialization pulse generation circuit as a reference potential, and applies a scan pulse sequentially to the first electrodes; and a discharge inducing pulse generation circuit that operates using the output voltage of one of the initialization pulse generation circuit and the sustain pulse generation circuit as a reference potential, and applies a discharge inducing pulse to the second auxiliary discharge electrodes so as to generate an auxiliary discharge between the first and second auxiliary discharge electrodes.

Alternatively, the drive circuit may be structured by a sustain pulse generation circuit for generating a sustain pulse to be applied to the first electrodes in the sustain period; an initialization pulse generation circuit that operates using an output voltage of the sustain pulse generation circuit as a reference potential, and applies an initialization pulse to the first electrodes and the first auxiliary discharge electrodes in the initialization period preceding the write period; a scan pulse generation circuit that operates using an output voltage of the initialization pulse generation circuit as a reference potential, and applies a scan pulse sequentially to the first electrodes; a second initialization pulse generation circuit that operates using the output voltage of the sustain pulse generation circuit as a reference potential, and applies to the second auxiliary discharge electrodes a second initialization pulse that has a lower voltage than the initialization pulse applied to the first electrodes; and a discharge inducing pulse generation circuit that operates using an output voltage of the second initialization pulse generation circuit as a reference potential, and applies a discharge inducing pulse to the second auxiliary discharge electrodes so as to generate an auxiliary discharge between the first and second auxiliary discharge electrodes.

Alternatively, the drive circuit may be structured by a sustain pulse generation circuit for generating a sustain pulse to be applied to the first electrodes in the sustain period; an initialization pulse generation circuit that operates using an output voltage of the sustain pulse generation circuit as a reference potential, and applies an initialization pulse to the first electrodes and the first auxiliary discharge electrodes in the initialization period preceding the write period; a scan pulse generation circuit that operates using an output voltage of the initialization pulse generation circuit as a reference potential, and applies a scan pulse sequentially to the first electrodes; a discharge inducing pulse generation circuit that operates using an output voltage of the sustain pulse generation circuit as a reference potential, and applies a discharge inducing pulse to the second auxiliary discharge electrodes so as to generate an auxiliary discharge between the first auxiliary discharge electrodes and the second auxiliary discharge electrodes; and a second initialization pulse generation circuit that operates using the output voltage of the discharge inducing pulse generation circuit as a reference potential, and applies to the second auxiliary discharge electrodes a second initialization pulse that has a lower voltage than the initialization pulse applied to the first electrodes.

Each first electrode may be connected to a first auxiliary discharge electrode positioned adjacent thereto, and sustain pulses having the same waveform may be applied to the first electrodes, the first auxiliary discharge electrodes and the second auxiliary discharge electrodes.

In the sustain period, sustain pulses having the same waveform may be applied to the first electrodes, the first auxiliary discharge electrode, and the second auxiliary discharge electrode.

In the initialization period preceding the write period, a potential of the second auxiliary discharge electrodes may be adjusted to be lower than a potential of the first auxiliary discharge electrodes.

To achieve this, in the initialization period, a positive initialization pulse may be applied to the first auxiliary discharge electrodes, and the second auxiliary discharge electrodes maybe maintained at a ground potential, or alternatively a positive initialization pulse may be applied to the first auxiliary discharge electrodes, and a negative pulse may be applied to the second auxiliary discharge electrodes.

In the sustain period, the second auxiliary discharge electrodes may be maintained in a high impedance state, or a potential of the second auxiliary discharge electrodes may be maintained in a range within which a potential of the first electrodes and second electrodes fluctuates.

To achieve this, the discharge inducing pulse generation circuit or the second initialization pulse generation circuit may be set such that the second auxiliary discharge electrodes are maintained in a high impedance state, or such that the potential of the second auxiliary discharge electrodes is maintained in a range within which a potential of the first electrodes and second electrodes fluctuates.

In the write period, the write auxiliary discharge may be generated at the same time or prior to application of the data pulse to the third electrodes being commenced, or alternatively, application of the data pulse to the third electrodes may be commenced approximately 500 ns or less after application of the scan pulse to the first electrodes is commenced.

Here, in the write period, the write auxiliary discharge may be generated between (i) a first auxiliary discharge electrode positioned adjacent to a first electrode to which the scan pulse will next be applied and (ii) a second auxiliary discharge electrode positioned adjacent to the first auxiliary discharge electrode.

In this case, each first electrode may be connected to a first auxiliary discharge electrode positioned adjacent to a first electrode to which the scan pulse is next applied, and in the write period, the same voltage waveform may be applied to (i) the first electrode to which the scan pulse is being applied and (ii) the first auxiliary discharge electrode positioned adjacent to the first electrode to which the scan pulse is next applied.

With respect to the panel structure, a width of a gap between a first auxiliary discharge electrode and a second auxiliary discharge electrode positioned adjacent thereto is set such that when a voltage equivalent to half or more of an amplitude of the scan pulse is applied between the first auxiliary discharge electrode and the second auxiliary discharge electrode, a discharge is generated between the first electrode and the auxiliary discharge electrode. Here, the preferable width of the gap is in a range of 10 μm to 50 μm inclusive.

Furthermore, a width of a gap in an electrode extension area between a first auxiliary discharge electrode and a second auxiliary discharge electrode positioned adjacent thereto may be set so that a discharge is not generated in the electrode extension area when a voltage equivalent to an amplitude of the scan pulse is applied between the first auxiliary discharge electrode and the second auxiliary discharge electrode. Here, the width of this gap is preferably in a range of 10 μm to 300 μm inclusive.

In a vicinity of the auxiliary discharge electrodes, a shading film is preferably formed that prevents light generating from the auxiliary discharge from reaching a panel surface.

In each cell, at least one of the first auxiliary discharge electrode and the second auxiliary discharge electrode may have a projection that extends toward the other electrode.

BRIEF DESCRIPTION OF THE DRAWINGS

FIGS. 25A~25E show the generation of discharges and the like within a panel according to embodiment 3-4;

FIGS. 41A~41E show the generation of discharges and the like within a panel according to embodiment 4-4;

BEST MODE FOR CARRYING OUT THE INVENTION

Embodiment 1-1

Structure of PDP Display Device

Figure 1:
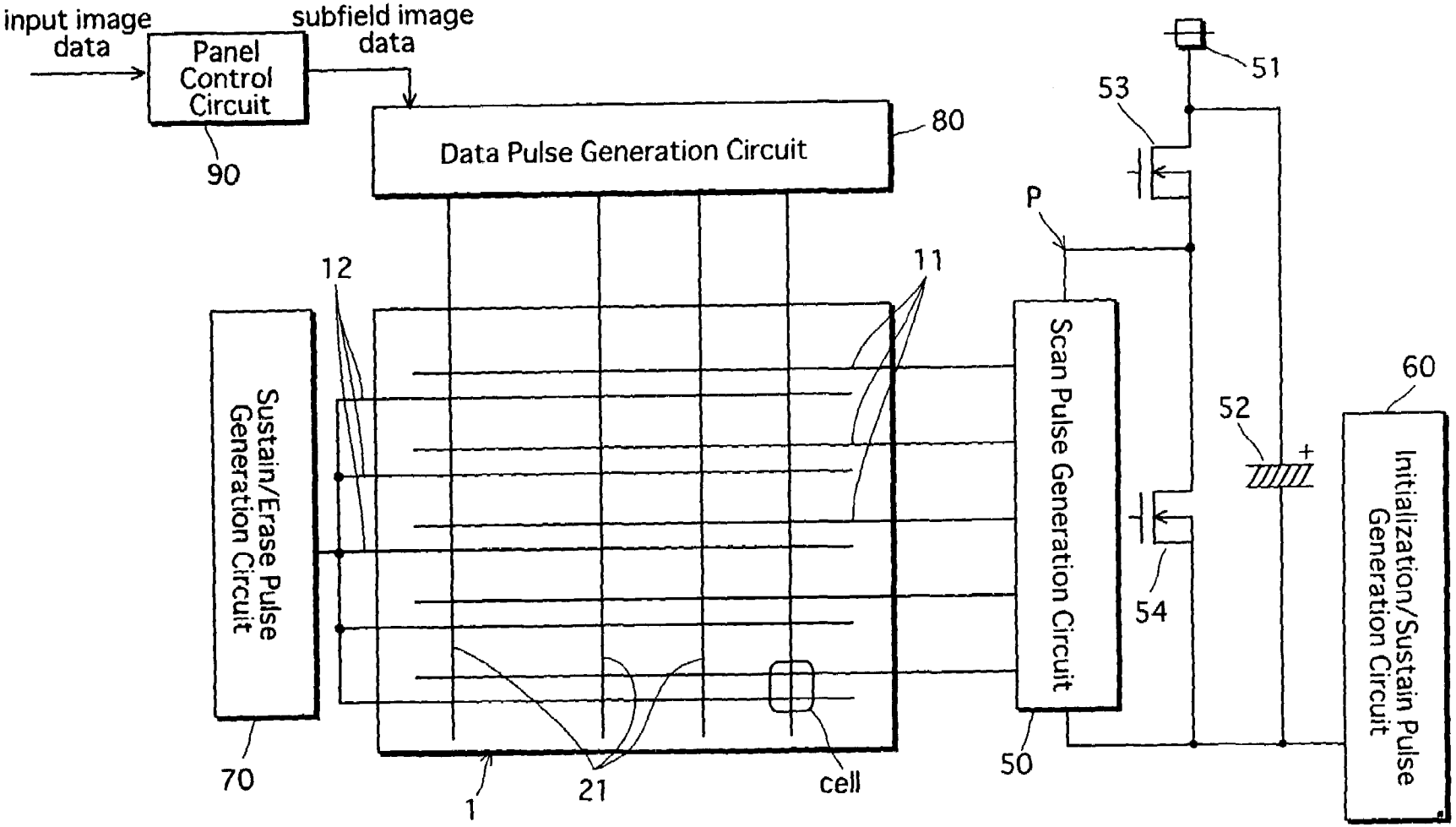
FIG. 1 shows a structure of a PDP display device according to an embodiment 1-1.

FIG. 1 shows a structure of a PDP display device according to embodiment 1-1.

The structure of the PDP display device is described below, and is substantially the same as a conventional surface discharge PDP.

As with a conventional PDP, a PDP 1 in the PDP display device includes a plurality of scan electrodes 11 extending in a horizontal direction, a plurality of sustain electrodes 12 extending parallel to the scan electrodes, and a plurality of data electrodes 21 extending orthogonally to the scan electrodes.

Although not depicted in FIG. 1, PDP 1 is structured by a front glass substrate and a back glass substrate that are arranged with a gap therebetween, and the gap is filled with a discharge gas so as to form a discharge space. Scan electrodes 11 and sustain electrodes 12 are provided on the facing surface of the front glass substrate, and data electrodes 21 are provided on the facing surface of the back glass substrate. A dielectric layer and protective layer are provided over the scan and sustain electrodes on the front glass substrate, and phosphor layers corresponding to the colors red (R), green (G), and blue (B) are provided over the data electrodes on the back glass substrate.

Furthermore, a plurality of discharge cells are formed in a matrix pattern where scan electrodes 11 extend across data electrodes 21, and image display is achieved is achieved by varying the combination of on-states and off-states of each discharge cell.

In a method (i.e. field time-division gray scale display method) used to drive the PDP, intermediate gray scales are expressed by time dividing a single frame (i.e. TV field) into a plurality of subframes (i.e. subfields) and varying the combination of subframes.

Figure 2:
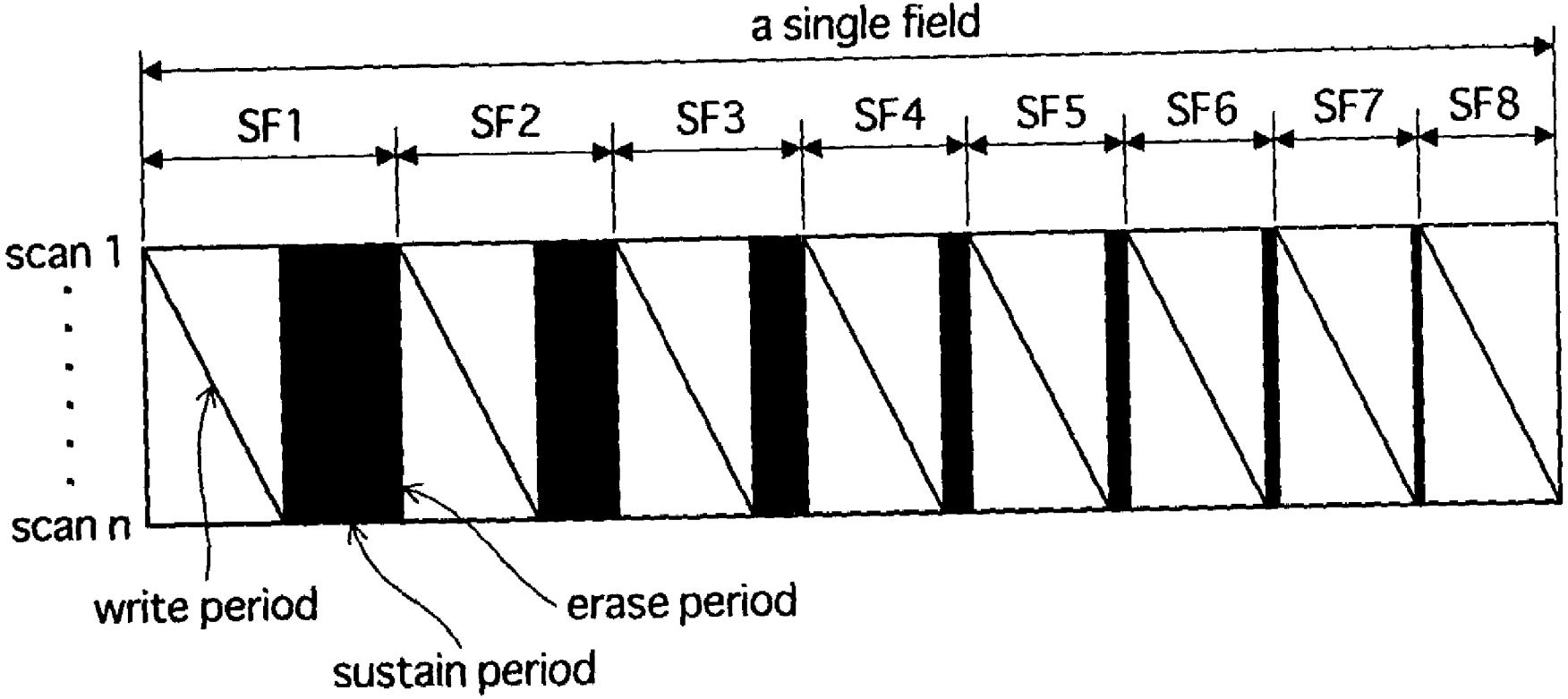
FIG. 2 shows the division of a single field to express 256 gray scales using a field time-division gray scale display method.

For example, since a television image according to the NTSC standard is composed of sixty fields per second, a single TV field is set at 16.7 ms. FIG. 2 shows the division of a single field to express 256 gray scales, with time represented in the lengthwise direction. As shown in FIG. 2, a single TV field is structured by eight subfields, and the ratio of luminescence periods of the subfields is 1, 2, 4, 8, 16, 32, 64, and 128, respectively. Here, by using the subfields to vary the combination of on-states and off-states of each cell, it is possible to control the luminescence periods within a single TV field of the cells using 256 gray scales.

Figure 3:
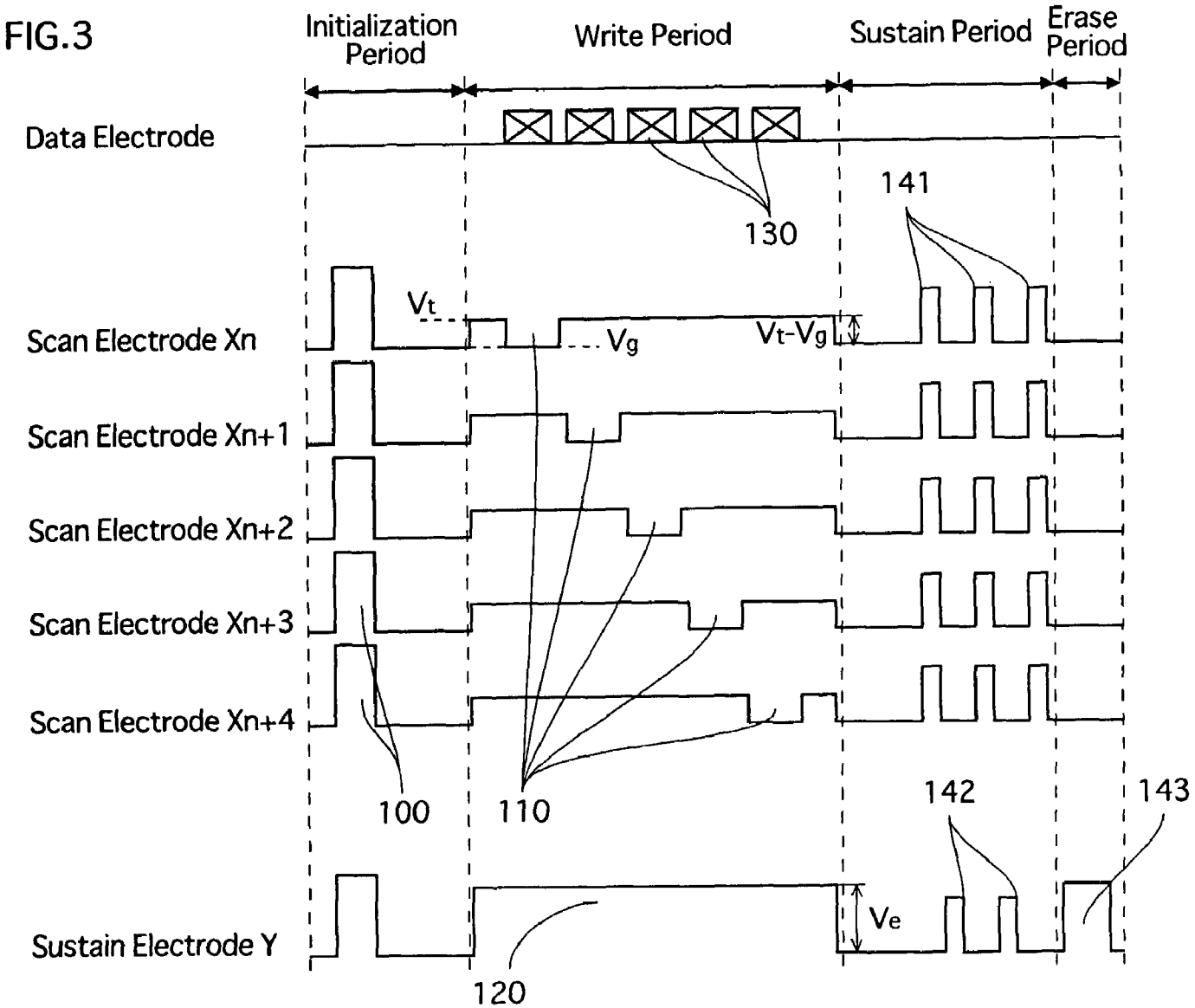
FIG. 3 shows drive waveforms of the PDP according to embodiment 1-1.

FIG. 3 shows drive waveforms generated by the above drive circuit with respect to a single subfield.

Basically, the drive method of the present embodiment is the same as a conventional method for driving a surface discharge PDP. Firstly, in an initialization period, an initialization pulse 100 is applied to scan electrodes 11 to generate an initialization discharge in all of the cells within the panel. A space charge within the entire panel is equilibrized by the initialization discharge, and wall charge, which is effective in the generation of the write discharge, is stored in a vicinity of data electrodes 21.

Next, in a write period, a negative scan pulse 110 is applied sequentially to the scan electrodes, and at the same time a positive data pulse 130 is applied to the data electrodes in accordance with the display data, and as a result a write discharge is generated (i.e. writing is conducted) in cells positioned at an intersection of the scan electrodes and data electrodes to which the respective pulses are applied.

Next, in a sustain period, high voltage sustain pulses 401 and 402 are applied alternately to scan electrodes 11 and sustain electrodes 12. This results in a discharge being repeatedly generated only in the cells in which the write discharge occurred, and image display is achieved by using the luminescence generated from this sustain discharge. Then, in an erase period that follows the sustain period, the wall charge stored on the dielectric layer as a result of the sustain discharge is erased by applying an erase pulse 403 to sustain electrodes 12.

Drive Waveforms and Drive Circuits

A drive circuit for realizing the above waveforms will now be described.

As shown in FIG. 1, The PDP display device includes a scan pulse generation circuit 50 for applying a scan pulse sequentially to the plurality of scan electrodes 11, an initialization/sustain pulse generation circuit 60 for applying an initialization pulse and a sustain pulse collectively to the plurality of scan electrodes 11, a sustain/erase pulse generation circuit 70 for applying a sustain pulse and an erase pulse collectively to the plurality of sustain electrodes 12, a data pulse generation circuit 80 for applying a data pulse to data electrodes 21 in accordance with the display data, and a pulse control circuit 90 for controlling the above pulse generation circuits as well as for processing the image data.

In addition to extracting image data for each field from inputted image data, producing image data for each subfield from the extracted field image data (i.e. subfield image data), and storing the produced subfield image data in frame memory, pulse control circuit 90 outputs data one line at a time to data pulse generation circuit 80 from the current subfield image data stored in frame memory. Furthermore, based, for example, on the horizontal synchronizing signal, vertical synchronizing signal and the like of the inputted image data, pulse control circuit 90 produces a trigger signal that indicates an application timing of the various pulses, and sends the generated trigger signal to the pulse generation circuits.

Pulse generation circuits 50, 60, 70 and 80 apply the various pulses to electrodes 11, 12 and 21 based on the trigger signal sent from pulse control circuit 90.

Scan pulse generation circuit 50 and initialization/sustain pulse generation circuit 60 are connected in a manner that allows circuit 50 to operate using the output of circuit 60 as a provisional ground level Vg, Furthermore, a power supply 51, a capacitor 52, a FET 53 and a FET 54 of circuit 50 are provided in a vicinity of circuit 50.

In the write period FET 53 is "on" and FET 54 is "off", and in the other periods FET 53 is "off" and FET 54 is "on". Thus, power is only supplied to circuit 50 from power supply 51 during the write period.

Also, in the write period, the reference potential of scan electrodes 11 (i.e the reference potential at point P in FIG. 1) is maintained at a potential Vt by capacitor 52, and a negative scan pulse of amplitude (Vt−Vg) is applied by circuit 50 with respect to this reference potential (see FIG. 3).

Data pulse generation circuit 80 will be described in detail in a later section, although basically, circuit 80 includes a line memory 81 (see FIG. 6) for temporarily storing data showing subfield image data inputted one line at a time (i.e. data that shows for each data electrode 21, whether the data electrode is "on" or "off"), and functions to output a data pulse in parallel to a plurality of data electrodes 21 in the write period.

Operation in the Write Period

Figure 4:
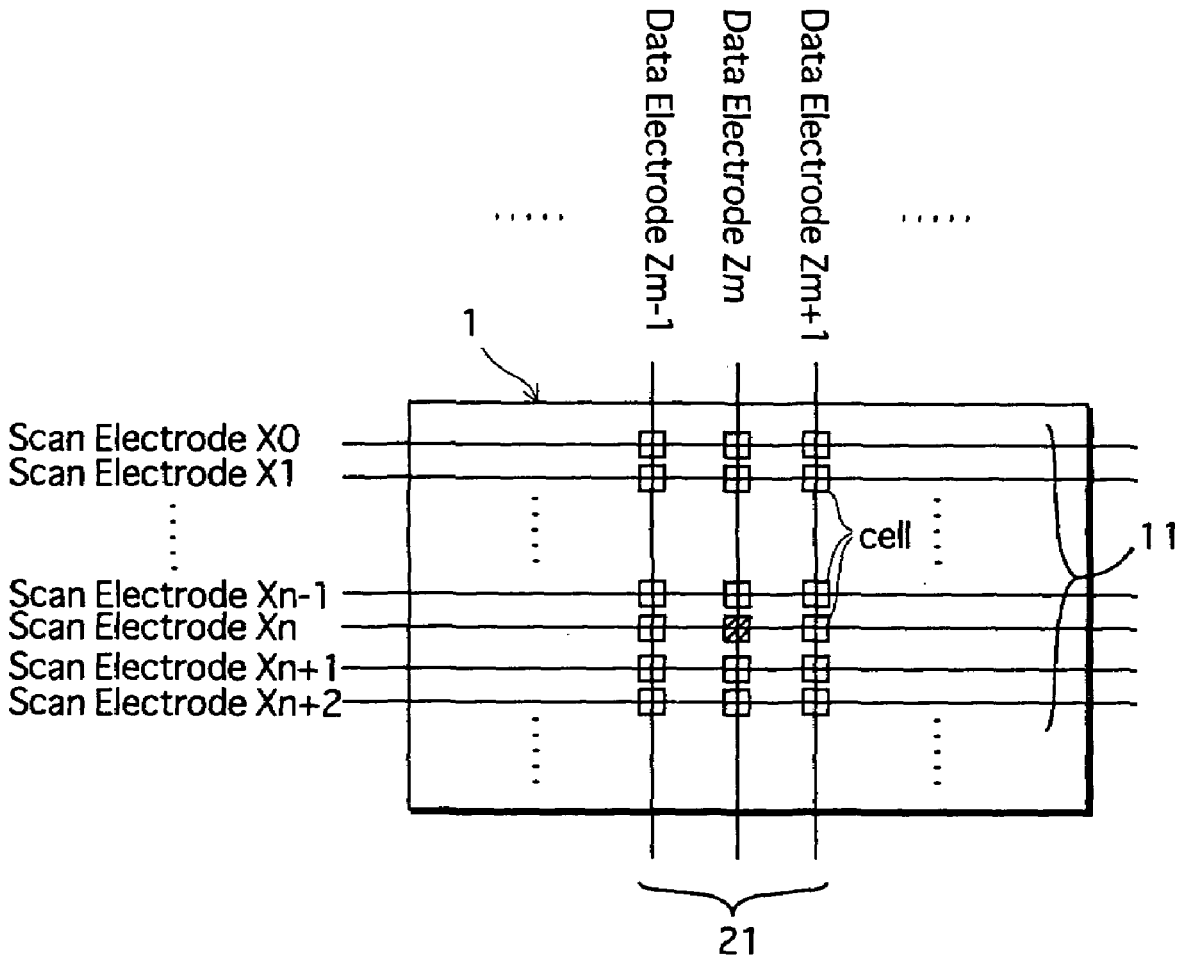
FIG. 4 shows a positioning of scan electrodes and data electrodes in the PDP according to embodiment 1-1.

FIG. 4 shows a positioning of scan electrodes 11 and data electrodes 21 in PDP 1. In FIG. 4, areas marked by squares where electrodes 11 and 21 extend across each other show the discharge cells. These cells are the smallest unit of luminescence in the panel.

The plurality of scan electrodes 11 extending in the horizontal direction are provided in the order X0, X1, . . . , Xn−1, Xn, Xn+1 . . . from top to bottom. The plurality of data electrodes 21 extending in the vertical direction are provided in the order Z0, Z1, . . . , Zm−1, Zm, Zm+1 . . . from left to right.

Here, when X0, X1, . . . , Xn−1, Xn, Xn+1 . . . , and Z0, Z1, Zm−1, Zm, Zm+1 . . . are used in the description of present invention, the cell positioned where scan electrode Xn extends across data electrode Zm (i.e. the shaded cell in FIG. 4) is designated as an "on" cell, and the other cells are designated as "off" cells.

Figure 5:
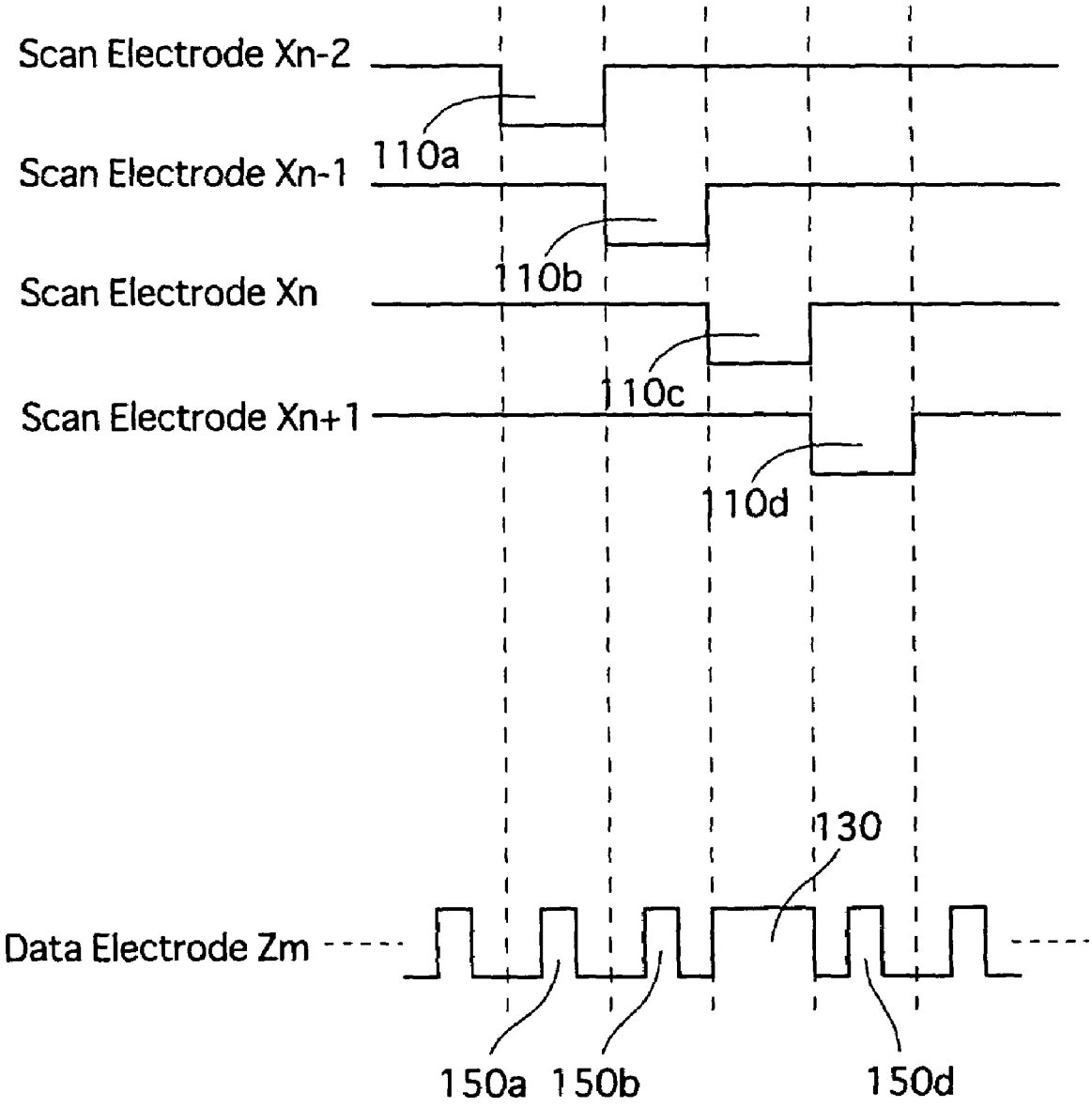
FIG. 5 shows exemplary drive waveforms applied to the scan electrodes and data electrodes in FIG. 4.

FIG. 5 shows exemplary drive waveforms applied to the scan and data electrodes in FIG. 4.

As shown in FIG. 5, when a scan pulse 110*c* is being applied to scan electrode Xn, a data pulse 130 is applied to data electrode Xm corresponding to the on-cell, and when scan pulses 110*a*, 110*b* and 110*d* are being applied respectively to scan electrodes Xn−2, Xn−1, Xn+1, a data pulse 130 is applied to data electrode Xm corresponding to the off-cells.

As shown in FIG. 3, sustain/erase pulse generation circuit 70 applies a positive sustain write pulse 120 of amplitude Ve to sustain electrodes 12 in the write period. Sustain write pulse 120 is applied so as to generate a write sustain discharge when the write discharge occurs, and thus to store negative wall charge on the dielectric layer over sustain electrodes 12.

Here, with-respect to cells corresponding to the scan electrode to which scan pulse 110 is being applied, a write discharge is generated in the on-cell and a write auxiliary discharge (hereafter "auxiliary discharge") is generated in the off-cells, the magnitude of the auxiliary discharge being insufficient for writing to occur. The write discharge induces a write sustain discharge to be generated in the on-cell, and writing is thus completed. On the other hand, even though an auxiliary discharge is generated in the off-cells, the magnitude of the auxiliary discharge is insufficient to generate a write sustain discharge.

Priming particles generated by the write discharge or the auxiliary discharge also flow into cells corresponding to scan electrode to which the scan pulse will next be applied (i.e the cells adjacent to and below the cells corresponding to a scan electrode to which the scan pulse is currently being applied).

Consequently, when the scan pulse is applied to the next scan electrode, a state of the cells corresponding to this scan electrode becomes conducive to the generation of a discharge (i.e. the priming particles that flow into these cells help to generate a write discharge), and thus a write discharge can be generated in the on-cell only a very short period after application of the scan and data pulses is commenced (i.e. this structure allows for write discharge delay to be reduced).

Thus, according to this structure, the scan and data pulses can be set to have a short pulse width (i.e. approx. 1.0 μsec), the length of the write period can be shortened in comparison to a conventional write period, and the occurrence of defective writing can be suppressed.

The following description relates to a structure of a drive circuit that conducts the driving described above by applying the data pulse and auxiliary pulse selectively to data electrodes 21.

Figure 6:
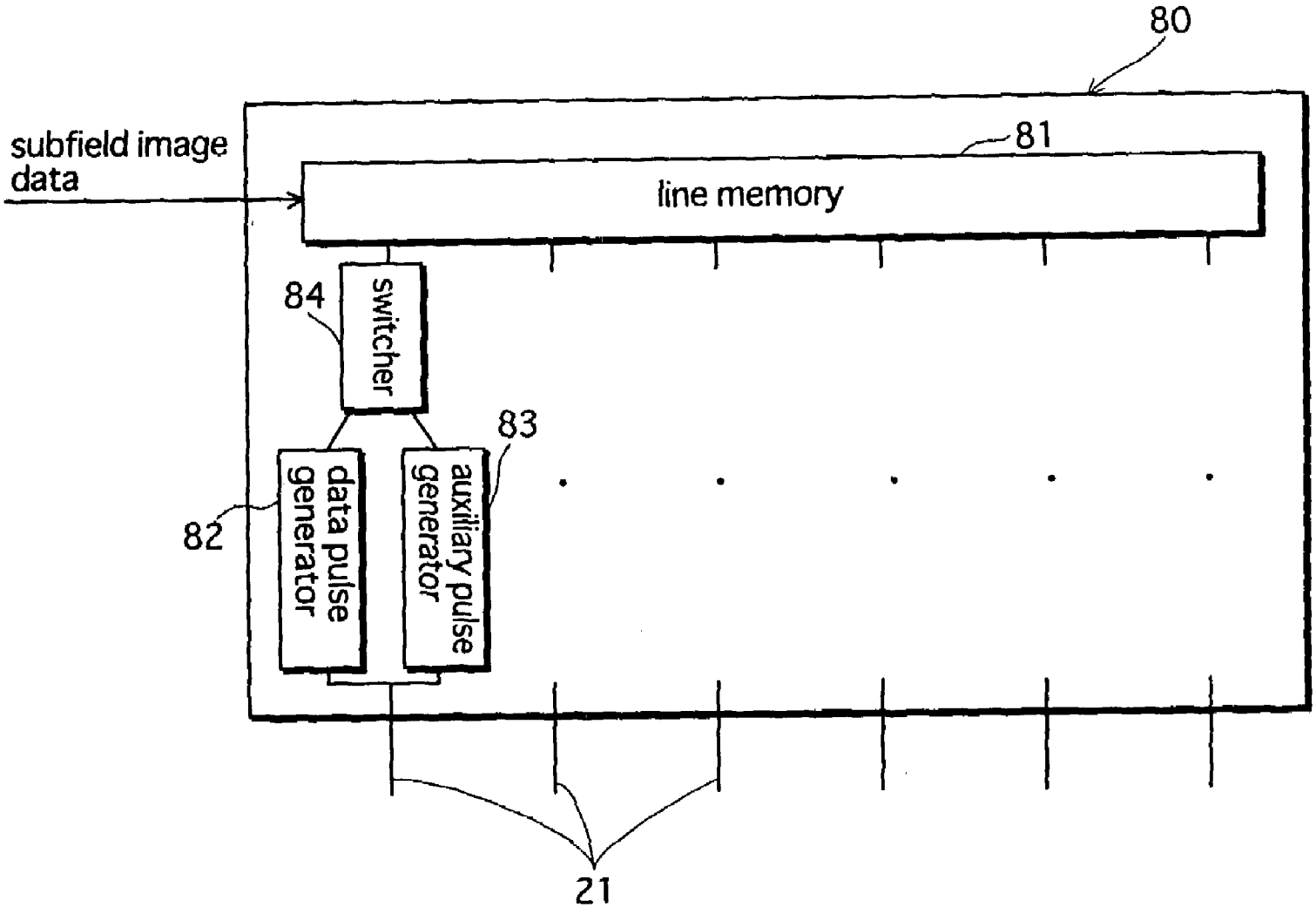
FIG. 6 shows a structure of a data pulse generation circuit 80 in FIG. 1.

As shown in FIG. 6, in addition to a data pulse generator 82 for generating the data pulse, data pulse generation circuit 80 includes, for each data electrode, an auxiliary pulse generator 83 for generating an auxiliary pulse, and a switcher 84 for selectively operating the two pulse generators 82 and 83 (FIG. 6 shows only the structure of the data electrode positioned on the far left-hand side of the panel, and the other data electrode structures have been omitted).

When corresponding data stored in a line memory 81 shows "on", switcher 84 drives data pulse generator 82 in order to applied a data pulse to data electrodes 21, and when corresponding data stored in line memory 81 shows "off", switcher 84 drives auxiliary pulse generator 83 so as to apply an auxiliary pulse to data electrodes 21.

According to the present embodiment as described above, a panel structure and basic drive method that are the same as conventional technology can be used to achieve a high quality of image display while at the same time reducing the length of the write period.

Embodiment 1-2

A structure of the PDP display device according to the present embodiment is the same as in embodiment 1-1.

Furthermore, the application in the write period of the auxiliary pulse to the data electrodes corresponding to the off-cells and the data pulse to the data electrodes corresponding to the on-cells is also the same as in embodiment 1-1.

In embodiment 1-1, the pulse width of the auxiliary pulse was set to be shorter than that of the data pulse. However, in the present embodiment, the average voltage absolute value of the auxiliary pulse is set to be lower than that of the data pulse. Here, the fact that the auxiliary pulse and the data pulse both have a positive polarity means that the average voltage absolute value of the auxiliary pulse is described as being set to a "lower" value than that of the data pulse.

Since the auxiliary discharge generated in off-cells corresponding to the scan electrode to which the scan pulse is being applied is smaller in magnitude than the write discharge, the same effects as in embodiment 1-1 can be achieved, even when the waveforms are regulated as described above.

Figure 7B:
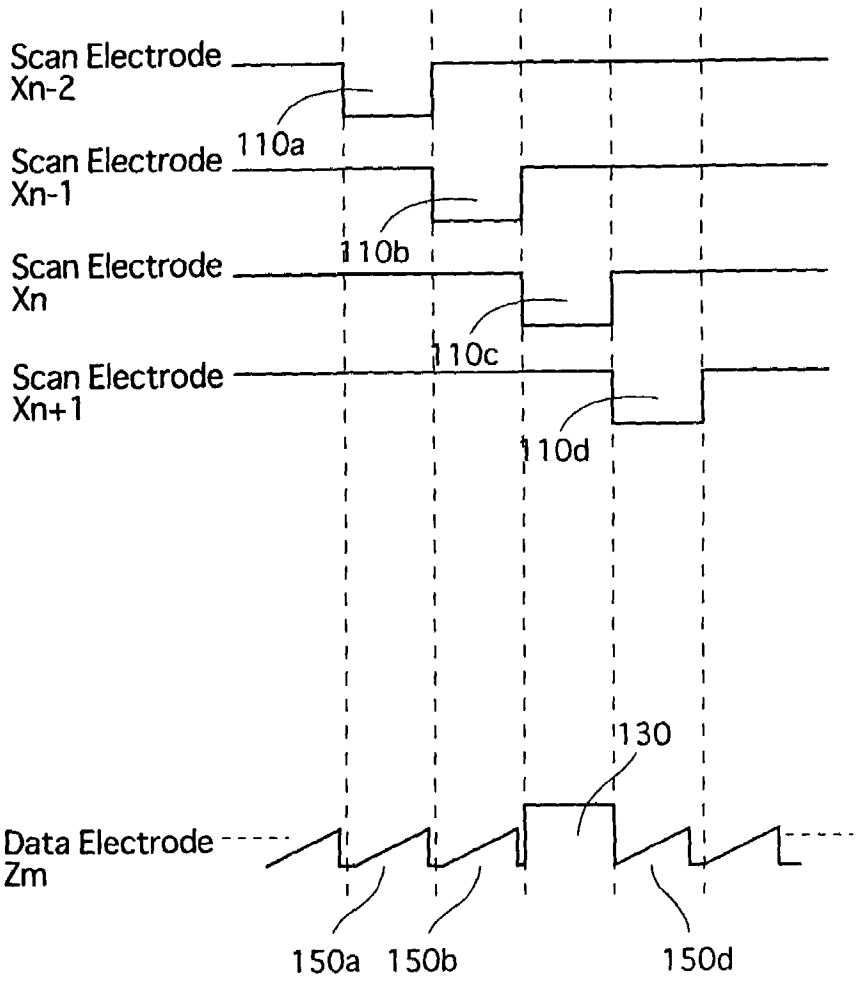
FIGS. 7A~7C show in detail exemplary auxiliary pulse waveforms according to an embodiment 1-2.
Figure 7A:
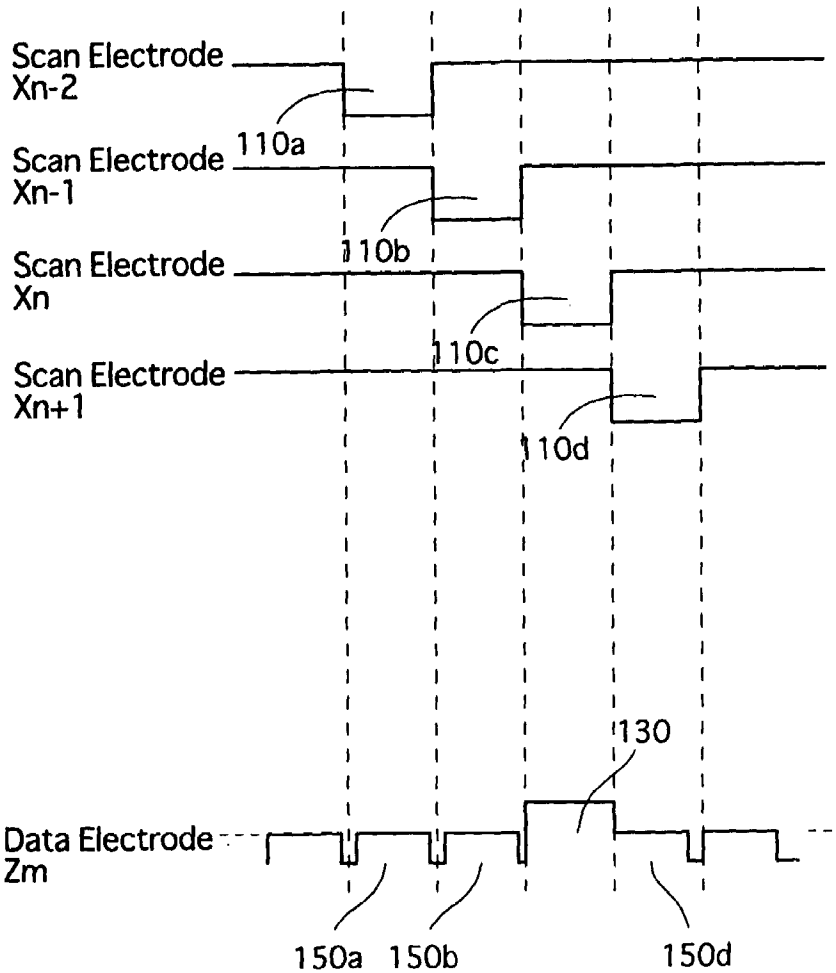
Figure 7C:
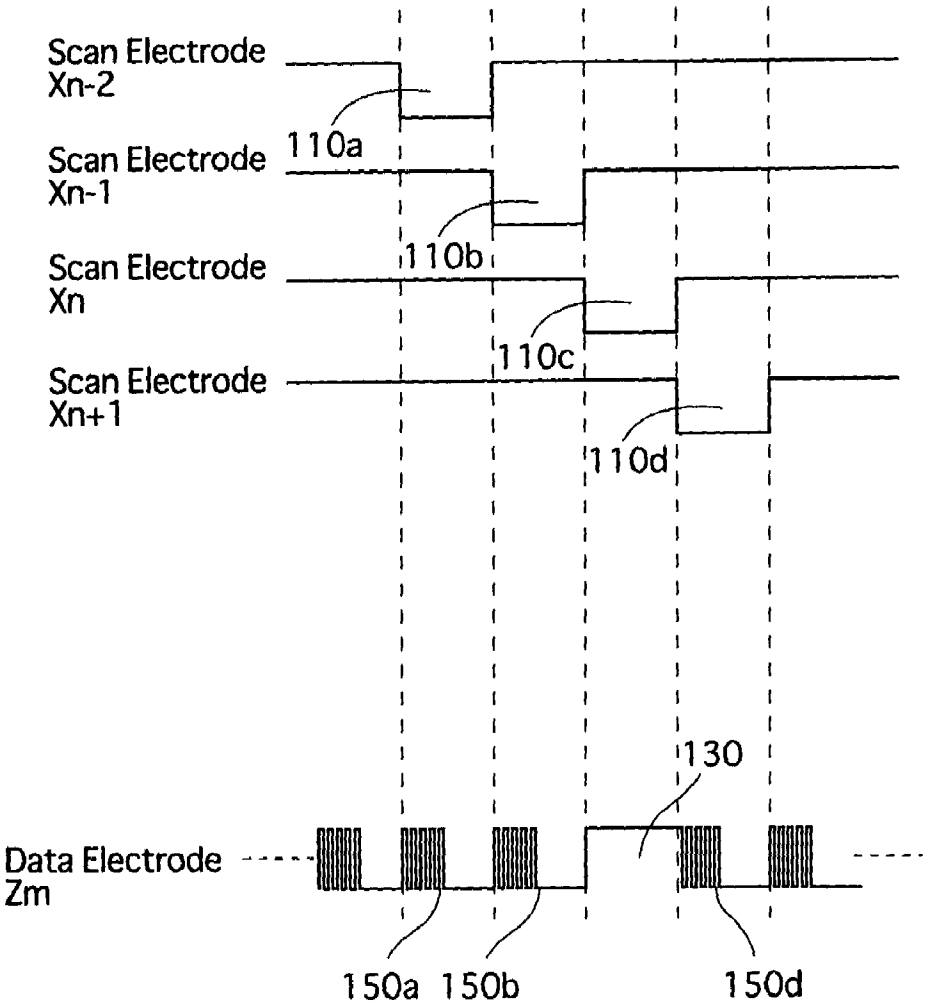

Specific examples of the auxiliary pulse waveforms are shown in FIGS. 7A to 7C.

In the example shown in FIG. 7A, although the pulse width of auxiliary pulses 150*a*, 150*b*, . . . , is not substantially different from that of data pulse 130, the wave height of the auxiliary pulses has been set so as to be shorter than that of data pulse 130.

In the example shown in FIG. 7B, the waveforms of the auxiliary pulses are in the shape of triangular waves.

Having waveforms in the shape of triangular waves allows the auxiliary discharge to be generated gradually, and thus the slight luminescence that follows the auxiliary discharge can be suppressed. Any deterioration in contrast can thus be minimized.

In the example shown in FIG. 7C, the waveforms of the auxiliary pulses are in the shape of a pulse train.

Here also, having waveforms in the shape of a pulse train allows the auxiliary discharge to be generated gradually, and thus the slight luminescence that follows the auxiliary discharge can be suppressed, and any deterioration in contrast can be minimized.

Embodiment 1-3

In embodiment 1-1, the auxiliary pulse is applied to data electrodes corresponding to off-cells in all of the eight subfields (SF1~SF8) structuring a single field. However, in the present embodiment, the auxiliary pulse is applied to data electrodes corresponding to the off-cells in subfields having a comparatively high brightness weight (i.e. SF1~SF5), whereas in the write period of subfields having a comparatively low brightness weight (i.e. SF6~SF8) only a write pulse is applied to data electrodes corresponding to off-cells (i.e. the auxiliary pulse is not applied to these data electrodes).

Figure 8:
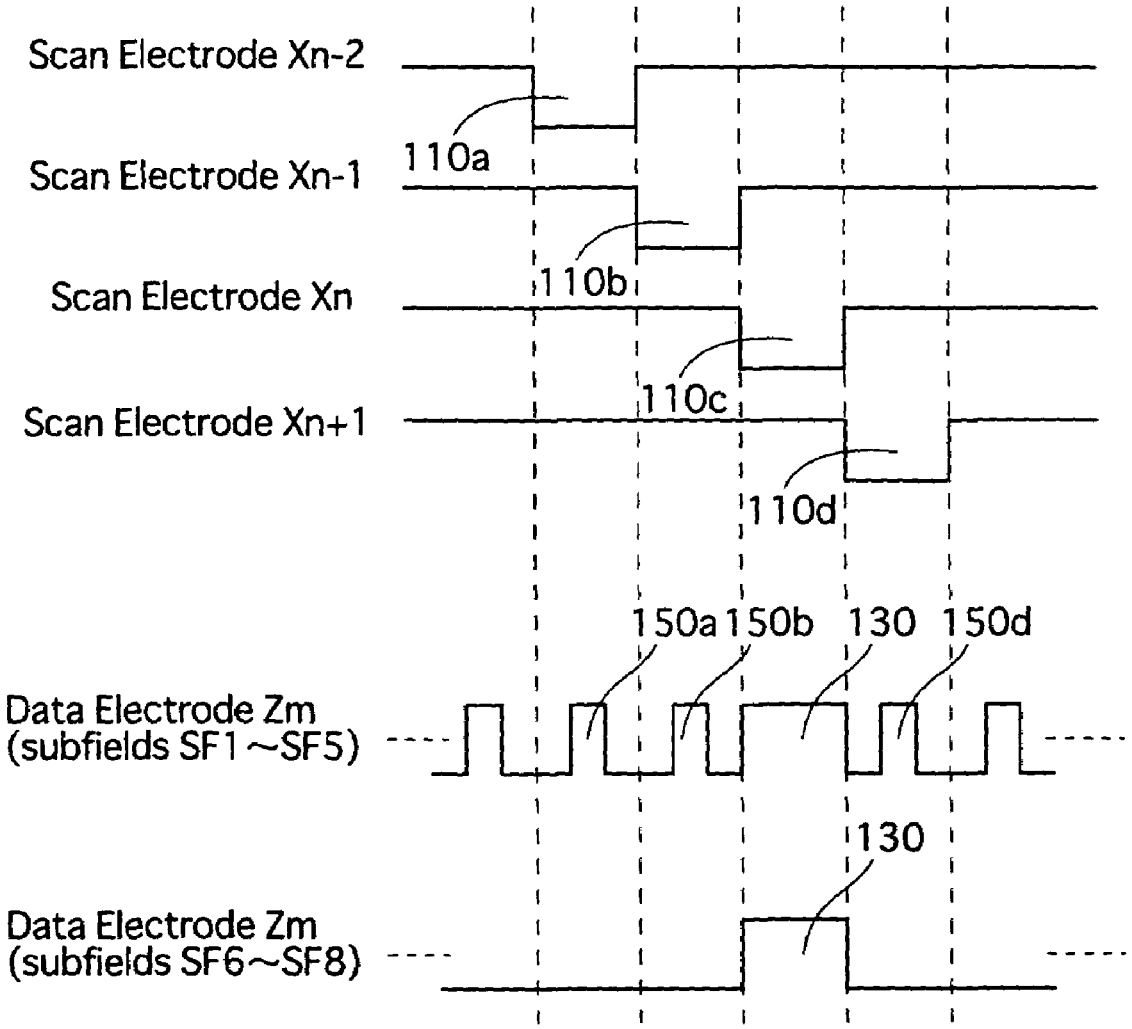
FIG. 8 shows drive waveforms of a PDP according to an embodiment 1-3.

In other words, as shown in FIG. 8, when scan pulse 110*c* is applied to scan electrode Xn, data pulse 130 is applied to data electrode Zm corresponding to the on-cell in any of subfields SF1 to SF8 so as to write the cell, although with respect to the off-cells, auxiliary pulses 150*a*, 150*b*, are only applied to data electrode Zm in subfields SF1 to SF5, whereas in subfields SF6 to SF8, auxiliary pulses are not applied to data electrode Zm.

According to this method of driving the panel, writing can be conducted effectively in subfields having higher brightness weights (i.e. those most visible to the human eye) even when the write period is shortened as a result of conducting the auxiliary discharge, and thus a high quality of image display without defective writing can be achieved.

On the other hand, although writing may not always be conducted effectively in subfields having a lower brightness weight due to an auxiliary discharge not being generated in these subfields, the low brightness weight of these subfields means that even if defective writing does occur, visually there will be little detrimental effect.

Furthermore, this structure allows the number of auxiliary discharges generated per field to be reduced in comparison to embodiment 1-1. Consequently, it is possible to suppress the occurrence of detrimental effects such as reductions in contrast due to auxiliary discharges, or increases in power consumption due to the increases in the frequency with which charging and discharging is conducted between the scan electrodes and data electrodes functioning as a capacitive load.

In order to realize the above drive method, data pulse generation circuit 80 may include a switch for turning auxiliary pulse generator 83 on and off. Here, the switch may be set to "on" in subfields SF1 to SF5, and "off" in subfields SF6 to SF8.

Embodiment 1-4

According to the present embodiment, when the image data of each field is comparatively bright, the auxiliary pulse is applied in the off-cells as described in embodiment 1-1 (FIG. 5), although when the image is dark, the auxiliary pulse is not applied.

Whether or not the image data in each field is bright can be judged, for example, by determining whether the total number of cells illuminated in a single field exceeds 10% of the total number of cells in PDP 1. Here, the "cells illuminated in a single field" refers to the cells in all of the subfields in a single field, with the exception of the off-cells. That is, the existence of an on-cell in even one of the subfields in a field is here defined as "cells illuminated in a single field".

The effects described below can be achieved by only generating an auxiliary discharge when the image data of the field is comparatively bright.

The effect of defective writing on an image is comparatively greater for a bright image than a dark image. Consequently, an acceptably high quality of image display can be achieved if, as in the present embodiment, defective writing is suppressed by generating an auxiliary discharge only when the image is bright.

On the other hand, generating an auxiliary discharge in the off-cells results in a faint luminescence, and this can reduce contrast. The reduction in contrast due to this faint luminescence is comparatively greater with respect to dark images. Consequently, contrast can be maintained, as in the present embodiment, by not generating an auxiliary discharge when the image is dark.

Thus, in the present embodiment, improvements in image quality can be achieved by preventing defective writing while at the same time maintaining contrast.

Furthermore, because the number of auxiliary discharges is reduced in comparison to embodiment 1-1, the present embodiment allows for power consumption to be suppressed.

A circuit for realizing the above drive method may be provided as follows.

A switch may be provided in data pulse generation circuit 80 for turning data pulse generator 83 "on" and "off", and an on-cell counter may be provided in pulse control circuit 90 for counting the number of on-cells in a single field.

Here, when the total number of on-cells counted by the on-cell counter exceeds a predetermined reference value (e.g. 10% of the total number of cells in PDP 1) the switch may be set to "on", and when the number of on-cells counted by the on-cell counter is less than or equal to 10% of the total number of cells in PDP 1 the switch may be set to "off".

Embodiment 1-5

Whereas in embodiment 1-1 an auxiliary discharge is generated in all of the off-cells in the write period, in the present embodiment an auxiliary discharge is only generated in off-cells positioned in a vicinity of the on-cells.

Figure 9:
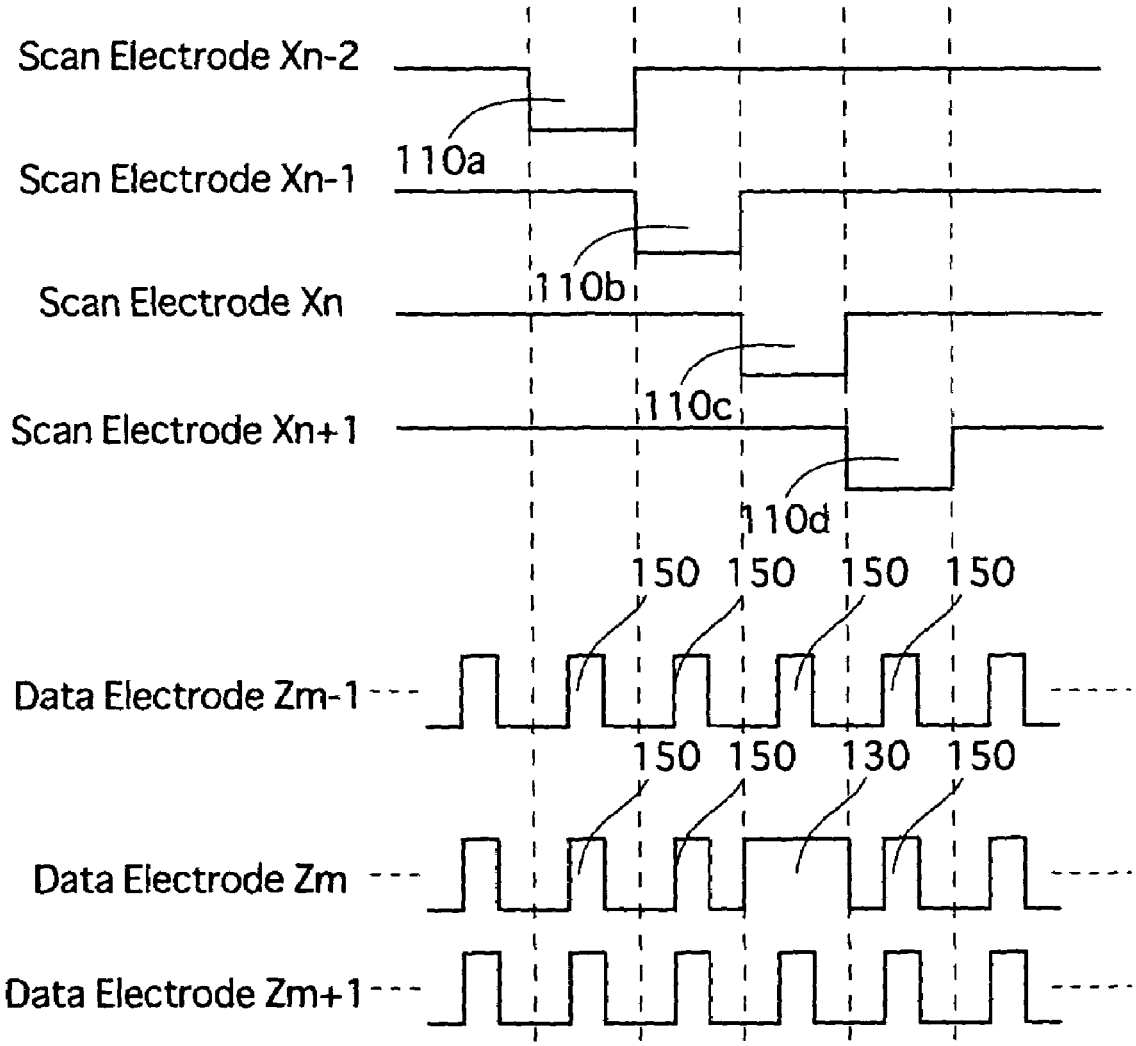
FIG. 9 shows drive waveforms of a PDP according to an embodiment 1-5.

FIG. 9 shows drive waveforms applied to each of the electrodes according to the present embodiment.

As shown in FIG. 9, scan pulses 110*a*, 10*b*, 110*c* and 110*d* are applied in order to scan electrodes Xn−2 to Xn+1, respectively.

Also, at the same time that scan pulse 110*c* is applied, data pulse 130 is applied to data electrode Zm corresponding to the on-cell.

In the off-cells, on the other hand, at the same time that the scan pulse is applied, auxiliary pulse 150 is applied to data electrodes Zm−1, Zm and Zm+1 corresponding to off-cells positioned in a vicinity of the on-cell. However, auxiliary pulse 150 is not applied to data electrodes corresponding to off-cells that are not in a vicinity of the on-cell (i.e. although not depicted in FIG. 9, these are all other data electrodes apart from Zm−1, Zm and Zm+1).

Thus, even when application of the auxiliary pulse is restricted to those off-cells positioned in a vicinity of the on-cell as described above, generation of a write discharge in the on-cell is aided by the priming particles that are generated by at least one of a write discharge and an auxiliary discharge generated in cells in a vicinity of the on-cell prior to the on-cell being written. Consequently, the capacity to achieve a high quality of image display without the occurrence of defective writing is the same as in embodiment 1-1 above.

On the other hand, because an auxiliary discharge is not generated in off-cells that are not in a vicinity of on-cells due to the auxiliary pulse not being applied in these cells according to the present embodiment, the effect on contrast of the slight luminescence following the auxiliary discharge can be restricted to those cells in a vicinity of the on-cells.

Furthermore, in comparison with embodiment 1-1 in which the auxiliary discharge is generated in all of the cells, the number of cells in which the auxiliary discharge is generated is reduced in the present embodiment, and thus reductions in power consumption can also be realized.

Consideration will now be given to the method of distinguishing between "off-cells positioned in a vicinity of the on-cell" and "off-cells not positioned in a vicinity of the on-cell".

With respect to the generation of priming particles that will assist the write discharge in the on-cell (i.e. the cell at an intersection of electrodes Xn and Zm) when the on-cell is written, the most important cell is the adjacent cell to which the scan pulse is applied immediately before the on-cell (i.e. the cell at an intersection of electrodes Xn−1 and Zm).

Thus, reference herein to "off-cells positioned in a vicinity of the on-cell" may be understood as indicating at least an off-cell positioned adjacent to and directly above an on-cell in the sequence of cells.

To give a specific example, if only the off-cell positioned adjacent to and directly above the on-cell is designated as the "off-cells positioned in a vicinity of the on-cell", then all other off-cells may be understood as being the "off-cells not positioned in a vicinity of the on-cell". Alternatively, if, as shown in the example in FIG. 8, the off-cells positioned around the on-cell are designated as the "off-cells positioned in a vicinity of the on-cell", then all other off-cells may be understood as being the "off-cells not positioned in a vicinity of the on-cell".

A circuit for realizing the above drive method may be provided as follows.

Data pulse generation circuit 80 as shown in FIG. 6 is structured such that line memory 81 stores, in addition to a scan line to which the scan pulse is currently being applied, subfield information relating to a number of scan lines adjacent to the aforementioned scan line.

Furthermore, a judging unit is provided in data pulse generation circuit 80 for referring to line memory 81 in order to judge for each cell corresponding to the scan line currently being written, whether the cell is in a vicinity of an on-cell.

When the corresponding data stored in line memory 81 shows "on", switcher 84 corresponding to each data electrode 21 drives data pulse generator 82 and a data pulse is applied to the data electrodes. On the other hand, when the corresponding data stored in line memory 81 shows "off", switcher 84 firstly refers to the judgment conducted by the judging unit. If judged that the "cell is in a vicinity of the on-cell", the switcher operates to drive data pulse generator 82 to apply an auxiliary pulse to the data electrodes, and if judged that the "cell is not in a vicinity of the on-cell", the auxiliary pulse is not applied.

Embodiment 2-1

A structure of the PDP display device according to the present embodiment is the same as that shown in FIG. 1 relating to embodiment 1-1.

Figure 10A:
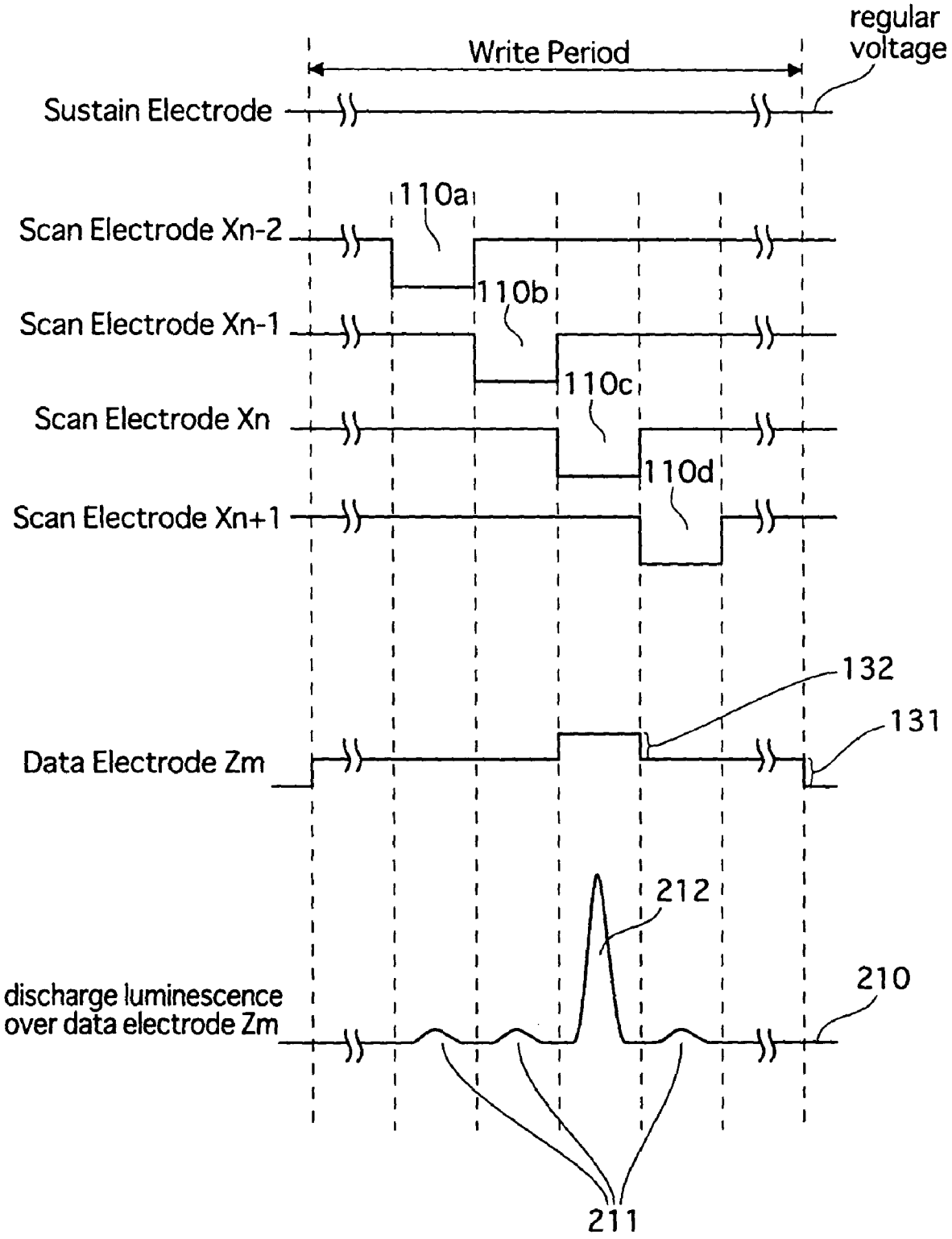
FIGS. 10A~10B show drive waveforms of a PDP according to an embodiment 2-1.

FIG. 10A shows drive waveforms applied to the electrodes in PDP 1 according to the present embodiment.

As shown in FIG. 10A, a data base pulse 131 is applied collectively to all of the data electrodes in the write period according to the present embodiment.

Also, scan pulse 110*a*, 110*b*, 110*c* and 110*d* are sequentially applied to scan electrodes Xn−2 to Xn+1, respectively, although when scan pulse 110*c* is applied to scan electrode Xn, a data pulse 132 is applied over data base pulse 131 to data electrode Zm corresponding to the on-cell.

Here, a voltage of the sustain electrodes is maintained at an even rate for the duration of the write period.

Figure 10B:
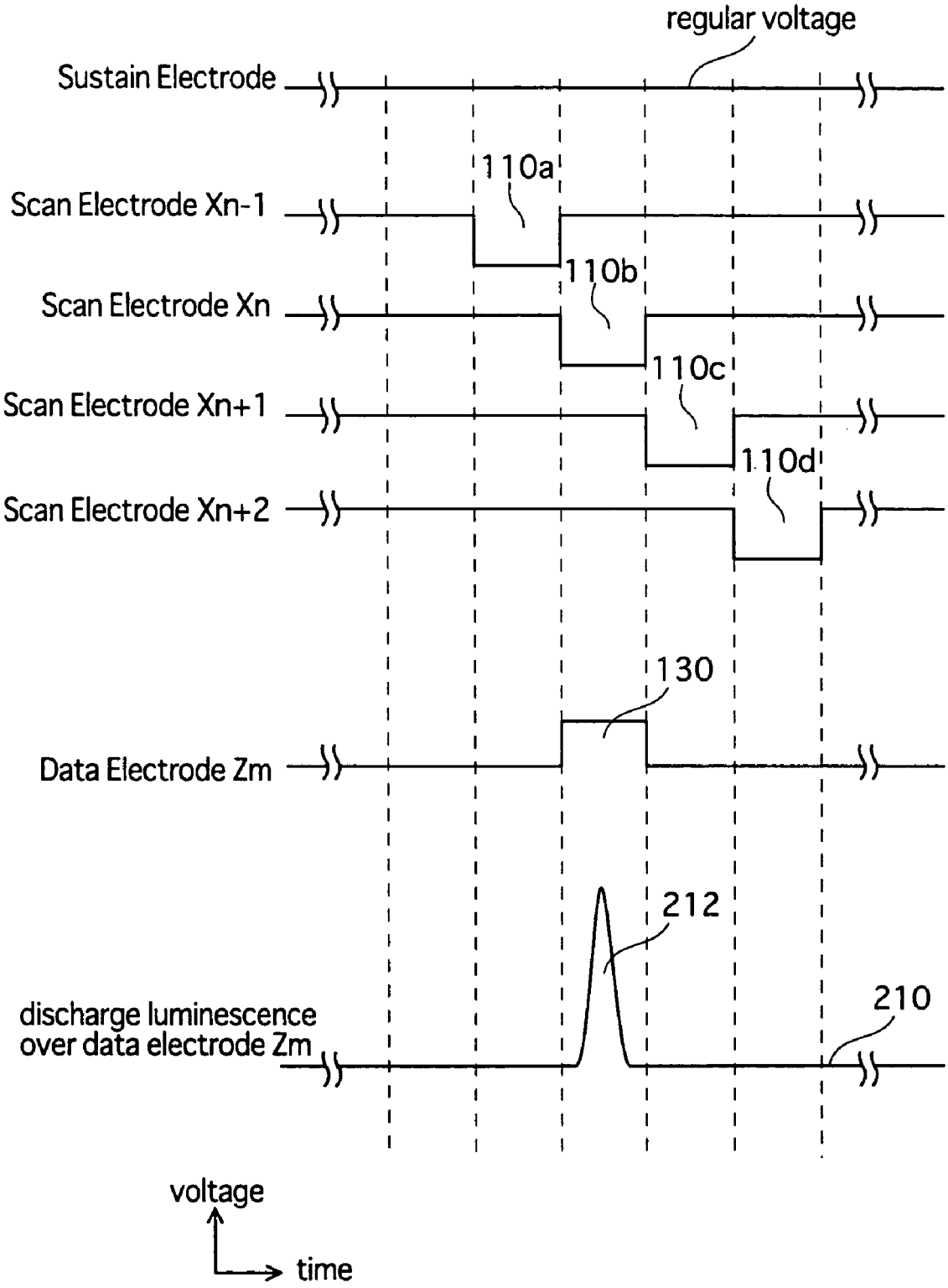

FIG. 10B shows a comparative example of the drive waveforms. Here, only data pulse 130 is applied to the data electrodes in the write period (i.e. data base pulse 131 is not applied).

Figure 11:
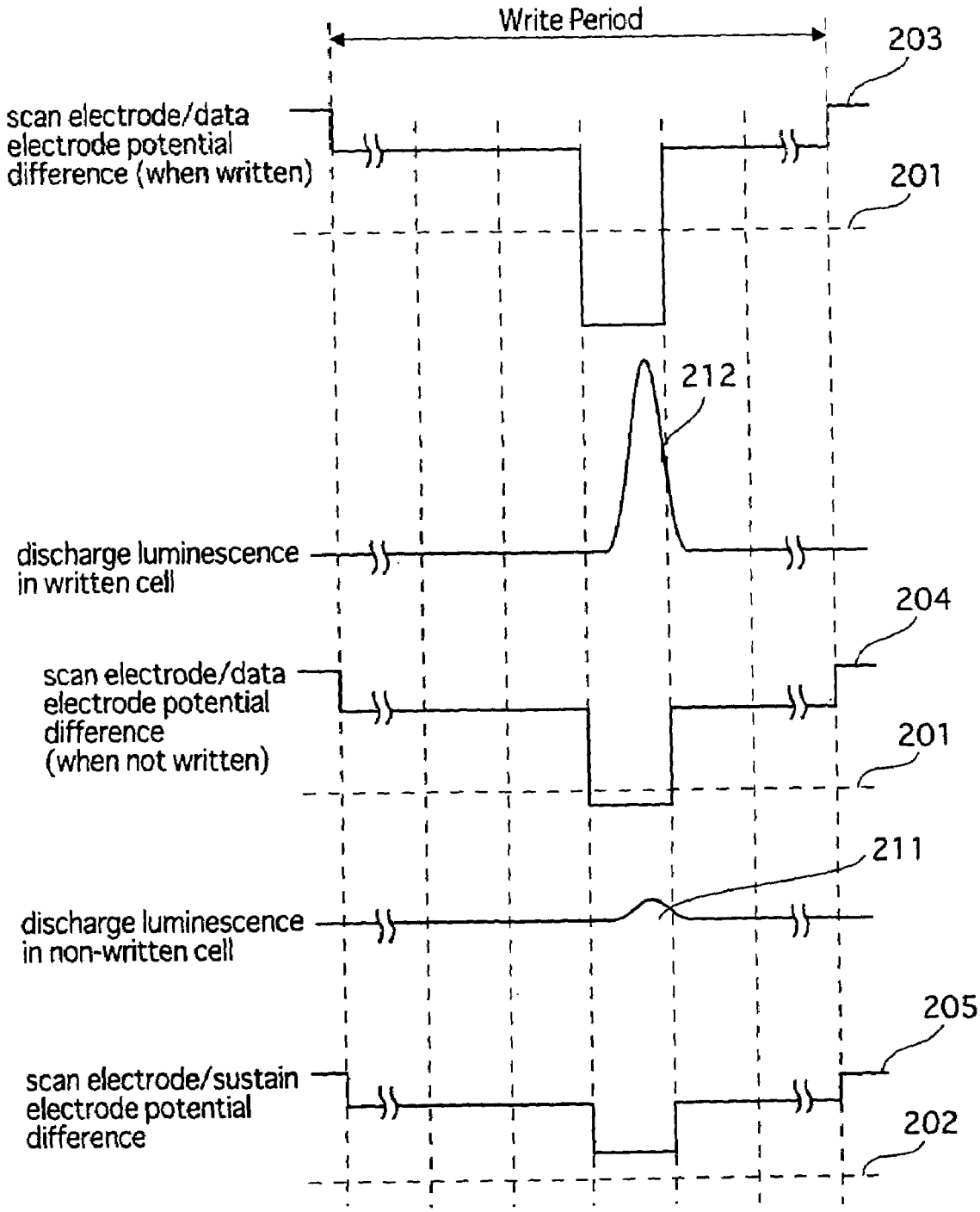
FIG. 11 shows a relationship of potential differences generated between electrodes in a write period according to a drive method of embodiment 2-1.

FIG. 11 shows the relationship of potential differences generated between the electrodes in the write period according to a drive method of present embodiment.

The setting of an amplitude of data base pulse 131 and a data pulse 132 will now be described with reference to FIG. 11.

An amplitude occurring when data pulse 132 is applied over data base pulse 131 (i.e. the combined amplitude of pulses 131 and 132) is set such that (i) a potential difference 203 between a scan electrode to which scan pulse 110 is being applied and a data electrode to which both data base pulse 131 and data pulse 132 are being applied is high enough to generate a write discharge (i.e. much higher than a discharge sparking voltage 201 between the scan electrode and the data electrode), and (ii) a potential difference 204 between a scan electrode to which scan pulse 110 is being applied and a data electrode to which only data base pulse 131 is being applied is only slightly above discharge sparking voltage 201 between the scan electrode and data electrode (i.e. lower than a voltage required to generate a write discharge).

A potential difference 205 between the scan electrodes and sustain electrodes is set so as not to exceed a discharge sparking voltage 202 between the scan electrodes and sustain electrodes.

By conducting the setting as described above, the voltage applied to the data electrodes is, as shown in FIG. 10A, higher than in the comparative example in FIG. 10B. This allows the following effects to be achieved in the write period.

Since a data pulse is applied in the on-cell corresponding to the scan electrode to which the scan pulse is currently being applied, potential difference 203 between the scan electrode and data electrode greatly exceeds discharge sparking voltage 201 between the scan and data electrodes, and a write discharge is generated as a result. A write sustain discharge is then induced by the write discharge and generated, and writing is thus conducted.

On the other hand, although only the scan pulse is applied in off-cells of the cells corresponding to the scan electrode to which the scan pulse is currently being applied (i.e. the data pulse is not applied), potential difference 203 between the scan electrode and data electrode slightly exceeds discharge sparking voltage 201 between the scan and data electrodes, and an auxiliary discharge is generated as a result. Since this auxiliary discharge is weaker than the write discharge, writing does not occur, and a write sustain discharge is not induced.

Priming particles, generated by either the auxiliary discharge or the write discharge occurring in cells corresponding to the scan electrode to which the scan pulse is currently being applied, also flow into cells corresponding to the scan electrode to which the scan pulse will next be applied (i.e. cells adjacent to and sequentially below the cells corresponding to the scan electrode to which the scan pulse is currently being applied), and thus the space within these cells becomes conducive to the generation of a discharge.

Consequently, a write discharge can be generated in the on-cells only a short period after application of the scan pulse and data pulse to these cells has been commenced. Thus the occurrence of defective writing can be suppressed, even when the scan and data pulses are set to have short pulse widths (i.e. approx. 1.0 μsec). That is, a high quality of image display can be achieved while at the same time shortening the length of the write period.

To achieve a circuit structure for applying data pulse 132 over data base pulse 131, data pulse generation circuit 80 shown in FIG. 1 may include, in addition to a data pulse generator, a data base pulse generator for generating a data base pulse, and the data pulse and data base pulse may both be applied to the data electrodes. By applying the data pulse over the data base pulse as described above, it becomes comparatively easy to apply a high voltage to the data electrodes.

Consideration will now be given to the magnitude of the auxiliary discharge.

Whenever a scan pulse is applied to a scan electrode, luminescence results from the write discharge or auxiliary discharge that is generated. A graph 210 in FIG. 10A shows the luminescence intensity when a photodiode, for example, is used to measure, through an oscilloscope, the luminescence of the discharge generated by data electrode Zm, while moving the oscilloscope down the scan electrodes sequentially.

Graph 210 shows slight luminescence peaks 211 resulting from the auxiliary discharges generated in the off-cells, and a comparatively large luminescence peak 212 resulting from the write discharge and write sustain discharge generated in the on-cell. Here, luminescence peaks 211 and 212 are marked in FIG. 11 using the same numbering.

Although the size of luminescence peaks 211 and 212 changes with variations in the waveforms, the luminescence level ratio of peaks 211 to peak 212 is preferably set equal to or greater than 1/100 given that the sufficient generation of priming particles is effective in suppressing the occurrence of defective writing. On the other hand, if this ratio is to large, misaddressing and reductions in contrast can occur, and thus the ratio is preferably maintained at no greater than 1/10.

Here, in a graph 210 in FIG. 10B, which shows the luminescence intensity in the comparative example, the existence of luminescence peak 212 resulting from the write discharge and write sustain discharge generated in the on-cell can be observed, although because auxiliary discharges were not generated in the off-cells, no luminescence peaks 211 can be observed.

Embodiment 2-2

A structure of the PDP display device according to the present embodiment is the same as that shown in FIG. 1 relating to embodiment 1-1.

Figure 12:
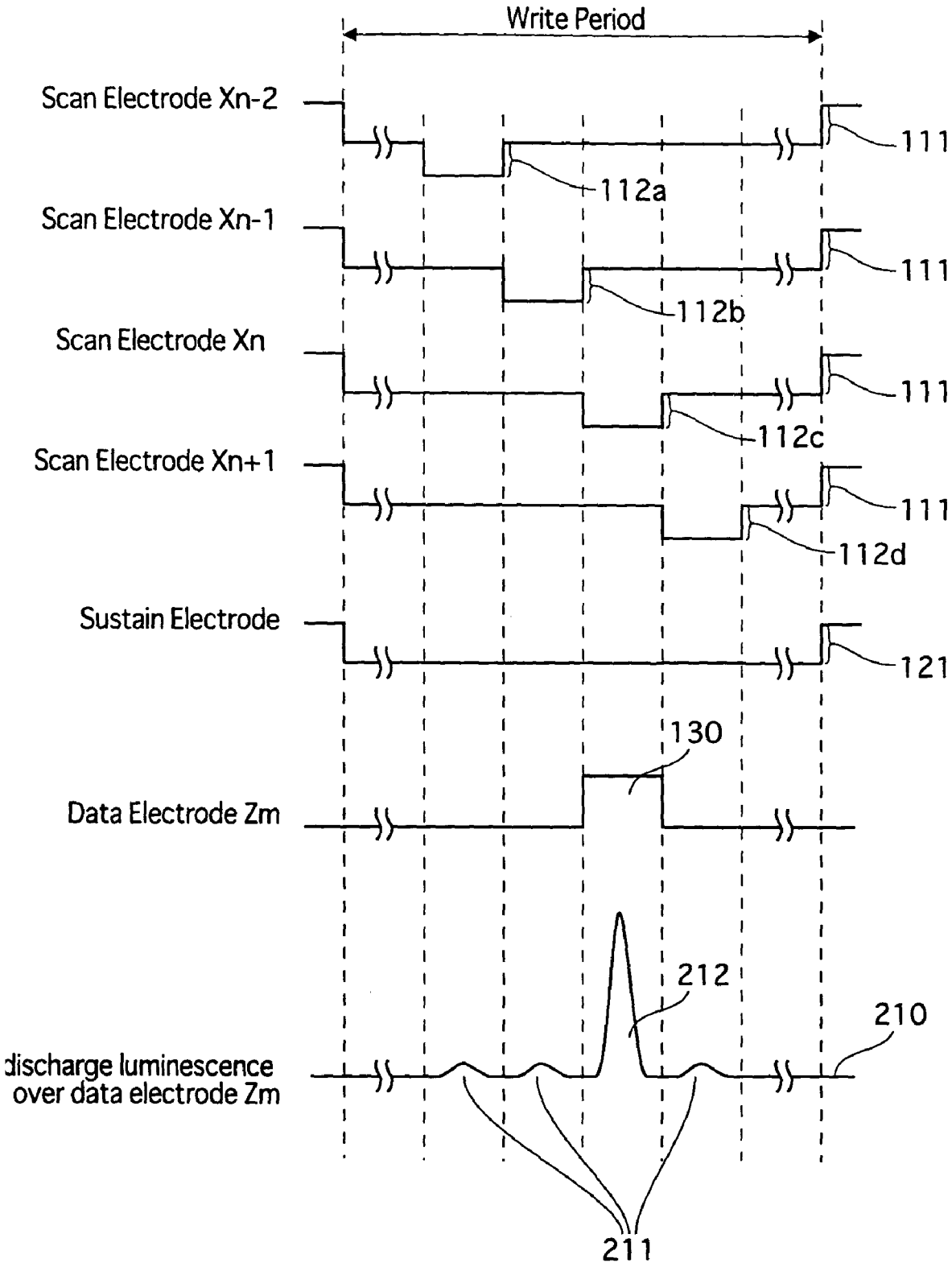
FIG. 12 shows drive waveforms of a PDP according to an embodiment 2-2.

FIG. 12 shows drive waveforms applied to the electrodes in PDP 1 according to the present embodiment.

According to the present embodiment, as shown in FIG. 12, a scan base pulse 111 is applied continuously to all of scan electrodes 11 in the write period, and scan pulses 122*a* to 122*d* are applied sequentially to scan electrodes Xn−2, Xn−1, Xn and Xn+1 over scan base pulse 111.

Here, when scan pulse 112*c* is applied to scan electrode Xn, data pulse 130 is applied at the same time to data electrode Zm corresponding to the on-cell.

Furthermore, a sustain base pulse 121 having the same polarity as scan base pulse 111 is applied continuously to sustain electrodes 12 for the duration of the write period.

In the drive method of the present embodiment, the relationship of potential differences occurring between the various electrodes in the write period is the same as that shown in FIG. 11.

In other words, an amplitude occurring when scan pulse 112 is applied over scan base pulse 111 is set such that (i) potential difference 203 between a scan electrode to which both scan base pulse 111 and scan pulse 112 are being applied and a data electrode to which data base pulse 130 is being applied is high enough to generate a write discharge, and (ii) potential difference 204 between a scan electrode to which both scan base pulse 111 and scan pulse 112 are being applied and a data electrode to which data pulse 130 is not being applied is only slightly above the discharge sparking voltage between the scan electrode and data electrode (i.e. lower than the voltage required to generate a write discharge).

Furthermore, an amplitude of sustain base pulse 121 is set such that a potential difference between the sustain electrodes to which sustain base pulse 121 is being applied is lower than the discharge sparking voltage between scan electrodes 11 and sustain electrodes 12.

By conducting the setting as described above, the absolute value of the voltage applied to the scan electrodes is, as shown in FIG. 12, higher than of the comparative example shown in FIG. 10B. This allows for the same effects as in embodiment 2-1 to be achieved in the write period.

In other words, since a data pulse is applied in the on-cell corresponding to the scan electrode to which the scan pulse 112 is currently being applied, the potential difference between the scan electrode and data electrode greatly exceeds the discharge sparking voltage between the scan and sustain electrodes, and a write discharge is generated as a result. A write sustain discharge is then induced by the write discharge and generated, and writing is thus conducted.

On the other hand, although only the scan pulse is applied in the off-cells (i.e. the data pulse is not applied), the potential difference between the scan electrode and data electrode slightly exceeds the discharge sparking voltage between the scan and sustain electrodes, and thus an auxiliary discharge is generated. This auxiliary discharge is not sufficient to induce a write sustain discharge.

Priming particles generated by either the auxiliary discharge or the write discharge occurring in cells corresponding to the scan electrode to which the scan pulse is currently being applied also flow into cells corresponding to the scan electrode to which the scan pulse will next be applied, and as a result the space within these cells becomes conducive to the generation of a discharge. Thus, the occurrence of defective writing can be suppressed, even when the scan and data pulses are set to have short pulse widths (i.e. approx. 1.0 μsec).

In order to apply scan pulse 112 over scan base pulse 111 as described above, a scan base pulse generator may be provided in initialization/sustain pulse generation circuit 60 (see FIG. 1) for applying scan base pulse 111, and circuit 60 may be structured so as to apply scan pulse 112 over scan base pulse 111. Furthermore, in order to apply sustain base pulse 121 to the sustain electrodes, a sustain base pulse generator may be included in sustain/erase pulse generation circuit 70.

Also, by applying the scan pulse over the scan base pulse as described above, it becomes comparatively easy to apply a high voltage to the scan electrodes.

In the present embodiment, as with embodiment 2-1, a graph 210 in FIG. 12 shows slight luminescence peaks 211 resulting from the auxiliary discharges generated in the off-cells, and a comparatively large luminescence peak 212 resulting from the write discharge and write sustain discharge generated in the on-cell. Here again, the luminescence level ratio of peaks 211 to peak 212 is preferably set in a range of 1/100 to 1/10 inclusive.

Embodiment 2-3

A structure of the PDP display device according to the present embodiment is the same as that shown in FIG. 1 relating to embodiment 1-1.

Figure 13:
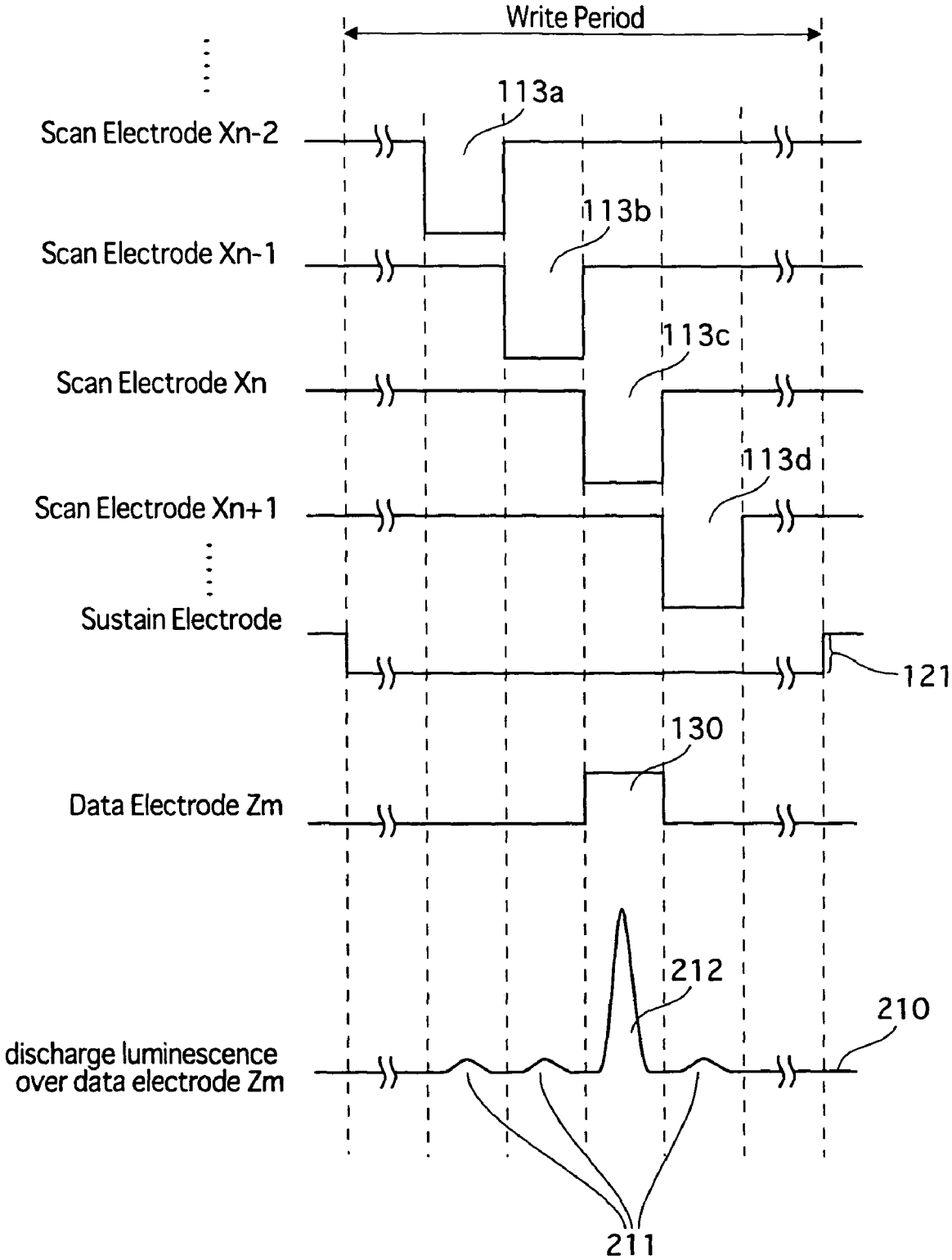
FIG. 13 shows drive waveforms of a PDP according to an embodiment 2-3.

FIG. 13 shows drive waveforms applied to the electrodes in PDP 1 according to the present embodiment.

A drive method in the present embodiment is basically the same as a conventional drive method, and as shown in FIG. 13, scan pulses 113*a* to 113*d* are applied sequentially to the scan electrodes, although when scan pulse 113*c* is applied to scan electrode Xn, data pulse 130 is applied at the same time to data electrode Zm corresponding to the on-cell.

Furthermore, sustain base pulse 121 having the same polarity as scan base pulse 111 is applied to sustain electrodes 12 for the duration of the write period.

In the present embodiment, the amplitude of scan pulses 113*a* to 113*d* is, as described below, set considerably higher than that of the scan pulses in the comparative example given in FIG. 10B.

The amplitude of scan pulses 113 is set such that the potential difference between a scan electrode to which scan pulse 113 is being applied and a data electrode to which the data pulse is not being applied is higher than the discharge sparking voltage between the scan and data electrodes, and yet lower than the voltage required to generate a write sustain discharge.

The amplitude of data pulse 130 is set such that the potential difference between a scan electrode to which scan pulse 113 is being applied and a data electrode to which the data pulse is being applied allows for a write sustain discharge to be generated.

Furthermore, the amplitude of sustain base pulse 121 is set such that the potential difference between a scan electrode to which scan pulse 113 is being applied and a sustain data electrode to which the sustain base pulse is being applied is lower than the discharge sparking voltage between the scan and sustain electrodes.

By conducting the setting as described above, the relationship of potential differences occurring between the various electrodes in the write period is the same as that shown in FIG. 11.

In other words, since a data pulse is applied in the on-cell corresponding to the scan electrode to which the scan pulse 113 is currently being applied, the potential difference between the scan electrode and data electrode greatly exceeds the discharge sparking voltage between the scan and sustain electrodes, resulting in the generation of a write discharge, which in turn induces a write sustain discharge to be generated to conduct the writing.

On the other hand, although only the scan pulse is applied in the off-cells (i.e. data pulse not applied), the potential difference between the scan electrode and data electrode slightly exceeds the discharge sparking voltage between the scan and data electrodes, and an auxiliary discharge is generated as a result. This auxiliary discharge is not sufficient to induce a write sustain discharge.

Because a write discharge is generated in the on-cell and an auxiliary discharge that is insufficient to conduct writing is generated in the off-cells, priming particles also flow into cells corresponding to the scan electrode to which the scan pulse will next be applied. Thus, the occurrence of defective writing can be suppressed, even when the scan and data pulses are set to have short pulse widths (i.e. approx. 1.0 μsec)

In the present embodiment, as with embodiment 2-1, a graph 210 in FIG. 13 shows slight luminescence peaks 211 resulting from the auxiliary discharges generated in the off-cells, and a comparatively large luminescence peak 212 resulting from the write discharge and write sustain discharge generated in the on-cell. Here again, the luminescence level ratio of peaks 211 to peak 212 is preferably set in a range of 1/100 to 1/10 inclusive.

Embodiment 3-1

Structure of the PDP Display Device

A structure of the PDP display device according to the present embodiment is substantially the same as that shown in FIG. 1 relating to embodiment 1-1.

Figure 14:
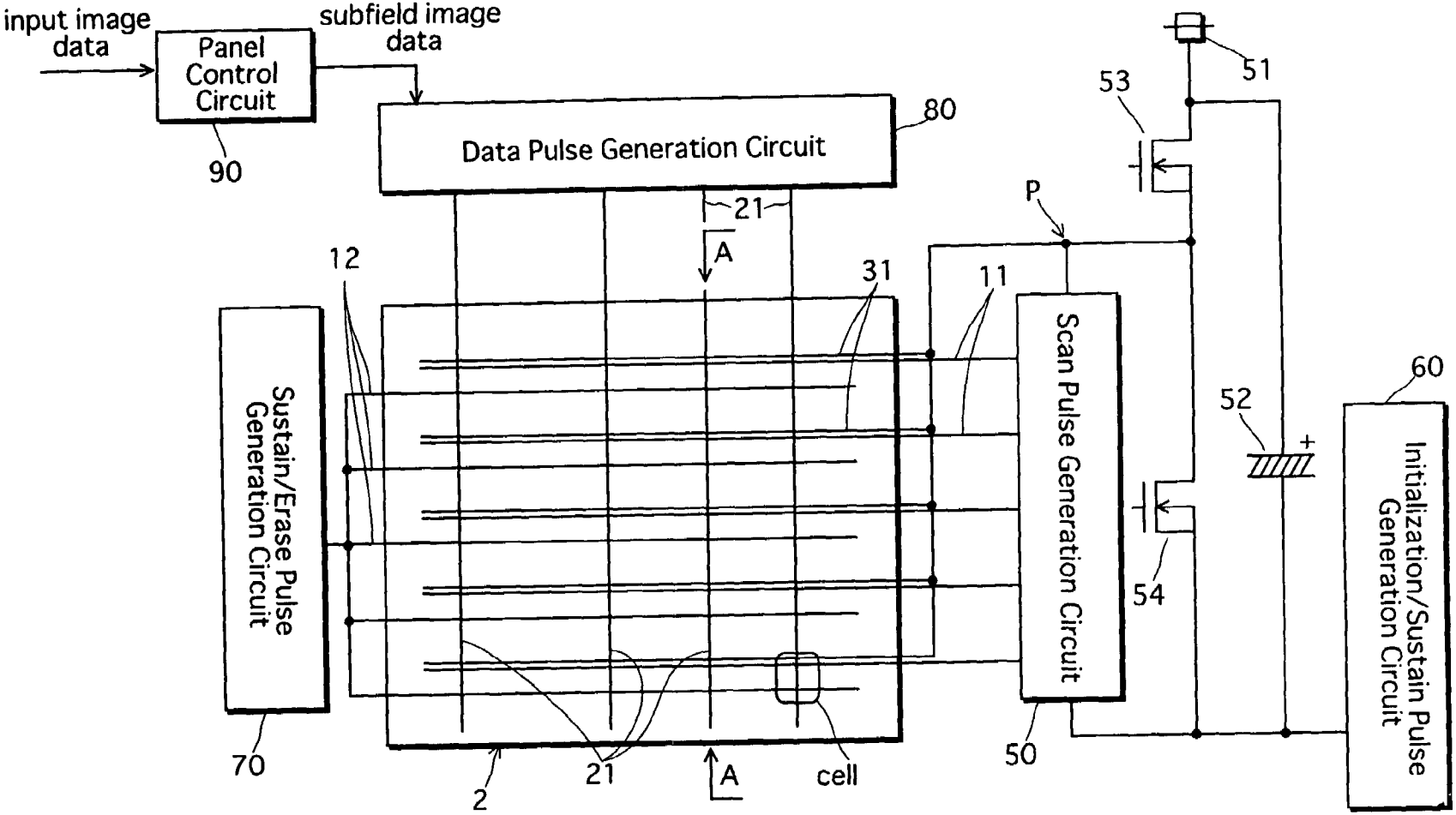
FIG. 14 shows a structure of a PDP display device according to an embodiment 3-1.

FIG. 14 shows the structure of a PDP display device according to the present embodiment.

Although the structure of a PDP 2 in the PDP display device is the substantially the same as that of PDP 1 shown in FIG. 1 relating to embodiment 1-1, auxiliary discharge electrodes 31 are provided so as to be adjacent to and parallel with scan electrodes 11.

Figure 15:
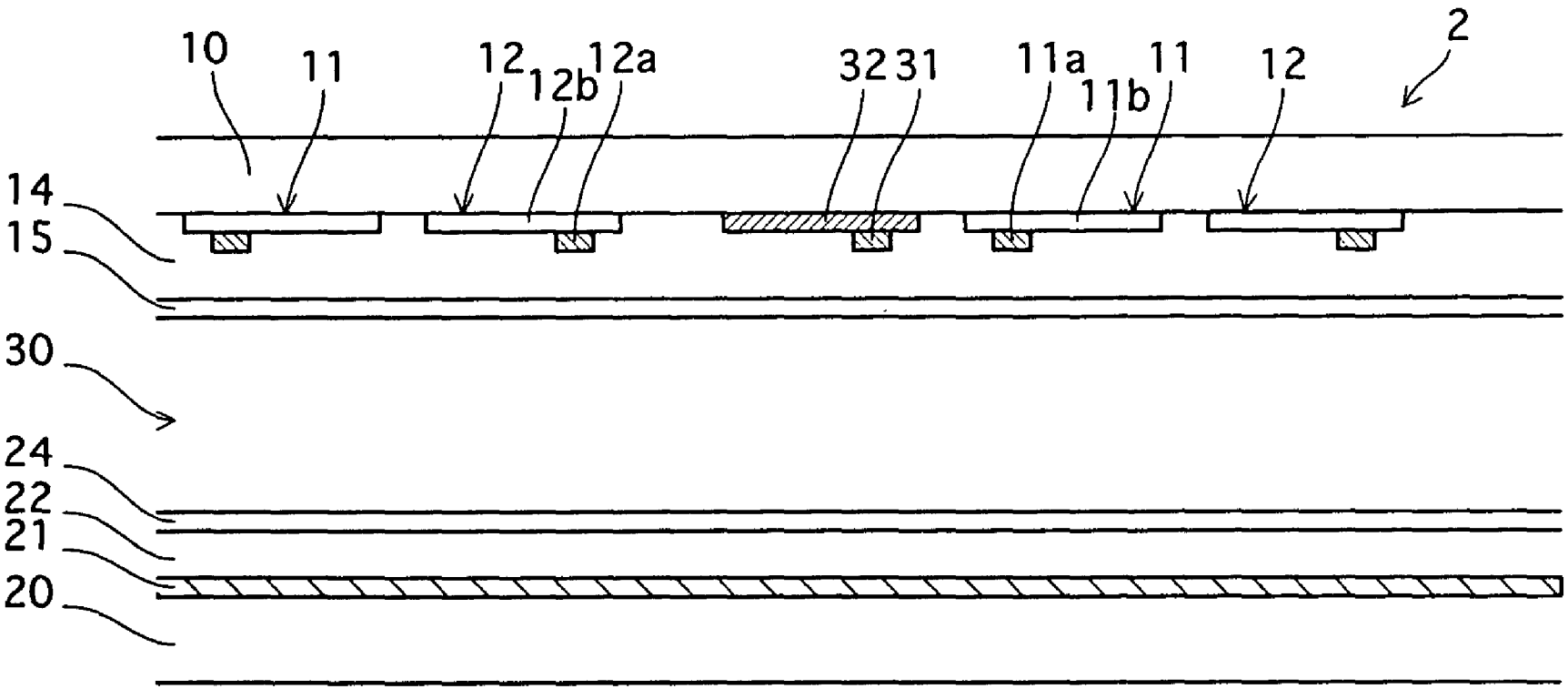
FIG. 15 is a structural cross-sectional diagram along an A~A axis of the PDP shown in FIG. 14.

FIG. 15 is a structural cross-sectional diagram along an A~A axis of PDP 2 as shown in FIG. 14.

In PDP 2, a front glass substrate 10 and back glass substrate are provided to face each other with a discharge space 30 existing therebetween.

On the facing surface of front glass substrate 10, scan electrodes 11, sustain electrodes 12 and auxiliary discharge electrodes 31 are arranged parallel to each other, and a dielectric layer 14 and a protective layer 15 are provided to cover to electrodes. Scan electrodes 11 are each formed from a transparent electrode layer 11*b*, and a bus electrode layer 11*a* that is layered over the transparent electrode layer. Sustain electrodes 12 are each formed from a transparent electrode layer 12*b*, and a bus electrode layer 12*a* that is layered over the transparent electrode layer. Auxiliary discharge electrodes 31 are each provided so as to be over a shading film 32 and adjacent to a bus electrode layer 11*a* of a scan electrode.

The gap between each auxiliary discharge electrode 31 and scan electrode 11 is narrower than the gap between each scan electrode and sustain electrode, and is set so as to allow an auxiliary discharge to be generated when a potential difference occurs that approximates the amplitude of the scan pulse (Vt−Vg).

On the other hand, on the facing surface of the back glass substrate, data electrodes 21 are arranged so as to extend orthogonally across scan electrodes 11, and a dielectric layer 23 and phosphor layers 24 are provided so as to cover data electrodes 21.

Drive Method and Drive Circuit

Figure 16:
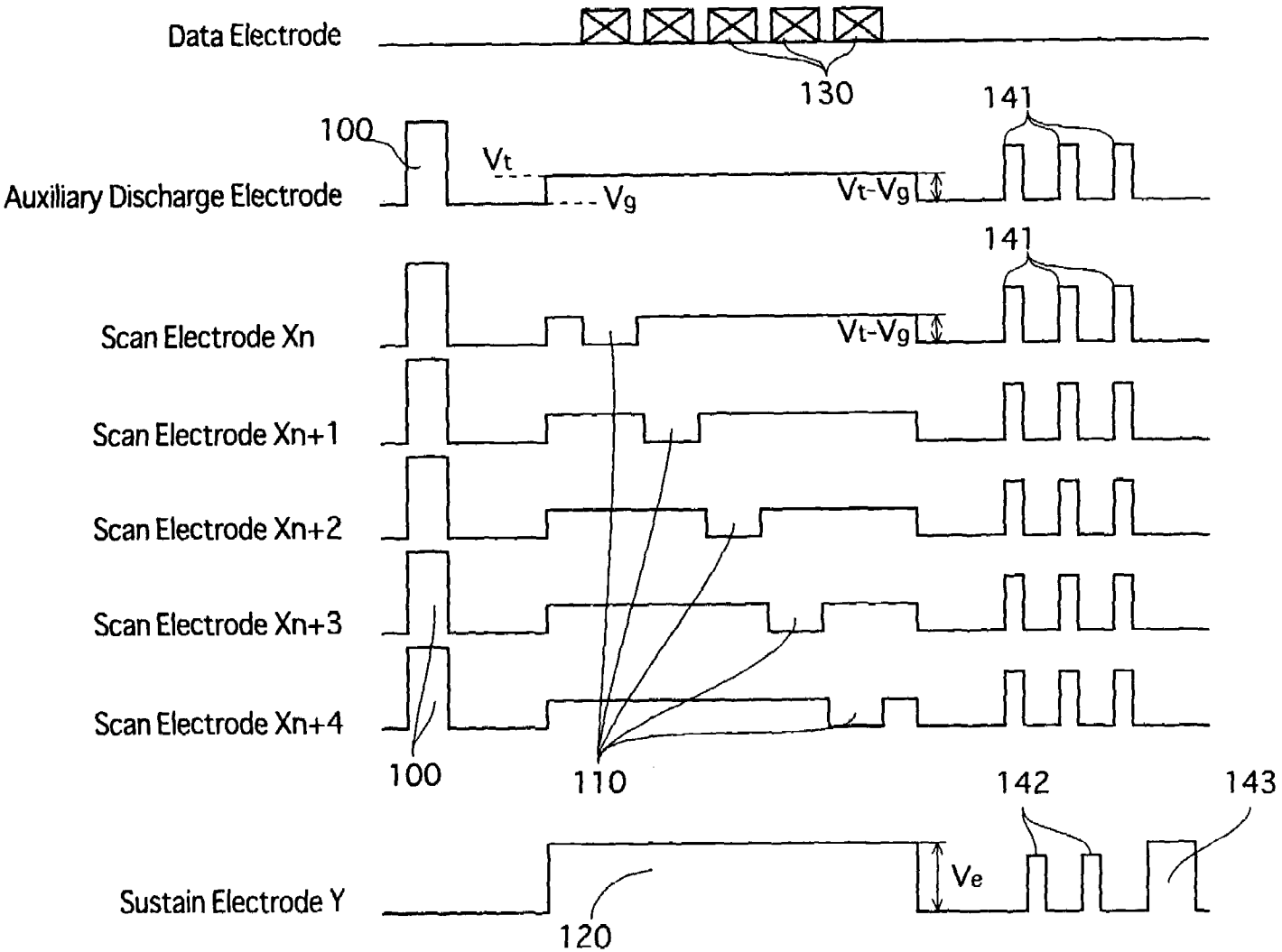
FIG. 16 shows drive waveforms of the PDP according to embodiment 3-1.

FIG. 16 shows drive waveforms applied to the electrodes in PDP 2.

The waveforms applied to scan electrodes 11, sustain electrodes 12 and data electrodes 21 are as described in embodiment 1-1, and the operation of the electrodes is the same as for the drive waveforms in a conventional three electrode AC-type surface discharge PDP.

As shown in FIG. 14, a drive circuit in the PDP display device of the present embodiment is the same as that shown in FIG. 1 relating to embodiment 1-1, and auxiliary discharge electrodes 31 are connected to the drive circuit at point P in FIG. 14.

As described in embodiment 1-1, in the drive circuit of the present embodiment, FET 53 is "on" and FET 54 is "off" in the write period, whereas in all other periods FET 53 is "off" and FET 54 is "on".

Consequently, an initialization pulse and a sustain pulse are applied to auxiliary discharge electrodes 31 from initialization/sustain pulse generation circuit 60 in the initialization period and sustain period, respectively, whereas in the write period a scan pulse is not applied to the auxiliary discharge electrodes.

In other words, except for the scan pulse not being applied in the write period, the waveforms applied to auxiliary discharge electrodes 31 are the same as the waveforms applied to scan electrodes 11, with both an initialization pulse 100 and a sustain pulse 141 being applied to scan electrodes 11 and auxiliary discharge electrodes 31.

The generation of discharges and the like within the panel during the write period will now be described with reference to FIGS. 17A to 17C.

As described in embodiment 1-1, the scan pulse has a negative polarity and an amplitude (Vt−Vg), and thus a potential difference (Vt−Vg) occurs between a scan electrode and an adjacent auxiliary discharge electrode when the scan pulse is applied to the scan electrode.

Figure 17A:
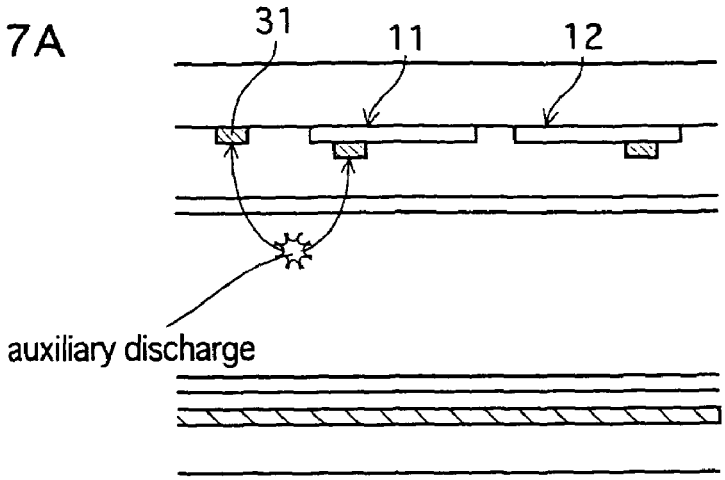
FIGS. 17A~17C show the generation of discharges and the like within a panel in the write period according to embodiment 3-1.
Figure 17B:
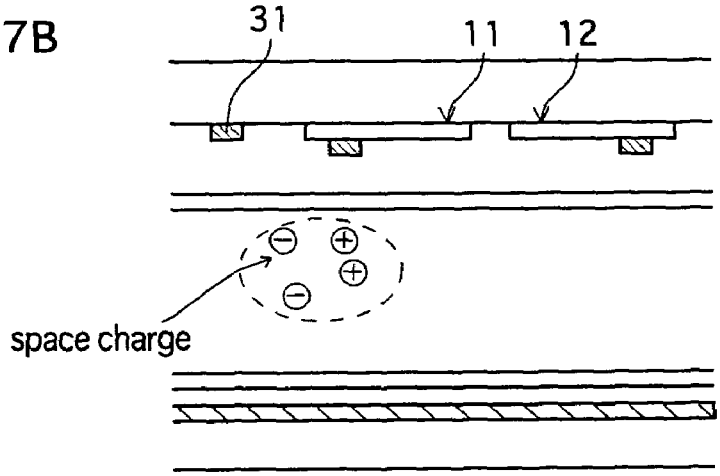
Figure 17C:
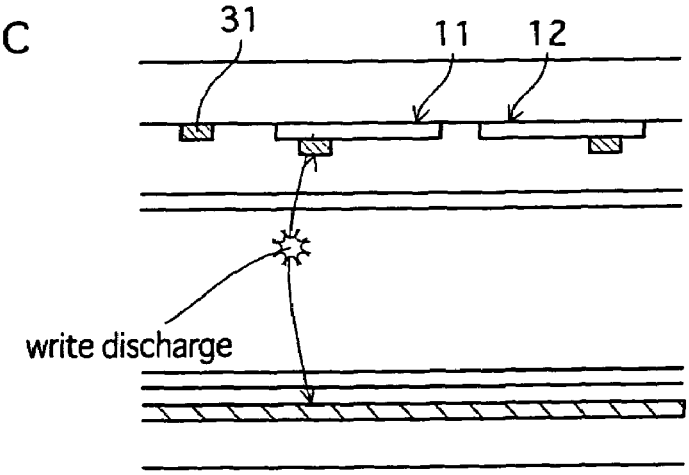

Consequently, as shown in FIG. 17A, an auxiliary discharge is generated between the scan electrode and the adjacent auxiliary discharge electrode, and as shown in FIG. 17B, space charge is generated in the discharge space of the cell in which the auxiliary discharge has occurred.

Here, the data pulse is applied to the data electrode corresponding to the on-cell at the same time that the scan pulse is applied to the scan electrode in the on-cell. Here, because of the large quantity of charged particles generated in the on-cell as a result of the auxiliary discharge described above, a write discharge is, as shown in FIG. 7C, effectively generated in the on-cell only a very short time after application of the scan and data pulses has been commenced.

On the other hand, only the scan pulse is applied in the off-cells, with the data pulse not being applied to data electrodes corresponding to the off-cells. Consequently, the potential difference between scan electrodes 11 and data electrodes 21 in the off-cells does not exceed the discharge sparking voltage between the scan and data electrodes, and thus a write discharge is not generated.

According to the drive method of the present embodiment, it is possible to generated a write discharge effectively, even when the scan pulse and data pulse are set to have a short pulse width (approx. i.e. 1.0 sec), and thus the occurrence of defective writing can be suppressed.

The gap between each auxiliary discharge electrode 31 and scan electrode 11 is preferably of a width that allows for a discharge to be generated when the potential difference between the auxiliary discharge electrode 31 and scan electrode 11 is equal to or greater than (Vt−Vg)/2. Here, the gap is preferably set in a range of 10 μm to 50 μm.

Generally, when a discharge is generated between electrodes that are positioned close together, deterioration of the film in a vicinity of the electrodes can occur as a result of ion sputtering. However, because only a small number of auxiliary discharges are generated in a single field (1/60 sec) according to the present embodiment, there is virtually no deterioration in the properties of protective layer 15 due to ion sputtering.

Furthermore, because a faint luminescence occurs as a result of the auxiliary discharge, and because the auxiliary discharge is conducted at least a few times during the display of black levels in a field, a reduction in contrast can easily occur as a result of the increased brightness of the black levels that generally occur when an auxiliary discharge is generated. However, because shading film 32 is formed beneath each auxiliary discharge electrode 31 according to the present embodiment, it is possible to suppress the reduction in contrast caused by luminescence from the auxiliary discharge.

Furthermore, because the same waveforms are applied to scan electrodes 11 and auxiliary discharge electrodes 31 in the initialization period and sustain period, initialization/sustain pulse generation circuit 60 can be used to apply these waveforms to both electrodes 11 and 31. Moreover, because auxiliary discharge electrodes 31 are maintained at a potential Vt during the write period, there is no particular need to provide an additional drive circuit, and thus the device can be provided at a relatively low cost.

Configurations within Electrode Extension Area

The configuration of electrodes within an electrode extension area at an edge of the panel will now be described with reference to FIGS. 18A and 18B.

Figure 18A:
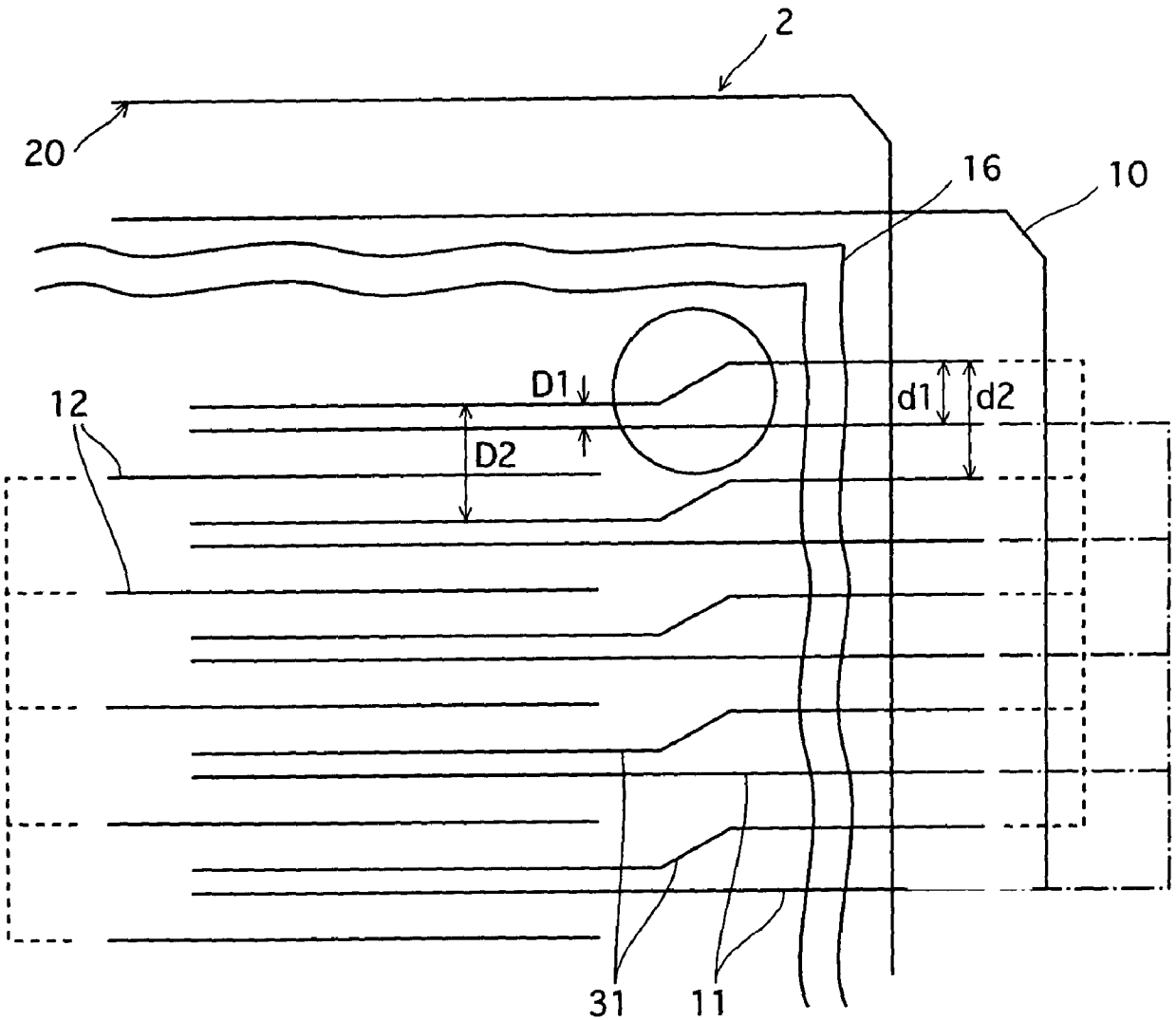
FIGS. 18A~18B show the configuration of electrodes in an electrode extension area according to embodiment 3-1.

FIG. 18A shows a section of PDP 2 that includes front glass substrate 10, back glass substrate 20, a sealing unit 16, scan electrodes 11, sustain electrodes 12 and auxiliary discharge electrodes 31.

In the present embodiment, as shown in FIG. 18A, a gap D1 between each auxiliary discharge electrode 31 and scan electrode 11 in a display area of the panel (i.e. the area within the boundary marked by sealing unit 16) is set narrowly so as to facilitate the auxiliary discharge. However, this gap widens in a section of the display area near sealing unit 16 (i.e. the circled section in FIG. 18A), and a gap d1 between the auxiliary discharge electrodes and scan electrodes in the electrode extension area (i.e. the area outside the boundary marked by sealing unit 16) is set to be wider than gap D1.

Gap d1 is wide enough to prevent a discharge from occurring, even when the potential difference between auxiliary discharge electrodes 31 and scan electrodes 11 approximates (Vt−Vg). Here, gap d1 is preferably set to be in a range of 50 μm to 300 μm.

Consequently, it is possible to realize a structure of the panel in which an auxiliary discharge is only generated within the display area, and not between adjacent electrodes in the electrode extension area.

Figure 18B:
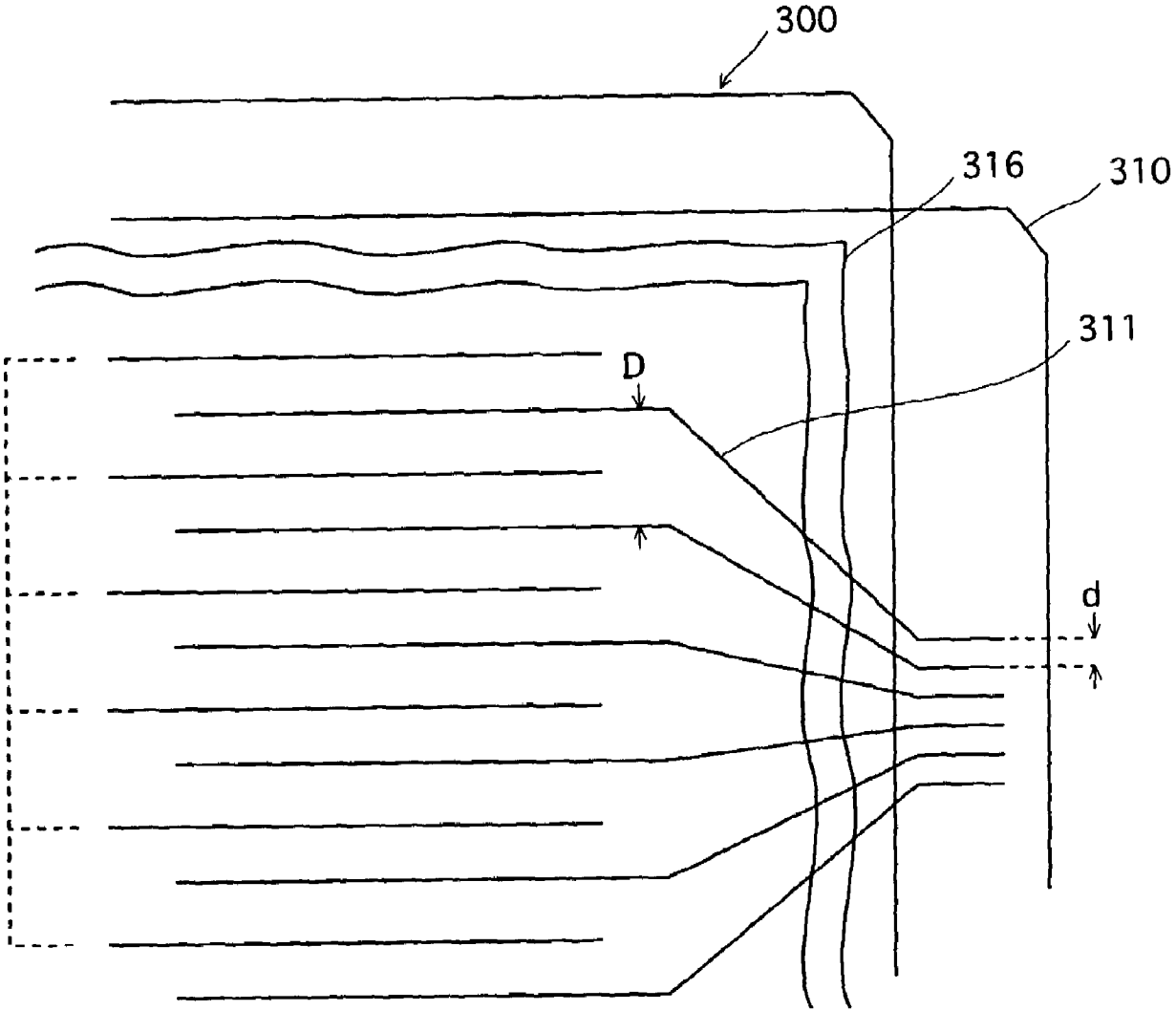

Furthermore, on a front glass substrate 310 of a conventional prior art PDP 300 as shown in FIG. 18B, a gap d between adjacent scan electrodes 311 outside of the area marked by a sealing unit 316 (i.e. within the electrode extension area) is made narrower than a gap D between adjacent scan electrodes 311 within an area marked by sealing unit 316. The advantage of this structure is that a width of the flexible printed circuitry (FPC) that contacts with the electrode extension area can also be set narrowly for connecting with an external circuit.

In contrast, according to the present embodiment as shown in FIG. 18A, a gap d2 between adjacent scan electrodes 11 in the electrode extension area is set to be equal to or greater than a gap D2 between adjacent scan electrodes 11 within the display area. This structure has the following advantages.

In PDP 2 of the present embodiment, the number of auxiliary discharge electrodes 31 formed on the front glass substrate 10 is equal to the number of scan electrodes 11, and as a result there are twice as many electrodes in the electrode extension area than is the case with a conventional PDP. Consequently, if the gap between scan electrodes 11 in the electrode extension area was set narrowly, the gap between adjacent electrodes in the electrode extension area would be considerably narrow, and thus a discharge could possibly be generated in the electrode extension area. However, by setting the gap between scan electrodes 11 in the electrode extension area to be equal to or greater than that in the display area, the possibility of a discharge generating in the electrode extension area can be suppressed.

Embodiment 3-2

Figure 19:
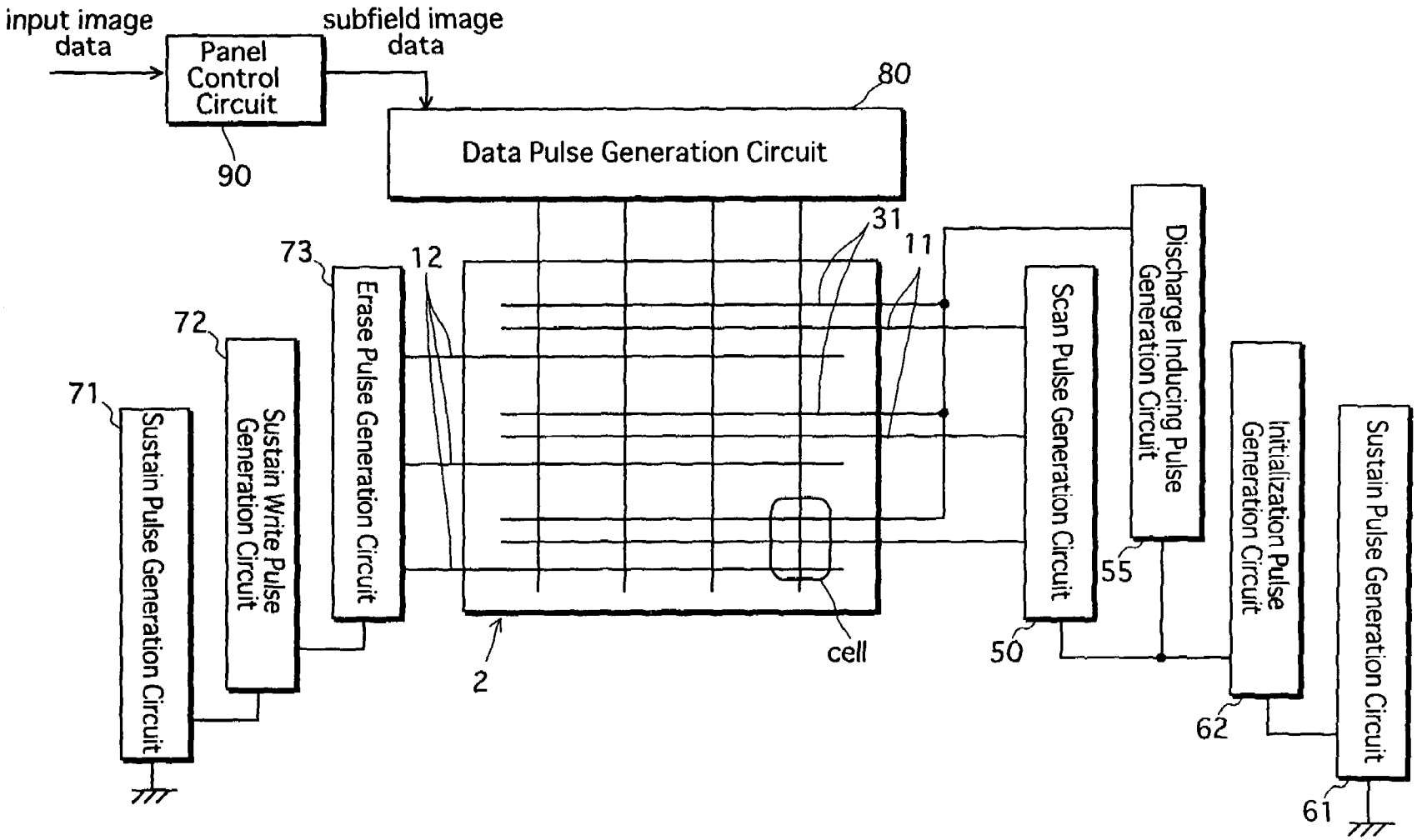
FIG. 19 shows a structure of a PDP display device according to an embodiment 3-2.

FIG. 19 shows a structure of a PDP display device according to the present embodiment.

The structure of a PDP 2 in the PDP display device is substantially the same as that shown in FIG. 14 relating to embodiment 3-1.

As drive circuits, the panel includes scan pulse generation circuit 50 for applying a scan pulse (i.e. a negative pulse of amplitude Vt referenced on a potential Vt), a sustain pulse generation circuit 61 for applying a sustain pulse 301, and an initialization pulse generation circuit 62 for applying an initialization pulse, and as a circuit for applying a pulse to auxiliary discharge electrodes 31, the panel includes a discharge inducing pulse generation circuit 55 for generating, in the write period, a discharge inducing pulse having a regular voltage Vp.

Initialization pulse generation circuit 62 operates using the output of sustain pulse generation circuit 61 as a provisional ground level, and scan pulse generation circuit 50 and discharge inducing pulse generation circuit 55 operate using the output of initialization pulse generation circuit 62 as a provisional ground level.

Furthermore, as circuits for applying pulses to sustain electrodes 12, the panel includes a sustain pulse generation circuit 71 for applying a sustain pulse, a sustain write pulse generation circuit 72 for applying a positive sustain write pulse 120 (amplitude Ve) to sustain electrodes 12, and an erase pulse generation circuit 73 for applying an erase pulse.

Here, sustain pulse generation circuit 61 and initialization pulse generation circuit 62 are structure so as to apply sustain and initialization pulses to auxiliary discharge electrodes 31 as well as scan electrodes 11. The use of circuits 61 and 62 to apply pulse to electrodes 11 and 31 allows costs relating to the circuitry of the panel to be reduced.

Sustain write pulse generation circuit 72 operates using the output of sustain pulse generation circuit 71 as a provisional ground level, and erase pulse generation circuit 73 operates using the output of sustain write pulse generation circuit 72 as a provisional ground level.

Here, the sustain write pulse is applied so as to generate a write sustain discharge between a scan electrode and a sustain electrode when a write discharge is generated, and thus allow for the accumulation of negative charge on the dielectric layer over the sustain electrode.

Furthermore, the panel includes a data pulse generation circuit 80 for applying a data pulse to data electrodes in accordance with the display data.

As with embodiment 1-1 above, these circuits are controlled by panel control circuit 90.

Figure 20:
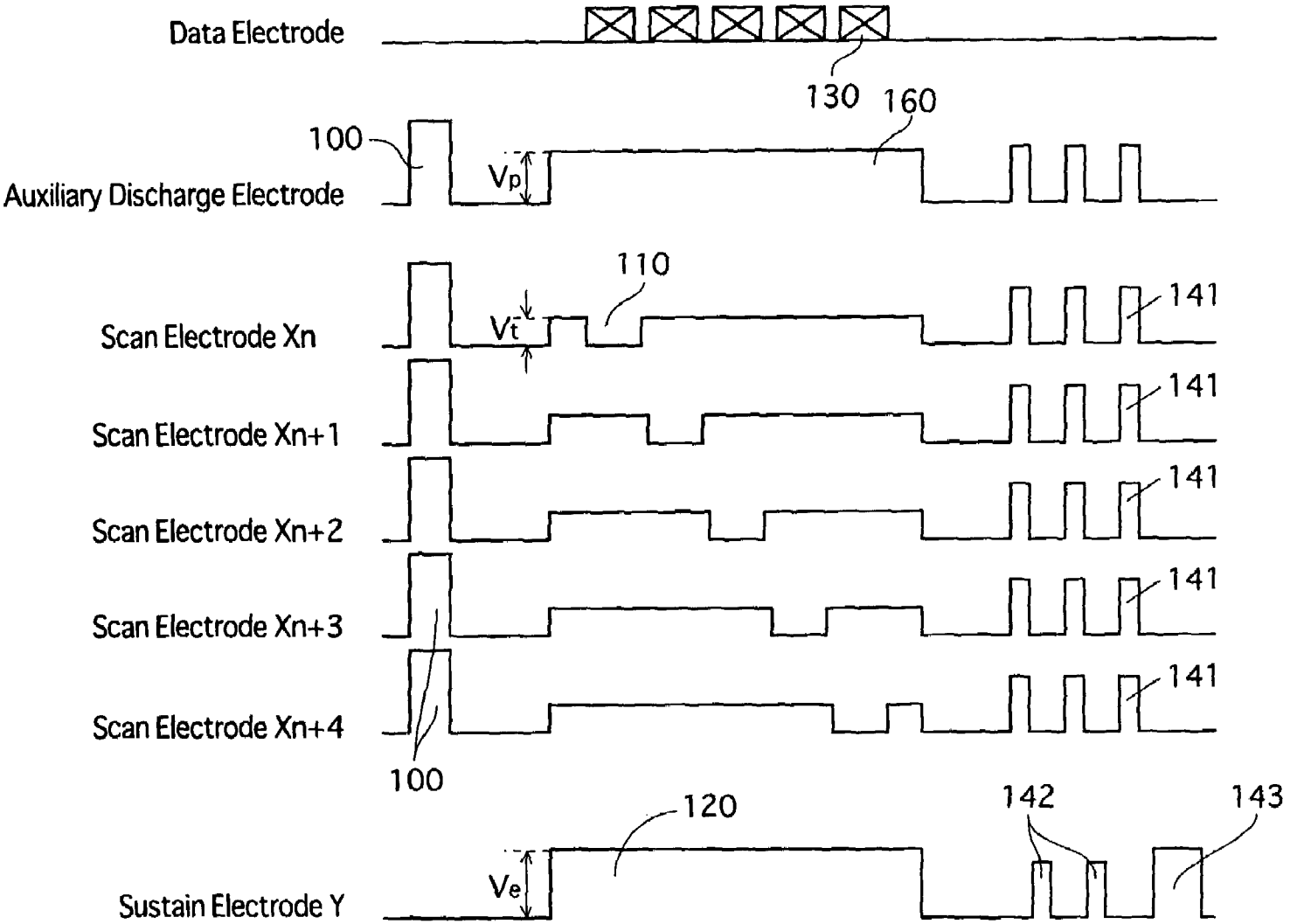
FIG. 20 shows drive waveforms of the PDP according to embodiment 3-2.

FIG. 20 shows drive waveforms applied to the electrodes in PDP 2 according to the present embodiment.

The drive waveforms according to the present embodiment are the same as those in FIG. 16 relating to embodiment 3-1, although in comparison to embodiment 3-1 in which a voltage Vt equal to a reference voltage level of scan electrodes 11 is applied to auxiliary discharge electrodes 31 in the write period, in the present embodiment a voltage Vp applied to auxiliary discharge electrodes 31 in the write period is determined by the wave height of a discharge inducing pulse 160 generated by discharge inducing pulse generation circuit 55.

Consequently, voltage Vp can be set freely by discharge inducing pulse generation circuit 55, and thus it is possible to set voltage Vp to a higher value than voltage Vt.

Here, the gap between scan electrodes 11 and auxiliary discharge electrodes 31 must be set so that a potential difference Vd2 (=Vp) between an auxiliary discharge electrode and a scan electrode to which the scan pulse is being applied is slightly greater than the discharge sparking voltage between the auxiliary discharge electrode and scan electrode. As such, being able to set voltage Vp to a high value allows a certain degree of freedom in the setting of the gap between the auxiliary discharge electrodes and scan electrodes.

In other words, the gap between scan electrodes 11 and auxiliary discharge electrodes 31 is set so that when the potential difference between a scan electrode and an auxiliary discharge electrode is (Vp−Vt), a discharge does not occur between the two electrodes, and when the potential difference between the scan electrode and auxiliary discharge electrode is Vd2 (=Vp), a discharge does occur between the two electrodes. Consequently, setting voltage Vp to higher values allows scan electrodes 11 and auxiliary discharge electrodes 31 to be set further apart.

The generation of discharges and the like in the panel during the write period when the waveforms shown in FIG. 20 are applied in PDP 2 is as described above in embodiment 3-1 with reference to FIG. 17. That is, an auxiliary discharge is generated between a scan electrode and auxiliary discharge electrode whenever a scan pulse is applied to the scan electrode. And as a result of the large quantity of charged particles generated by the auxiliary discharge, the time required for a write discharge to occur after the application of a data pulse has been commenced is extremely short, and the write discharge can be generated effectively.

Here, because auxiliary discharge electrodes 31 are provided closer to scan electrodes 11 than sustain electrodes 12, a discharge only occurs between auxiliary discharge electrodes 31 and scan electrodes 11, and not between auxiliary discharge electrodes 31 and sustain electrodes 12.

Furthermore, as shown in the example in FIG. 19, although auxiliary discharge electrodes 31 are shown in the example in FIG. 19 to be connected to each other so that the same waveforms can be applied to all of the auxiliary discharge electrodes, the same effects can be achieved by applying the same waveforms to each of the auxiliary discharge electrodes, even if the auxiliary discharge electrodes are not connected to each other.

Embodiment 3-3

A structure of the PDP according to the present embodiment is the same as PDP 2 shown in embodiment 3-2 above. The drive method is also the same as in embodiment 3-2, although in the sustain period according to the present embodiment, auxiliary discharge electrodes 31 may be set to a high impedance state as shown in FIG. 21 or maintained at a medium potential as shown in FIG. 22.

Figure 21:
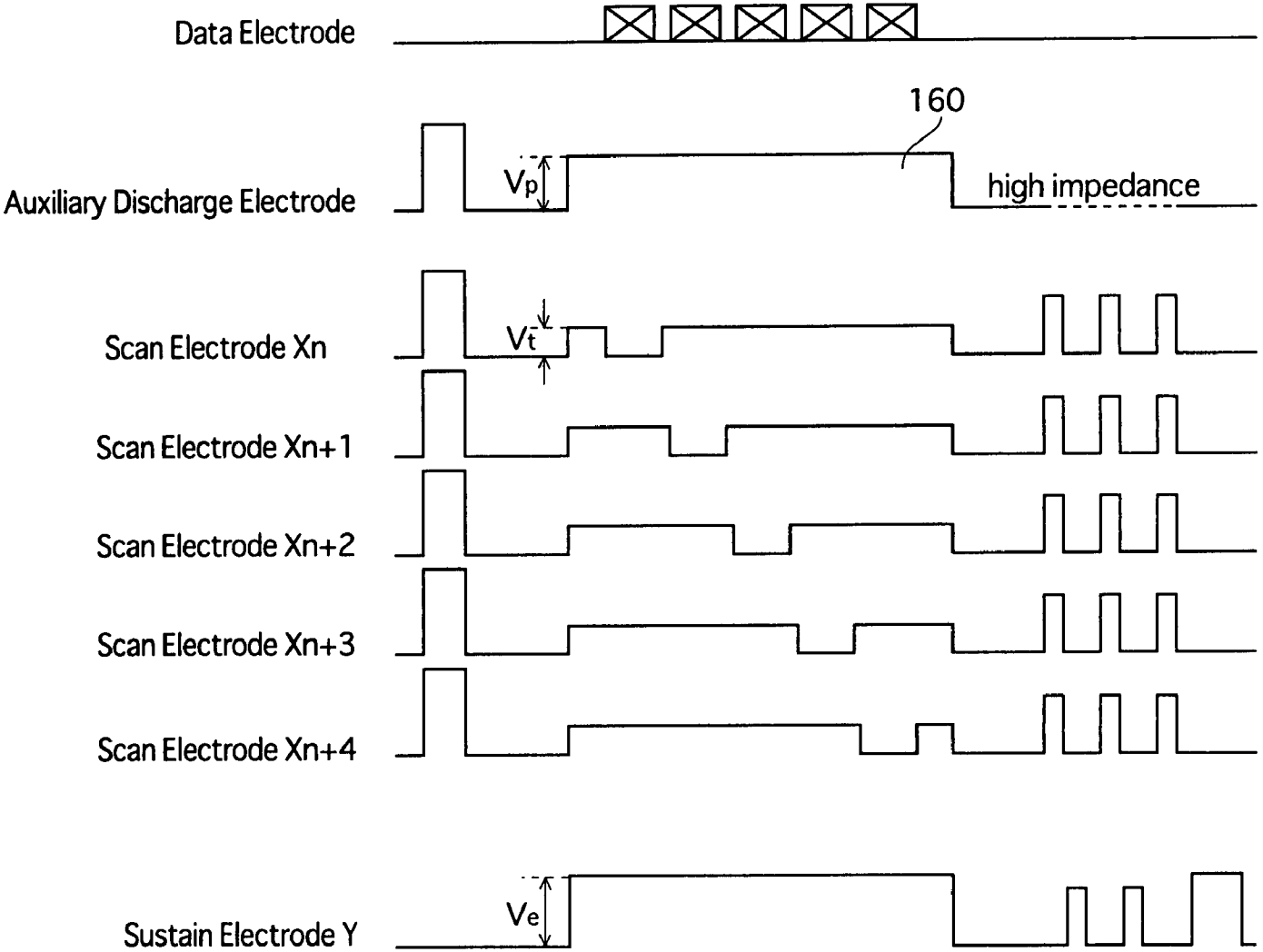
FIG. 21 shows drive waveforms of a PDP according to an embodiment 3-3.
Figure 22:
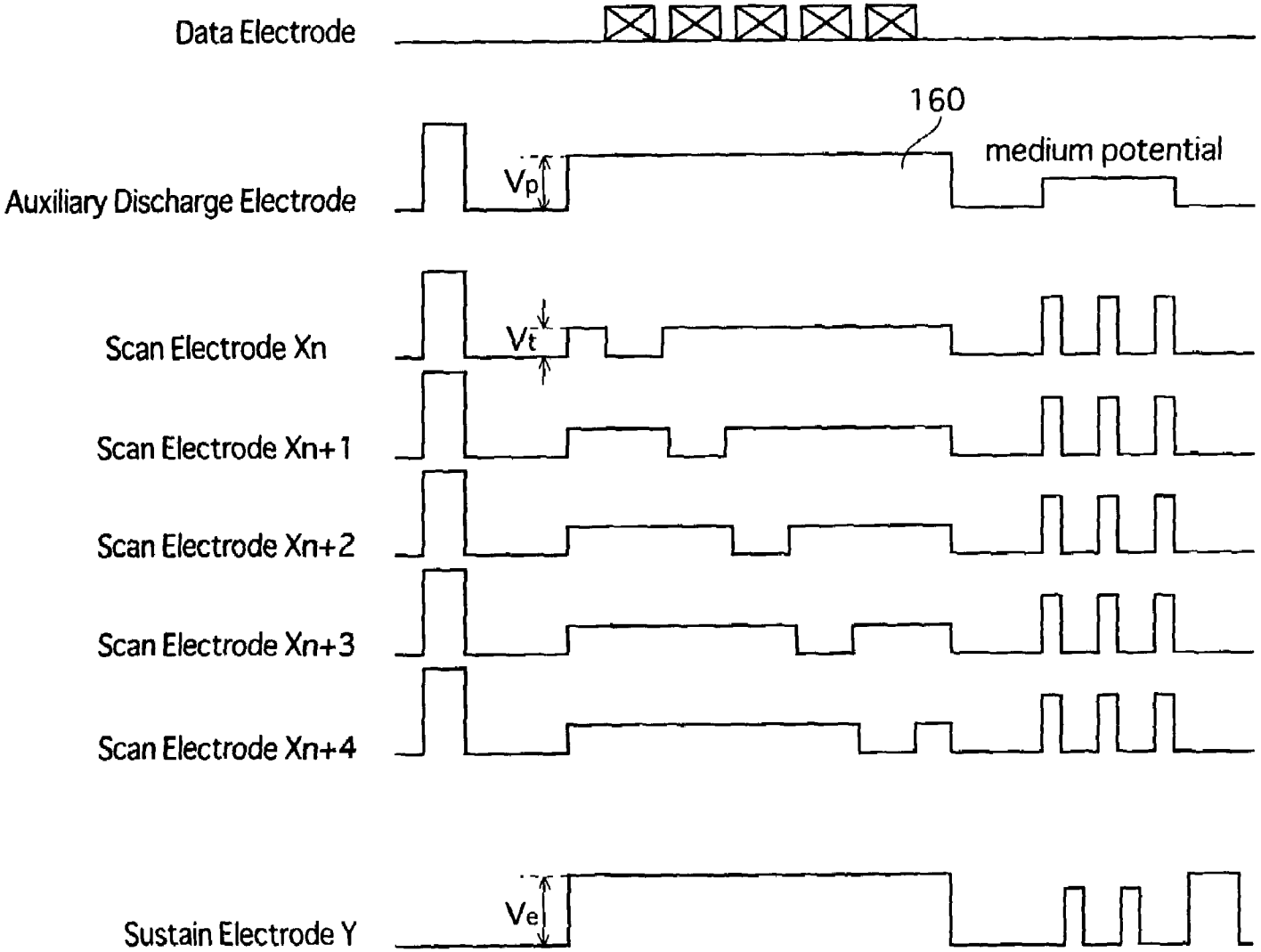
FIG. 22 shows drive waveforms of the PDP according to embodiment 3-3.

In order to set auxiliary discharge electrodes 31 to a high impedance state in the sustain period as shown in FIG. 21, a switch may be provided for turning "on" and "off" the connection between discharge inducing pulse generation circuit 55 (see drive circuit block in FIG. 19) and the auxiliary discharge electrodes, and the switch may be set to "off" in the sustain period, and "on" in all other periods.

In embodiment 3-2, because of the large potential difference between each auxiliary discharge electrode and an adjacent sustain electrode, unnecessary discharge is generated between the auxiliary discharge electrodes and sustain electrodes in the sustain period, and this unnecessary discharge can weaken or terminate a discharge generated between scan electrodes 11 and sustain electrodes 12. However, in the present embodiment, the occurrence of unnecessary discharge is prevented by maintaining auxiliary discharge electrodes 31 in a high impedance state in the sustain period.

Here, the high impedance state may be maintained with the auxiliary discharge electrodes being connected to each other, although to improve the prevention of unnecessary discharge it is preferable to disconnect auxiliary discharge electrodes in the sustain period and separately maintain each auxiliary discharge electrode in a high impedance state.

As shown in FIG. 22, on the other hand, in order to maintain auxiliary discharge electrodes 31 at a medium potential in the sustain period, the output of discharge inducing pulse generation circuit 55 may be kept at a regular level that is of the same polarity as the sustain pulse but lower in value (i.e. approx. ½ the amplitude of the sustain pulse).

In this case, the potential of all of the auxiliary discharge electrodes in the sustain period is maintained as at a level approximating the middle of the range over which the potential of scan electrodes 11 and sustain electrodes 12 fluctuates (i.e. a "medium potential"), and as result no great voltage occurs between auxiliary discharge electrodes 31 and adjacent sustain electrodes 12. As in the high impedance example above, it is thus possible to prevent the occurrence of unnecessary discharge.

Here, the circuit structure is, as shown in FIG. 19, relatively simple, since auxiliary discharge electrodes 31 in PDP 2 are connected to one another so that they can be driven collectively by discharge inducing pulse generation circuit 55.

Embodiment 3-4

Figure 23:
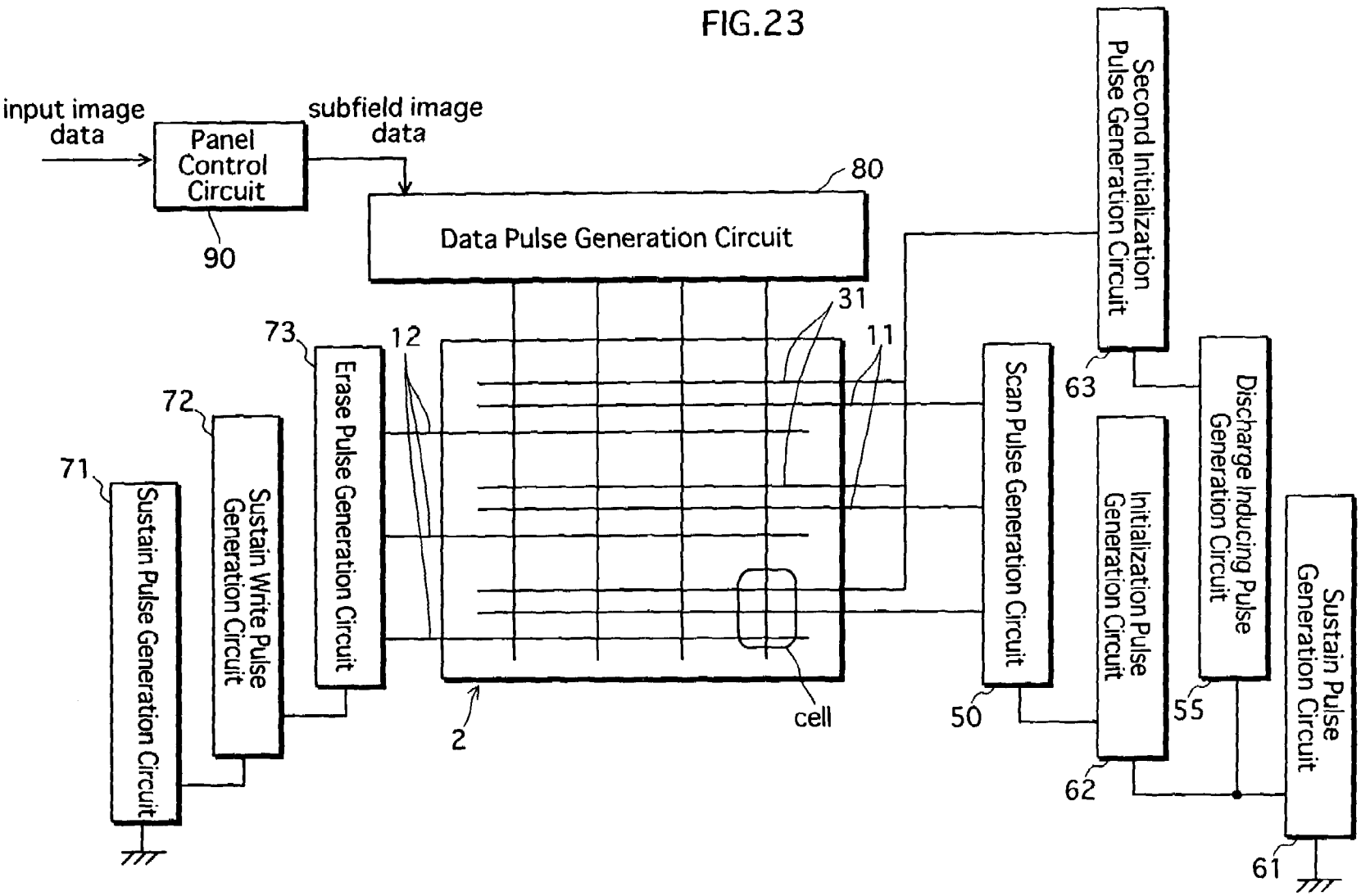
FIG. 23 shows a structure of a PDP display device according to an embodiment 3-4.

FIG. 23 shows a structure of a PDP display device according to the present embodiment.

The structure of a PDP 2 in the PDP display device is the same as that shown in FIG. 14 relating to embodiment 3-1 above.

A structure of the drive circuits is the same as that shown in FIG. 19, although included in the structure is a second initialization pulse generation circuit 63 for applying a second initialization pulse 101 having a regular amplitude (Vs) to auxiliary discharge electrodes 31 in the initialization period.

The circuits are connected such that discharge inducing pulse generation circuit 55 operates using the output of sustain pulse generation circuit 61 as a provisional ground level, and second initialization pulse generation circuit 63 operates using the output of discharge inducing pulse generation circuit 55 as a provisional ground level.

Figure 24:
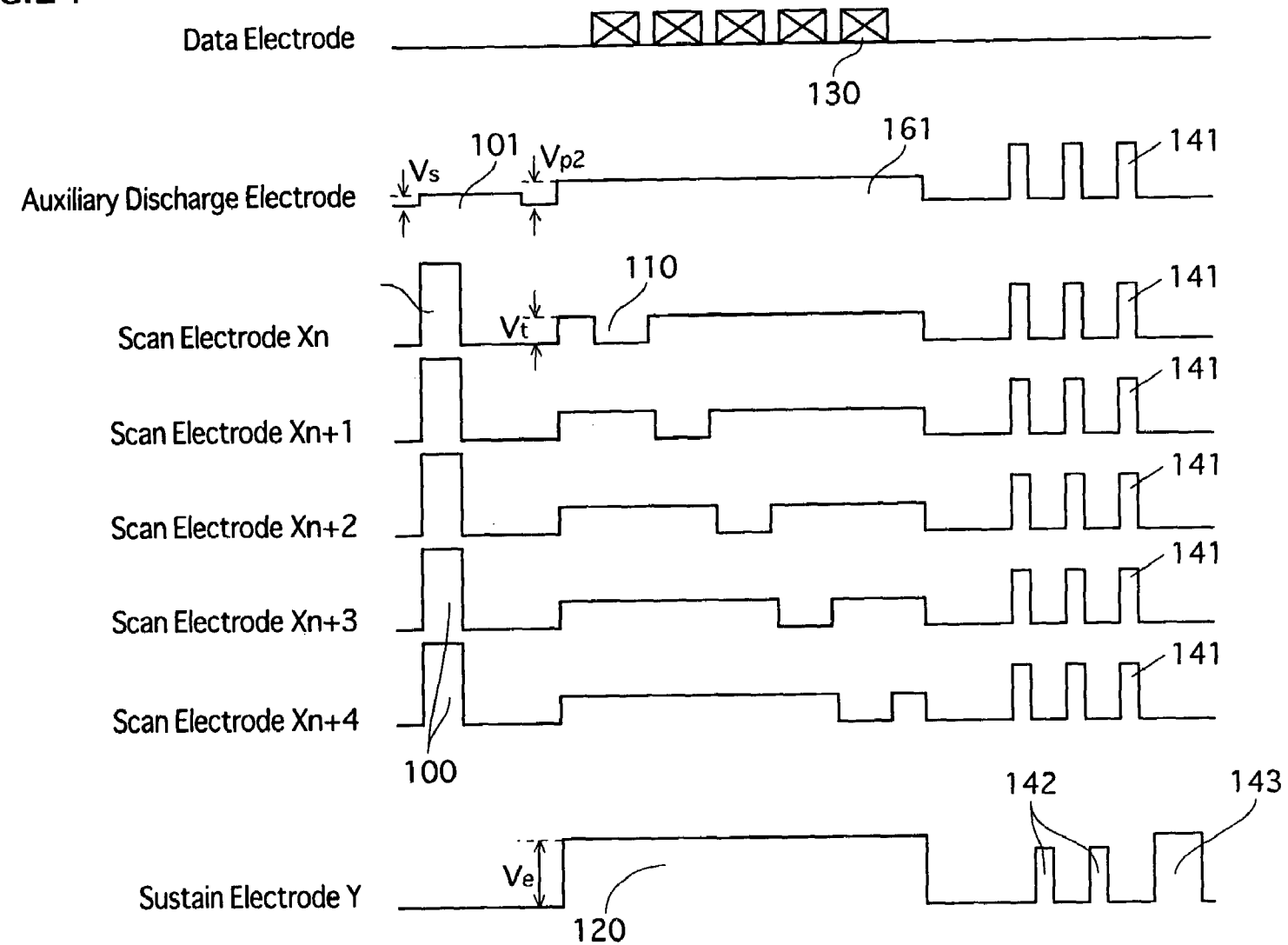
FIG. 24 shows drive waveforms of the PDP according to embodiment 3-4.

FIG. 24 shows drive waveforms applied to the electrodes in PDP 2 according to the present embodiment. The application of these waveforms will now be described with reference to FIG. 24.

The drive waveforms applied to scan electrodes 11, sustain electrodes 12 and data electrodes 21 are the same as those shown in FIG. 20 relating to embodiment 3-2.

On the other hand, a positive second initialization pulse 101 (voltage Vs) having an amplitude Vs is applied to auxiliary discharge electrodes 31 by second initialization pulse generation circuit 63 in the initialization period, and a positive sustain pulse 161 (voltage Vp2) having an amplitude Vp2 is applied to the auxiliary discharge electrodes by discharge inducing pulse generation circuit 55 in the sustain period. Here, amplitude Vs of the second initialization pulse is set lower than an amplitude of the initialization pulse applied to scan electrodes 11.

Consideration will now be given to the setting of voltage Vp2 and the gap between scan electrodes 11 and auxiliary discharge electrodes 31.

When, in the write period, a discharge inducing pulse is applied to auxiliary discharge electrodes 31 without a scan pulse being applied to scan electrodes 11, a potential difference of Vd3=(potential difference resulting from charge stored in the initialization period)+(Vp2−Vt) occurs between the scan electrodes and auxiliary discharge electrodes. Furthermore, when, in the write period, a scan pulse is applied to scan electrodes 11 in addition to the discharge inducing pulse applied to auxiliary discharge electrodes 31, a potential difference of Vd4=(potential difference resulting from charge stored in the initialization period)+Vp2 occurs between the scan electrodes and auxiliary discharge electrodes.

Consequently, the value of voltage Vp2 and the width of the gap between scan electrodes 11 and auxiliary discharge electrodes 31 is set so that a discharge is not generated between scan electrodes 11 and auxiliary discharge electrodes 31 at a potential difference between these electrodes of Vd3, whereas a discharge is generated between scan electrodes 11 and auxiliary discharge electrodes 31 at a potential difference between these electrodes of Vd4.

The following description relates to the generation of discharges and the like in the panel during the initialization and write periods when the drive waveforms shown in FIG. 24 are applied.

In the present embodiment, the amplitude Vs of second initialization pulse 101 applied to auxiliary discharge electrodes 31 is of lower amplitude than initialization pulse 100, and thus a preliminary discharge is generated between auxiliary discharge electrodes 31 and scan electrodes 11 in the initialization period (see FIG. 25A).

As a result of this preliminary discharge, positive charge is stored on the dielectric layer above auxiliary discharge electrodes 31, and negative charge is stored on the dielectric layer above scan electrodes 11 (see FIG. 25B).

Next, an auxiliary discharge is generated between scan electrodes 11 and auxiliary discharge electrodes 31 in the write period when the scan pulse is applied to scan electrodes 11 (see FIG. 25C), and space charge is generated in the discharge space (see FIG. 25D).

The basic operations and effects according to this structure are the same as those in embodiment 3-2, and thus the occurrence of defective writing can be suppressed, even when the scan pulse and data pulse are set to have a short pulse width (approx. 1.0 μsec). In the present embodiment, however, it is possible to set amplitude Vp2 of the discharge inducing pulse to a lower value than amplitude Vp of the discharge inducing pulse in embodiment 3-2.

In other words, a comparison of potential difference Vd4 of the present embodiment with potential difference Vd2 (=Vp) of embodiment 3-2 shows that both Vd4 and Vd2 can be viewed similarly, since both potential differences result in a voltage that only slightly exceeds the discharge sparking voltage between the scan electrodes and the auxiliary discharge electrodes. Consequently, it is possible to set amplitude Vp2 of the discharge inducing pulse to a lower value than amplitude Vp of the discharge inducing pulse applied to auxiliary discharge electrodes 31 in embodiment 3-2.

Costs related to the circuitry can thus be reduced as a result of being able to lower the voltage resistance of the circuit elements in discharge inducing pulse generation circuit 55.

Furthermore, the voltage resulting from the discharge inducing pulse applied in the write period is supplemented by the voltage generated by the charge stored in the initialization period, and thus an auxiliary discharge can be generated, even when amplitude Vp2 of the discharge inducing pulse is set lower than the discharge sparking voltage between scan electrodes 11 and auxiliary discharge electrodes 31.

Moreover, because sustain pulse generation circuit 61 is used to apply pulses to both scan electrodes 11 and auxiliary discharge electrodes 31 according to the present embodiment, circuitry costs can be reduced below those involved in providing separate circuits.

Variations of the Present Embodiment

Figure 26:
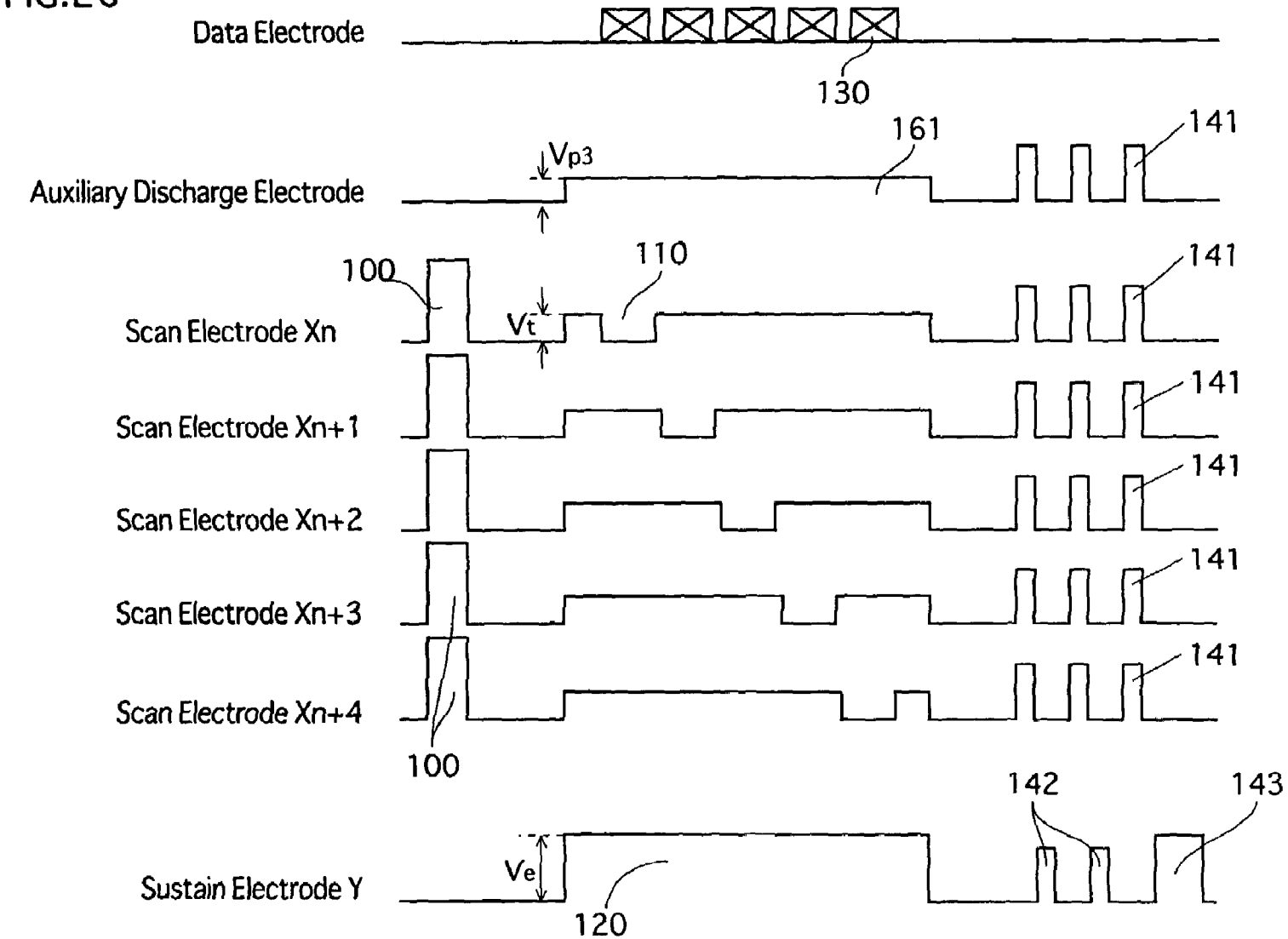
FIG. 26 shows a variation of the drive waveforms of the PDP according to embodiment 3-4.

As shown by the drive waveforms in FIG. 26, by setting auxiliary discharge electrodes 31 to a ground potential instead of applying the second initialization pulse, the same effects as described for the present embodiment can be achieved, even when the an amplitude Vp3 of the discharge inducing pulse is set to a lower value than amplitude Vp2. Moreover, according to this variation, it is possible to omit second initialization pulse generation circuit 63, and thus further reduce circuitry costs.

Also, the second initialization pulse applied to auxiliary discharge electrodes 31 need not have a positive polarity, and may be set to have a negative polarity. In this case, the amount of positive charge stored over auxiliary discharge electrodes 31 is further increased, and thus the same effects of the present embodiment can be achieved, even if the amplitude of the discharge inducing pulse applied to auxiliary discharge electrodes 31 is set still lower.

Furthermore, as described above in embodiment 3-3, by maintaining the output of second initialization pulse generation circuit 63 or discharge inducing pulse generation circuit 55 (see drive circuit block in FIG. 23) to be either (i) in a high impedance state in the sustain period, or (ii) ½ the amplitude of the sustain pulse in the sustain period, it is possible to prevent the weakening or terminating of a sustain discharge between the scan electrodes 11 and sustain electrodes 12 required for display, and it is further possible to prevent a discharge from occurring between auxiliary discharge electrodes 31 and sustain electrodes 12.

Again, the same effects as described above for the present embodiment can be achieved, even if the positioning of second initialization pulse generation circuit 63 and discharge inducing pulse generation circuit 55 is switched so that circuit 63 is operated using the output of sustain pulse generation circuit 61 as a reference potential, and circuit 55 is operated using the output of circuit 63 as a reference potential.

Embodiment 3-5

Figure 27:
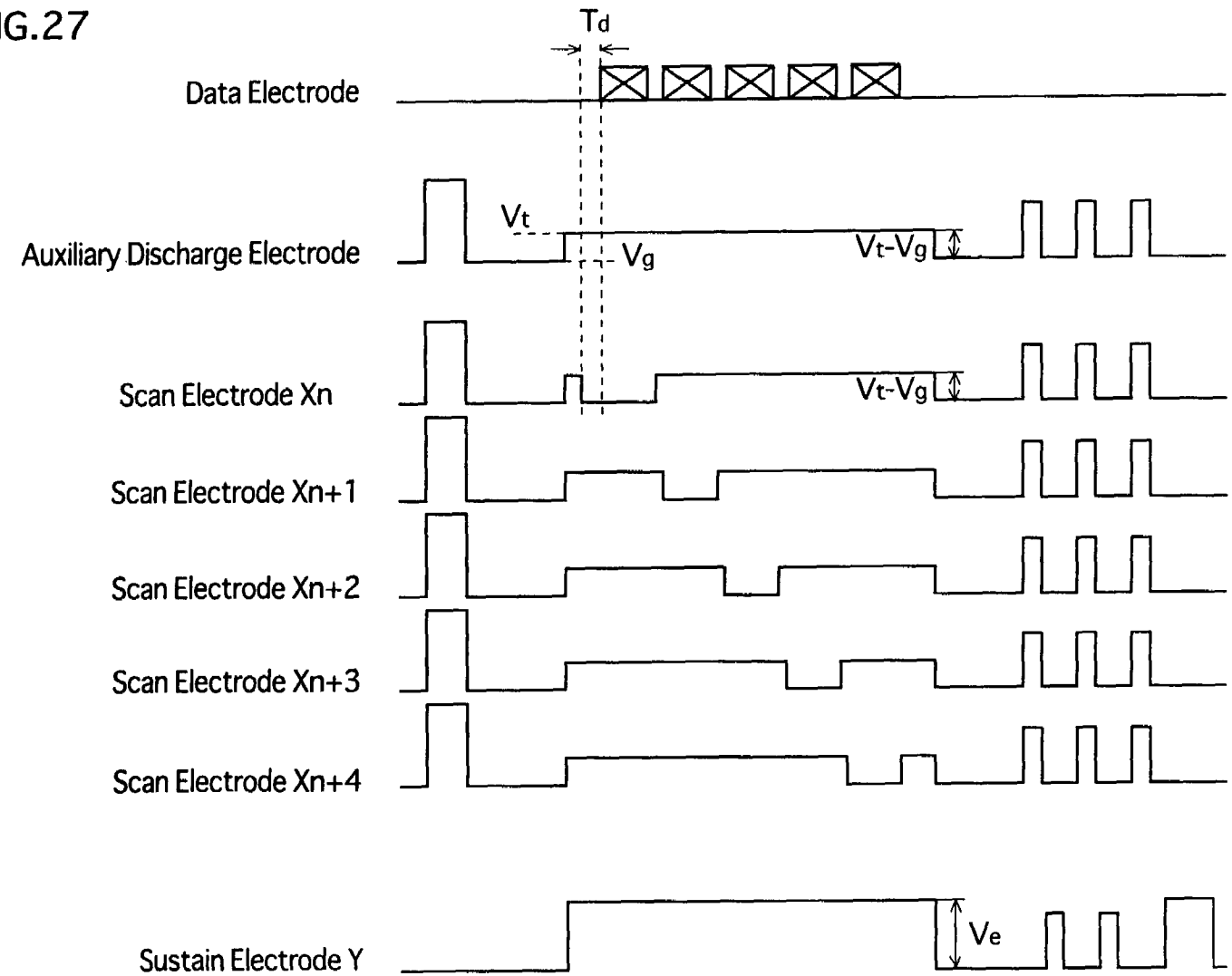
FIG. 27 shows drive waveforms of a PDP according to an embodiment 3-5.

FIG. 27 shows drive waveforms of a PDP according to the present embodiment. These drive waveforms are substantially the same as those shown in FIG. 16, although in the present embodiment, a short delay period Td is set between the time at which application of the scan pulse is commenced and the time at which application of the data pulse is commenced.

The setting of delay period Td may be conducted by adjusting the timing at which the trigger signal is sent from panel control circuit 90 to data pulse generation circuit 80.

Delay period Td may be set to be greater than Ons and less than or equal to 500 ns, although preferably below 300 ns. The reasons for this are as follows.

According to this structure, the auxiliary discharge is generated after a short delay from when application of the scan pulse is commenced, and the space charge resulting from this discharge recombines over time and is eliminated. Furthermore, in order to generate a fast and effective write discharge, the data pulse must be applied while there is space charge in the discharge space. Consequently, application of the data pulse is preferably conducted after the generation of space charge from the auxiliary discharge and before the space charge is eliminated. This period is in a range of 0 ns to 500 ns.

Consequently, by delaying application of the data pulse by 0 ns to 500 ns after application of the scan pulse is commenced, it is possible to further shorten the time period required for the write discharge to generate from the auxiliary discharge.

Here, the drive waveforms shown in FIG. 16 relate to when delay period Td=0.

Furthermore, the same effects as described for the present embodiment can be achieved by setting delay period Td in not only embodiment 3-1 but also in embodiments 3-2 to 3-4.

Embodiment 3-6

In embodiments 3-1 to 3-4 relating to PDP 2, an auxiliary discharge is generated between a scan electrode 11 and an auxiliary discharge electrode 31 whenever a scan pulse is applied to the scan electrode. However, in the present embodiment, as described below, it is possible to further enhance the generation of this auxiliary discharge by making some adjustments to the electrode structure of PDP 2.

Figure 28B:
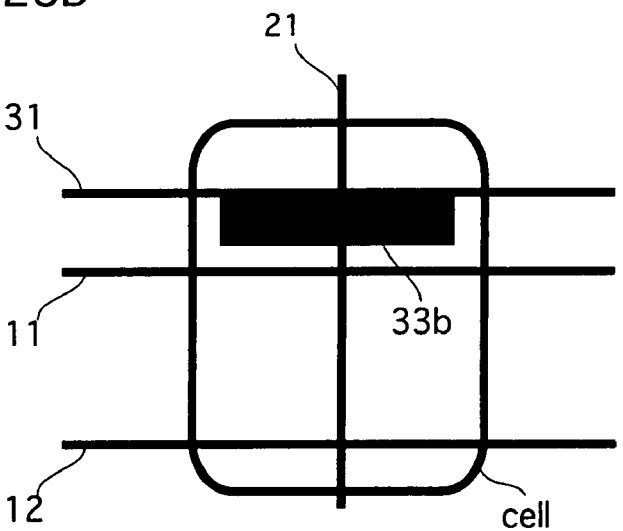
FIGS. 28A~28H show an electrode structure of a PDP according to an embodiment 3-6.
Figure 28A:
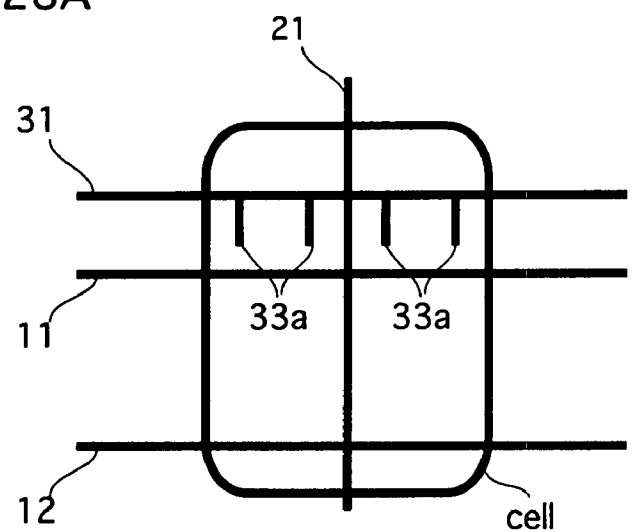

In the example shown in FIG. 28A, one or a plurality of ctenoid-shaped small protrusions 33*a* is formed on auxiliary discharge electrodes 31 in the cells, so as to protrude toward scan electrodes 11. According to this structure, the gap between auxiliary discharge electrodes 31 and scan electrodes 11 is narrowed, and this facilitates the generation of the auxiliary discharge.

In the example shown in FIG. 28B, a wide protrusion 33*b* is formed on auxiliary discharge electrodes 31 in the cells, so as to protrude toward scan electrodes 11. According to this structure, in addition to the gap between auxiliary discharge electrodes 31 and scan electrodes 11 being narrowed, the resistance value of auxiliary discharge electrodes 31 is reduced, and this prevents a reduction in voltage when a discharge is generated, in addition to facilitating the generation of an auxiliary discharge.

Figure 28D:
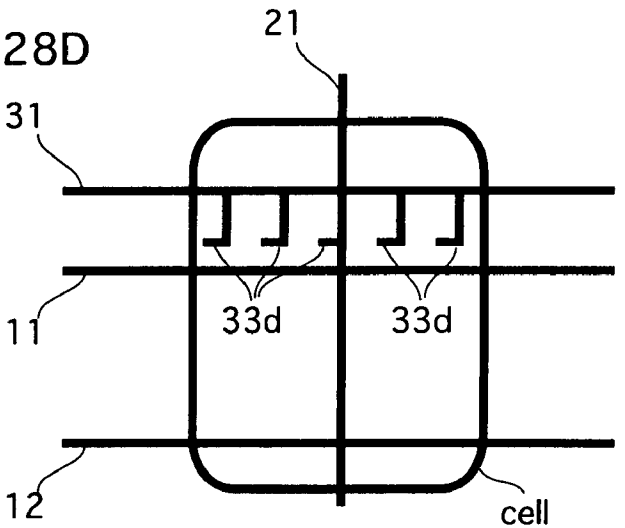
Figure 28C:
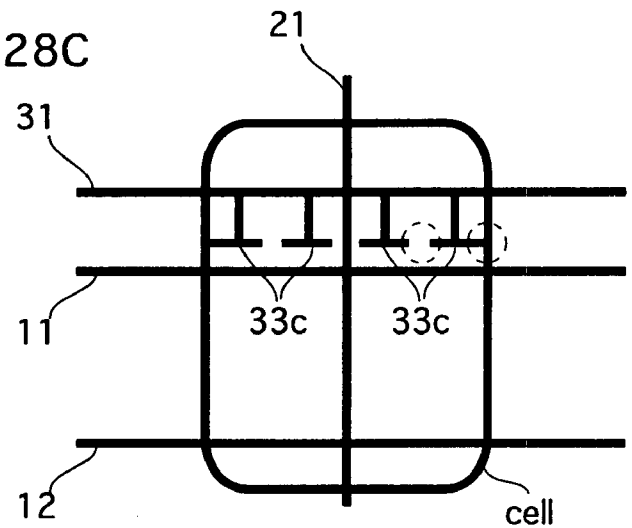
Figure 28E:
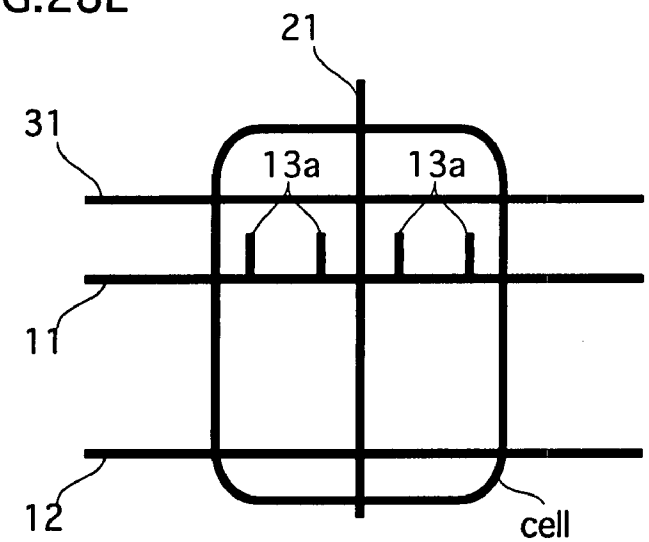
Figure 28F:
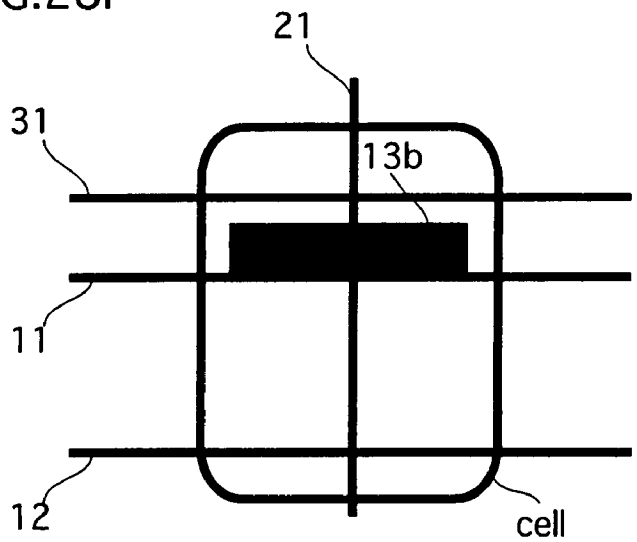
Figure 28G:
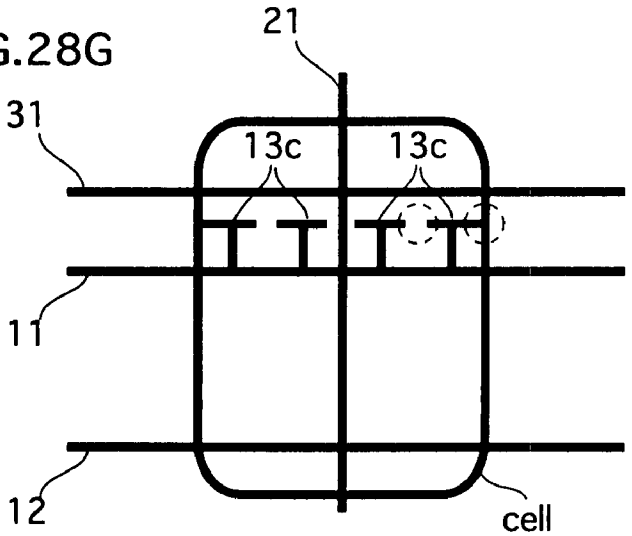
Figure 28H:
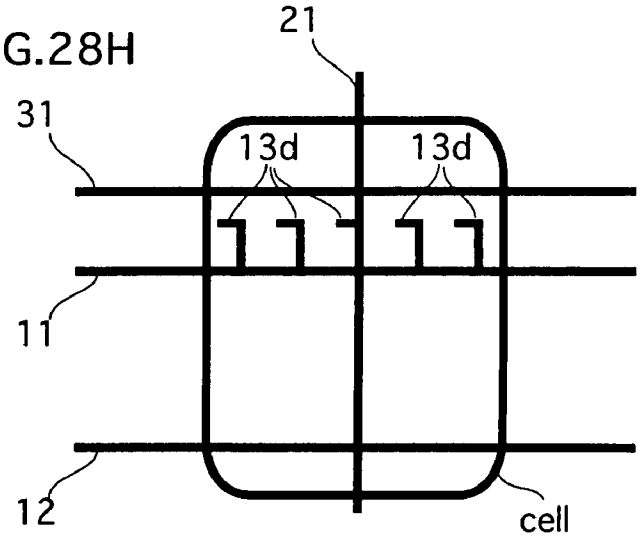

In the example shown in FIG. 28C, one or a plurality of T-shaped protrusions 33*c* is formed on auxiliary discharge electrodes 31 in the cells, so as to protrude toward scan electrodes 11.

And in the example shown in FIG. 28D, one or a plurality of L-shaped protrusions 33*c* is formed on auxiliary discharge electrodes 31 in the cells, so as to protrude toward scan electrodes 11. According to these structures, in addition to the auxiliary discharge being facilitated by the narrowing of the gap between auxiliary discharge electrodes 31 and scan electrodes 11, it is possible to prevent the electrodes from burning out due to the flow of excess voltage current.

In comparison with the T-shaped protrusions 33*c* in FIG. 28C, which each have two end parts (i.e. the circled parts in FIG. 28C), the L-shaped protrusions 33*d* in FIG. 28D each have only one end part. Here, it is relatively easy for the end parts of electrodes formed on a substrate to become detached from the substrate. As such, there is less chance of the end parts of the L-shaped protrusions from becoming detached.

Here, in the examples shown FIGS. 28A to 28D, protrusions 33*a* to 33*d* are formed on auxiliary discharge electrodes 31. However, the same effects can be achieved, even if protrusions 33*a* to 33*d* are formed on scan electrodes 11 as shown in FIGS. 28E to 28H.

Embodiment 4-1

Structure of PDP Display Device

Figure 29:
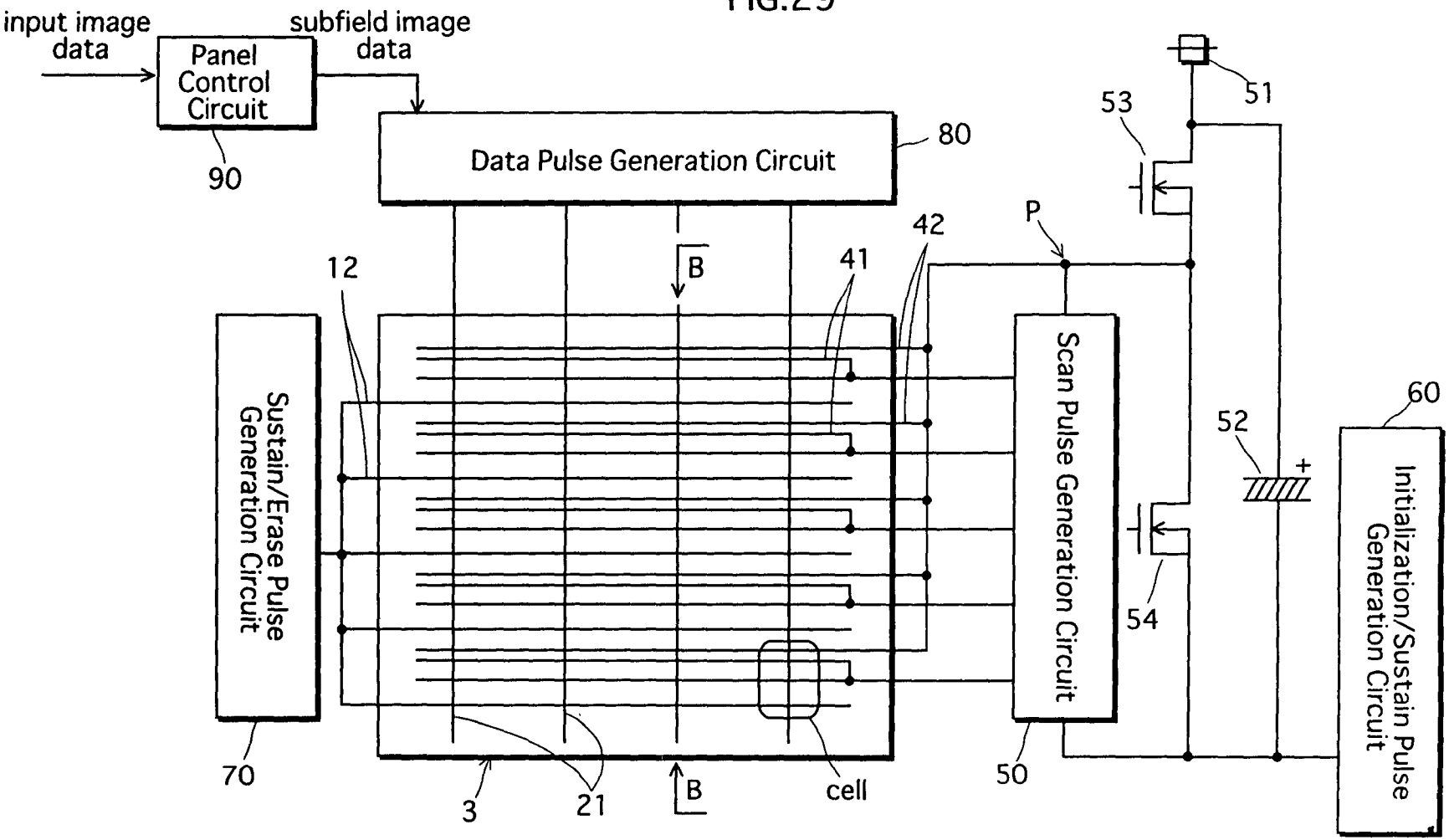
FIG. 29 shows a structure of a PDP display device according to an embodiment 4-1.
Figure 30:
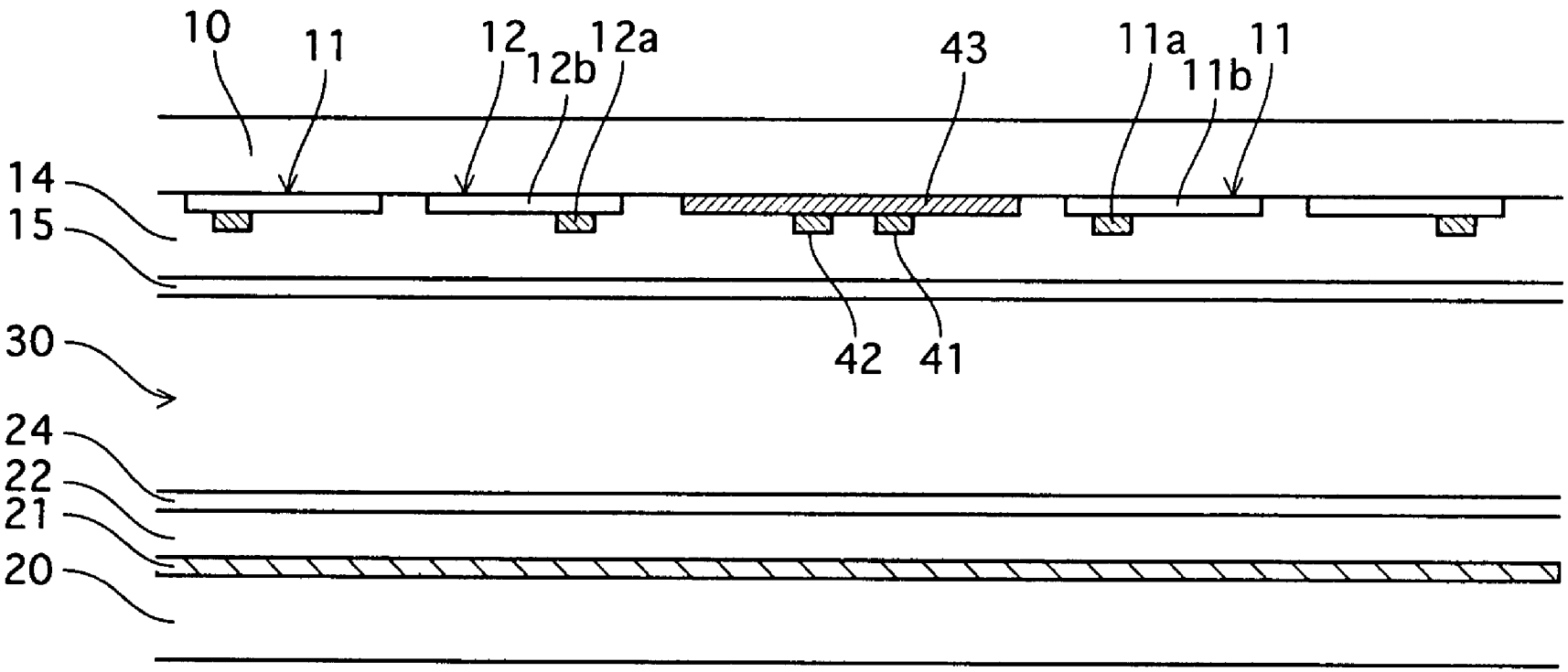
FIG. 30 is a structural cross-sectional diagram along a B~B axis of the PDP shown in FIG. 29.

FIG. 29 shows a structure of a PDP display device according to the present embodiment. FIG. 30 is a structural cross-sectional diagram along a B~B axis of a PDP 3 shown in FIG. 29.

The structure of PDP 3 in the PDP display device is the same as PDP 2 shown in FIG. 14, although in comparison with PDP 2 in which auxiliary discharge electrodes 31 are provided adjacent to scan electrodes 11 so that an auxiliary discharge may be generated between scan electrodes and adjacent auxiliary discharge electrodes, in PDP 3 of the present embodiment, a pair of auxiliary discharge electrodes (i.e. a first auxiliary discharge electrode 41 and a second auxiliary discharge electrode 42) are arranged adjacent to each scan electrode 11, the auxiliary discharge electrodes are provided over a shading film 43, and the auxiliary discharge is generated between the auxiliary discharge electrodes 41 and 42 in each pair.

In order to generate an auxiliary discharge between first and second auxiliary discharge electrodes 41 and 42, the gap between electrodes 41 and 42 is set so that a small discharge is generated at a potential difference of approximately (Vt−Vg). Here, this gap is preferably set at a width that allows a discharge to be generated when the aforementioned potential difference is greater than or equal to (Vt−Vg)/2. In numerical terms this equates to a gap in a range of 10 μm to 50 μm.

Furthermore, as shown in FIG. 29, each first auxiliary discharge electrode 41 is connected to an adjacent scan electrode 11, and second auxiliary discharge electrodes 42 are connected to each other at point P in FIG. 29.

The drive circuit structure according to the present embodiment is identical to that described in embodiment 3-1 with reference to FIG. 14, and thus there is no increase in circuitry related costs according to the present embodiment.

Drive Waveforms and Drive Circuits

Figure 31:
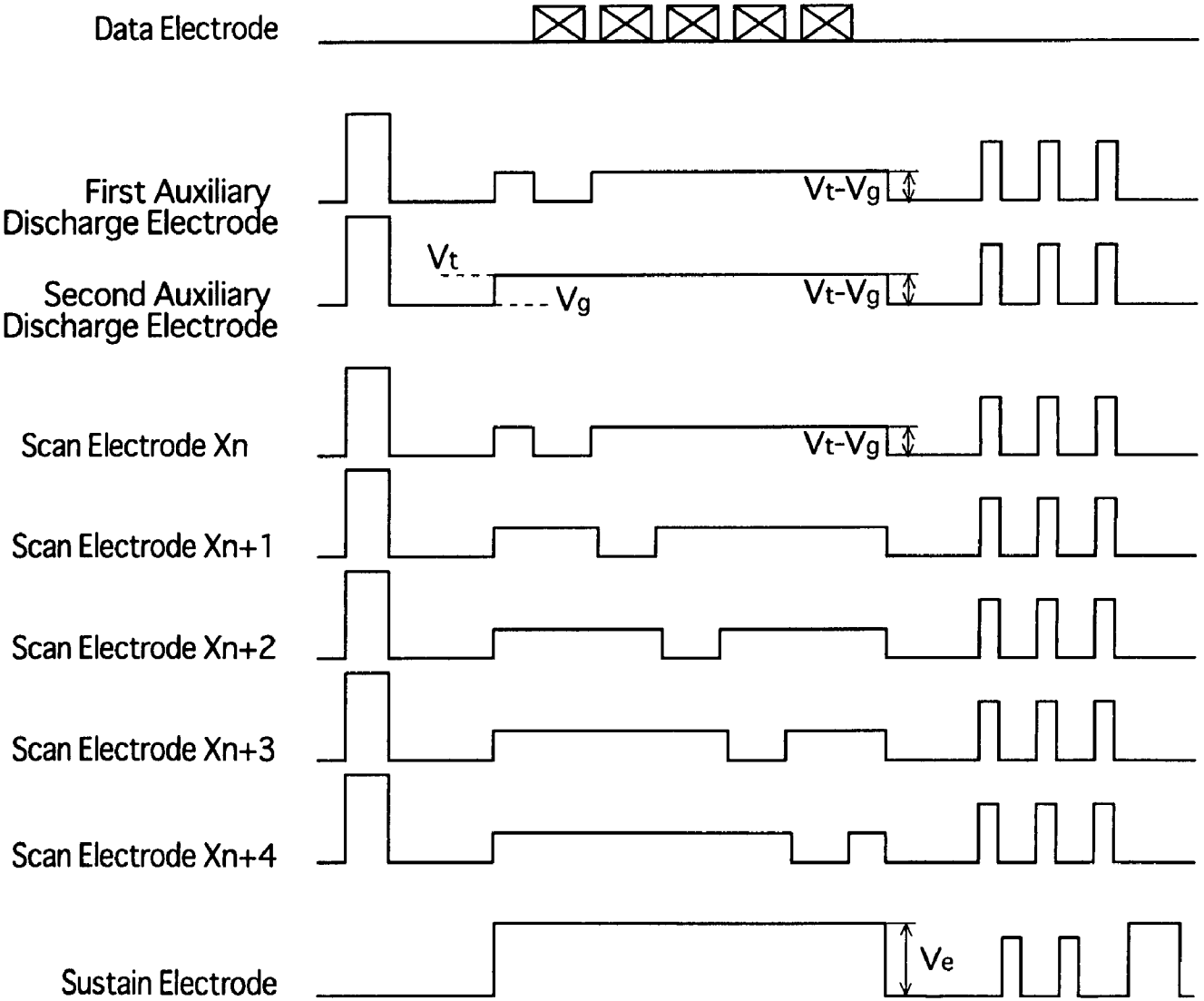
FIG. 31 shows drive waveforms of the PDP according to embodiment 4-1.

FIG. 31 shows drive waveforms applied to the electrodes in PDP 3.

The drive waveforms applied to scan electrodes 11, sustain electrodes 12 and data electrodes 21 are the same as those shown in FIG. 16 relating to embodiment 3-1, and the operation of PDP 3 is basically the same as for drive waveforms in a conventional three electrode AC-type surface discharge PDP. Also, the drive waveforms applied to second auxiliary discharge electrodes 42 are the same as those applied to auxiliary discharge electrodes 31 as described in embodiment 3-1 with reference to FIG. 16.

Furthermore, the drive waveforms applied to each first auxiliary discharge electrode 41 are the same as those applied to scan electrodes 11 positioned adjacent thereto. Here, with respect to first auxiliary discharge electrodes 41, FIG. 31 only shows the drive waveform applied to the first auxiliary discharge electrode positioned adjacent to scan electrode Xn.

Figure 32A:
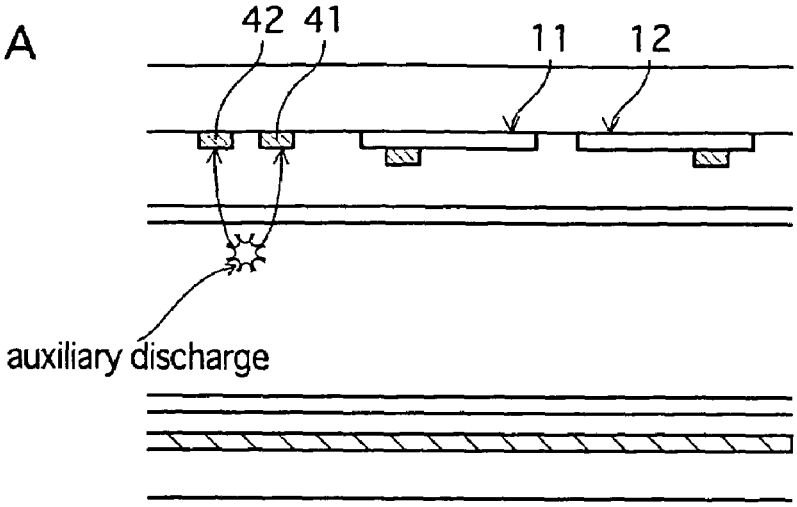
FIGS. 32A~32C show the generation of discharges and the like within a panel in a write period according to embodiment 4-1.
Figure 32B:
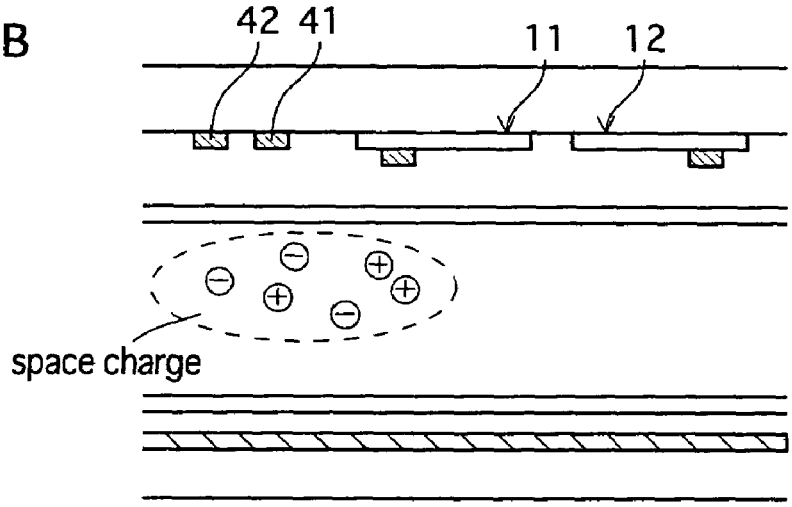
Figure 32C:
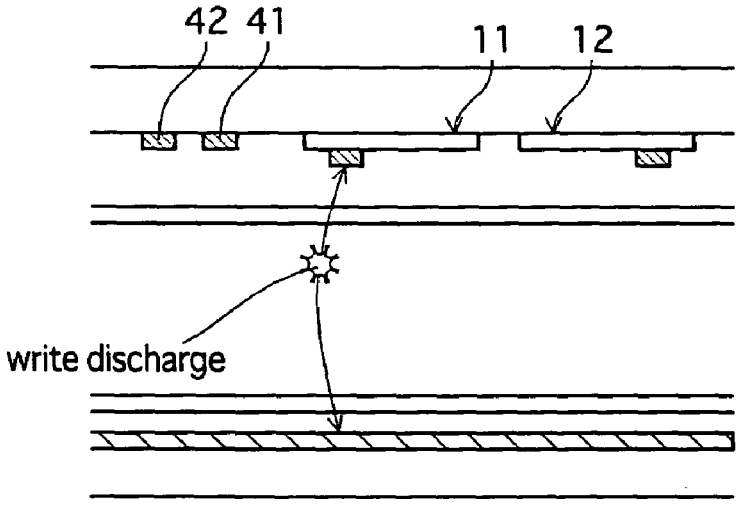

The generation of discharges and the like in the panel during the write period will now be described with reference to FIGS. 32A to 32C.

Since the scan pulse has a negative polarity and an amplitude (Vt−Vg), a potential difference (Vt−Vg) occurs between first auxiliary discharge electrodes 41 and second auxiliary discharge electrodes 42 when the scan pulse is applied to scan electrodes 11. Consequently, as shown in FIG. 32A, an auxiliary discharge is generated between the first and second auxiliary discharge electrodes whenever the scan pulse is applied to the scan electrodes. And as shown in FIG. 32B, space charge is generated in the discharge space as a result of the auxiliary discharge.

On the other hand, a data pulse is applied to the data electrode corresponding to the on-cell whenever the scan pulse is applied to the scan electrode in the on-cell. Because of the large amount of space charge existing in the on-cell as a result of the auxiliary discharge, a write discharge is generated quickly and effectively. Thus, it is possible to generate a write discharge effectively, even when the scan pulse is set to have a short pulse width (i.e. approx. 1.0 μsec).

Furthermore, as described above in embodiment 3-1, because the number of auxiliary discharges that are generated is not great, there is no deterioration in the properties of protective layer 15 caused by ion sputtering. Moreover, because a shading film is formed beneath each pair of first and second auxiliary discharge electrodes 41 and 42, it is possible to suppress reductions in contrast caused by the auxiliary discharge.

In addition to the effect achievable by embodiment 3-1 above, the present embodiment can achieve the following.

In embodiment 3-1, because an auxiliary discharge is generated between auxiliary discharge electrodes 31 and scan electrodes 11, either excess or insufficient amounts of wall charge may be stored on the surface of the dielectric layer over scan electrodes 11, and this may result in defective illumination, such as off-cells being illuminated or on-cells not being illuminated in the sustain period.

However, in the present embodiment, because the auxiliary discharge is generated between the first and second auxiliary discharge electrodes 41 and 42 (i.e. electrodes other than scan electrodes 11), the auxiliary discharge has virtually no effect on the formation of wall charge on the dielectric layer over scan electrodes 11. This means that prior art drive technology for a conventional three electrode AC-type surface discharge PDP can be used without modification to conduct the basic driving of scan electrodes 11, sustain electrodes 12 and data electrodes 21.

Figure 33:
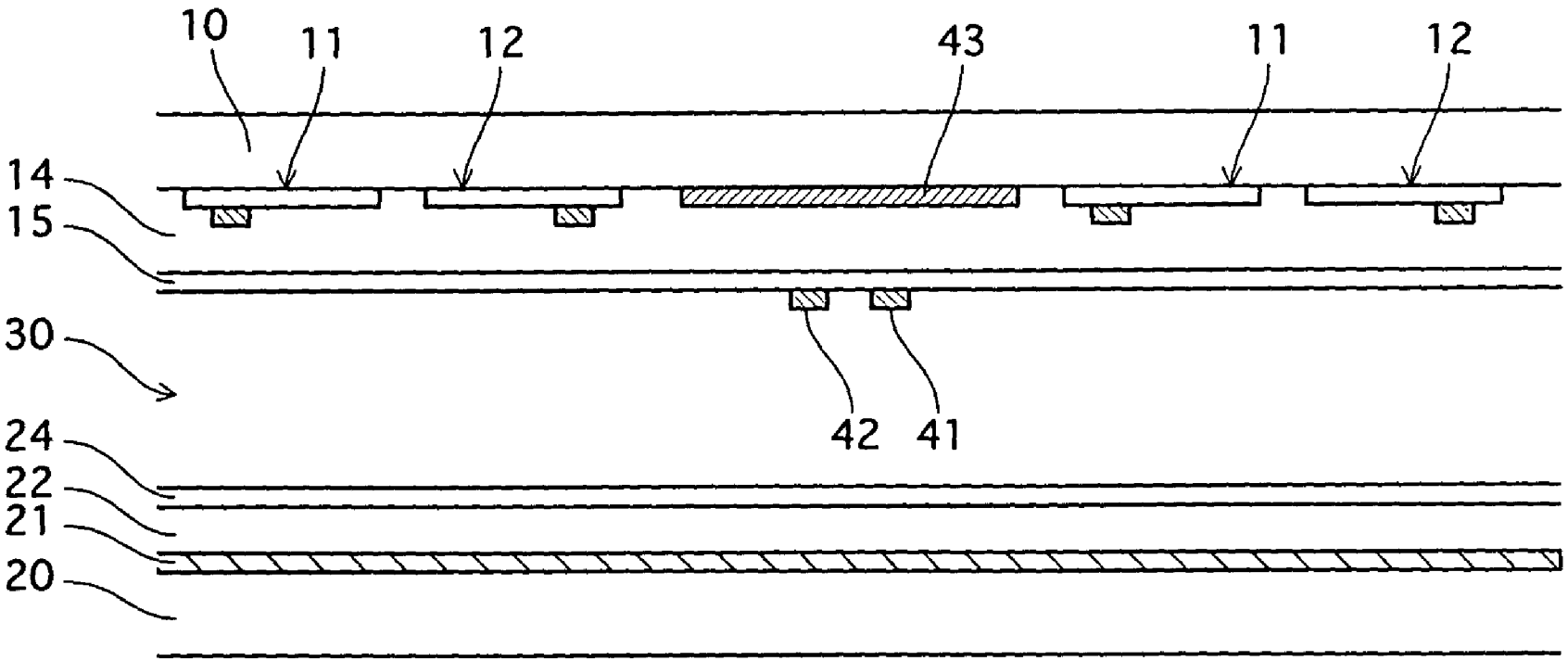
FIG. 33 is a structural cross-sectional diagram of the PDP according to a variation of embodiment 4-1.

Here, as shown in the example in FIG. 30, first and second auxiliary discharge electrodes 41 and 42 in PDP 3 are formed directly over shading film 43, and these electrodes are covered with dielectric layer 14 and protective layer 15. However, as shown in FIG. 33, dielectric layer 14 and protective layer 15 may be formed over shading film 43, and first and second auxiliary discharge electrodes 41 and 42 may then be formed on top of layers 14 and 15. In this case, the auxiliary discharge can still be generated as described above, even though first and second auxiliary discharge electrodes 41 and 42 face directly into the discharge space.

Furthermore, because the number of auxiliary discharges that are generated is not great, there is no deterioration of the properties of first and second auxiliary discharge electrodes 41 and 42 due to ion sputtering. Moreover, because a shading layer is formed beneath electrodes 41 and 42, it is possible to suppress the reductions in contrast caused by the auxiliary discharge.

Configurations within Electrode Extension Area

Figure 34:
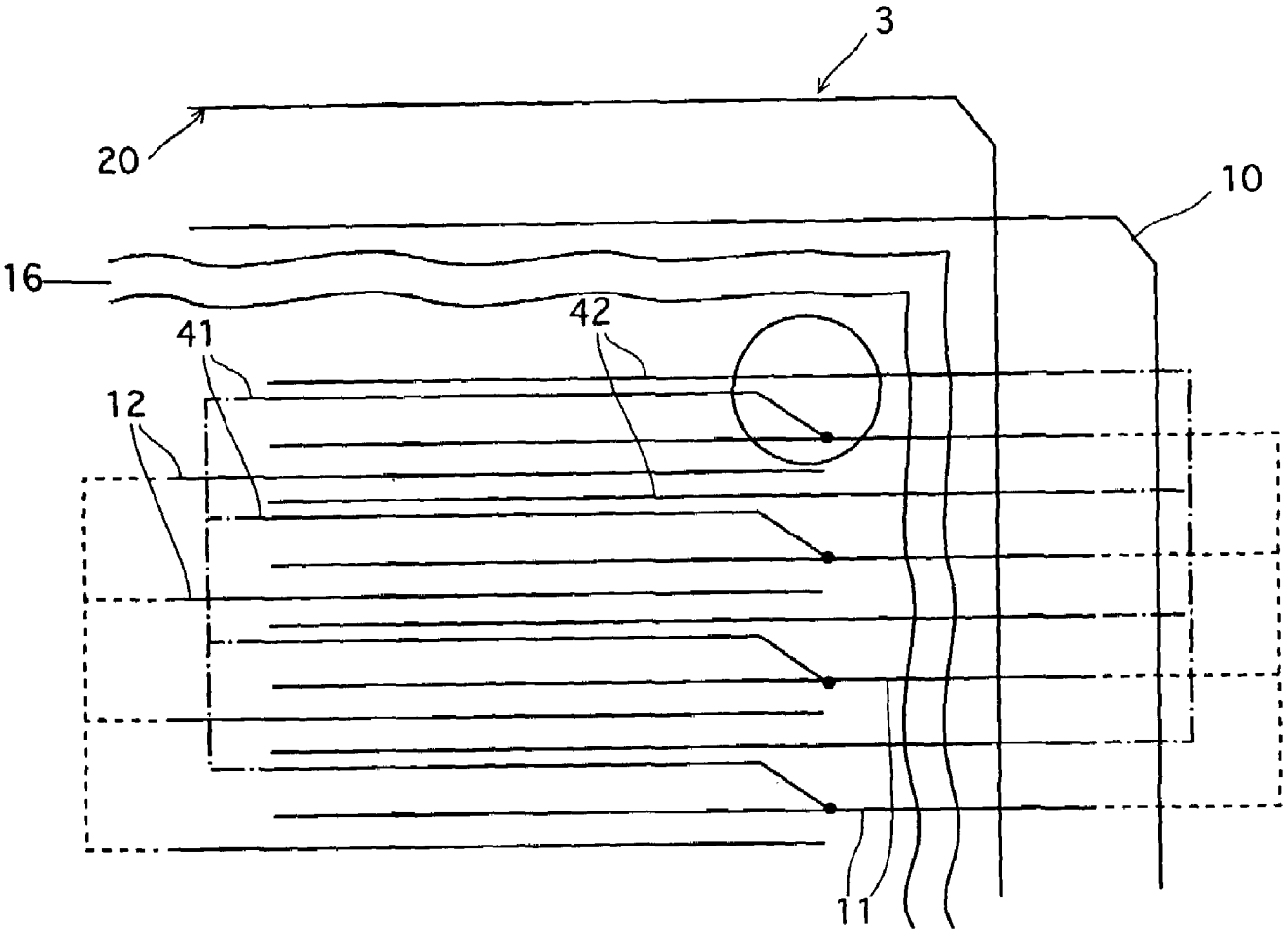
FIG. 34 show the configuration of electrodes in an electrode extension area according to embodiment 4-1.

The configuration of electrodes within the electrode extension area will now be described with reference to FIG. 34.

In PDP 3 of the present embodiment, the number of first auxiliary discharge electrodes 41 and second auxiliary discharge electrodes 42 formed on the front glass substrate 10 is each equal to the number of scan electrodes 11, and thus the number of electrodes increases two-fold over the number of scan electrodes in a conventional PDP.

If, for example, scan electrodes 11 and first and second auxiliary discharge electrodes 41 and 42 were extended to an area outside of sealing unit 16, the number of electrodes in the electrode extension area would be 1.5 times that of embodiment 3-1 (or 3 times that of a conventional PDP), and connecting each of the electrodes in the electrode extension area to the FPC would be difficult.

However, in the present embodiment, first auxiliary discharge electrodes 41 are connected to adjacent scan electrodes 11 within the area marked by sealing unit 16 (i.e. electrodes 41 are not extended), and thus the number of electrodes that are extended beyond the area marked by sealing unit 16 is restricted to the same as that in embodiment 3-1.

Consequently, by setting the gap between scan electrodes 11 in the electrode extension area to be greater than or equal to the equivalent gap in the display area (i.e. the same as in embodiment 3-1), it is possible to prevent a discharge from being generated in the electrode extension area.

Furthermore, as in embodiment 3-1, the gap between the first and second auxiliary discharge electrodes in each pair widens in a section of the display area near sealing unit 16 (i.e. the circled section in FIG. 34), and the gap between these electrodes in the electrode extension area is set to be wide.

Specifically, by setting the gap between first and second auxiliary discharge electrodes 41 and 42 in the electrode extension area at a width (preferably in a range of approx. 50 μm to 300 μm) that does not allow a discharge to generate even at a potential difference of approximately (Vt−Vg), it is possible to prevent a discharge from occur-ring between the first and second auxiliary discharge electrodes in the electrode extension area.

Embodiment 4-2

Figure 35:
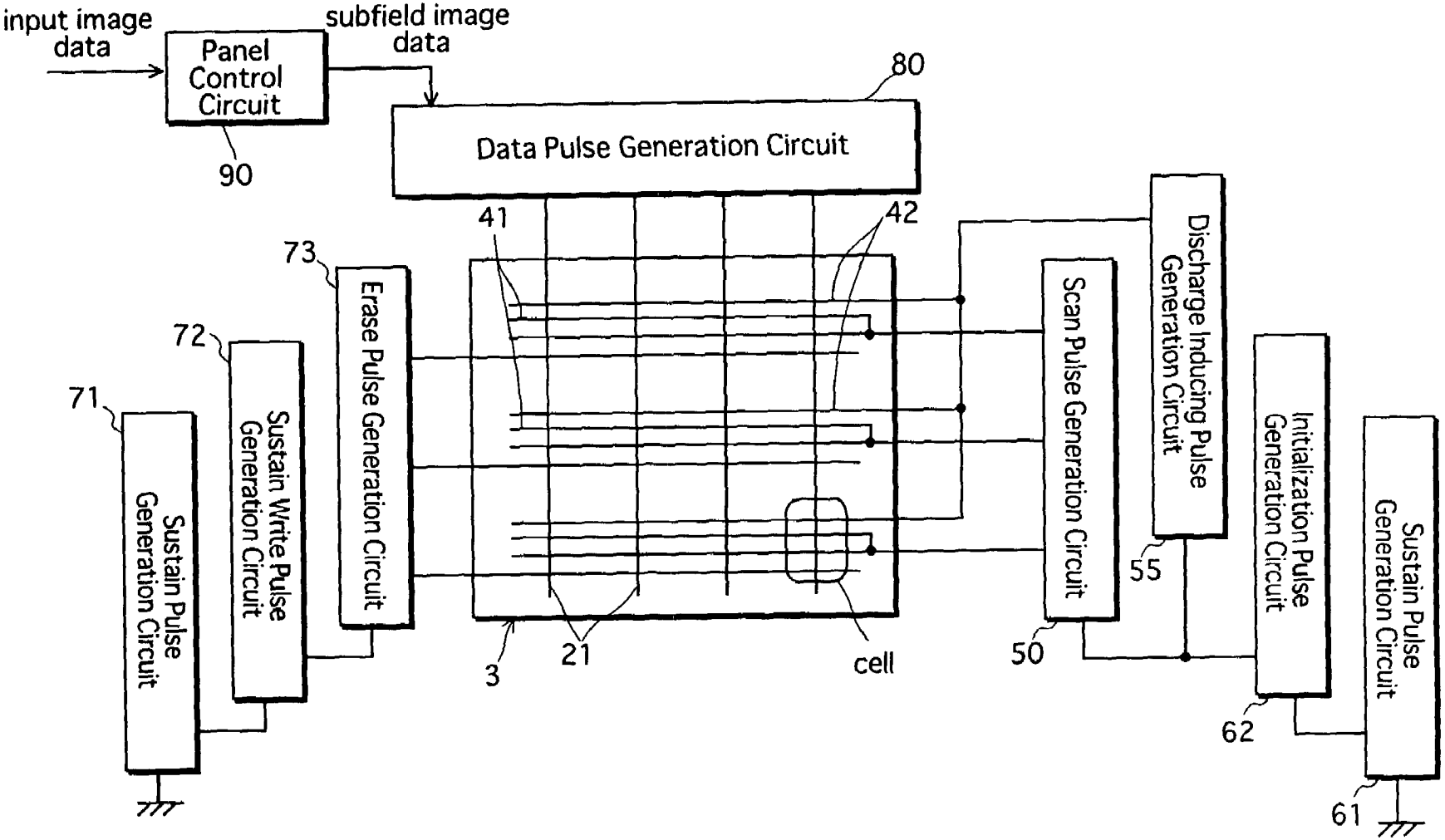
FIG. 35 shows a structure of a PDP display device according to an embodiment 4-2.

FIG. 35 shows a PDP display device according to the present embodiment. The structure of a PDP 3 in the PDP display device is the same as that shown in FIG. 29 relating to embodiment 4-1.

Since the drive circuitry is the same as that in embodiment 3-2, a detailed description will not be given here, although to apply pulses to scan electrodes 11 and first auxiliary discharge electrodes 41, the panel includes scan pulse generation circuit 50 for applying a scan pulse (i.e. a negative pulse of amplitude Vt referenced on a potential Vt), sustain pulse generation circuit 61 for applying a sustain pulse, and initialization pulse generation circuit 62 for applying an initialization pulse. Furthermore, to apply pulses to second auxiliary discharge electrodes 41, the panel includes discharge inducing pulse generation circuit 55 for generating, in the write period, a discharge inducing pulse having a regular voltage Vp, and to apply pulses to sustain electrodes 12, the panel includes a sustain pulse generation circuit 71 for applying a sustain pulse, a sustain write pulse generation circuit 72 for applying a positive sustain write pulse 120 (amplitude Ve) to sustain electrodes 12, and an erase pulse generation circuit 73 for applying an erase pulse to sustain electrodes 12.

Figure 36:
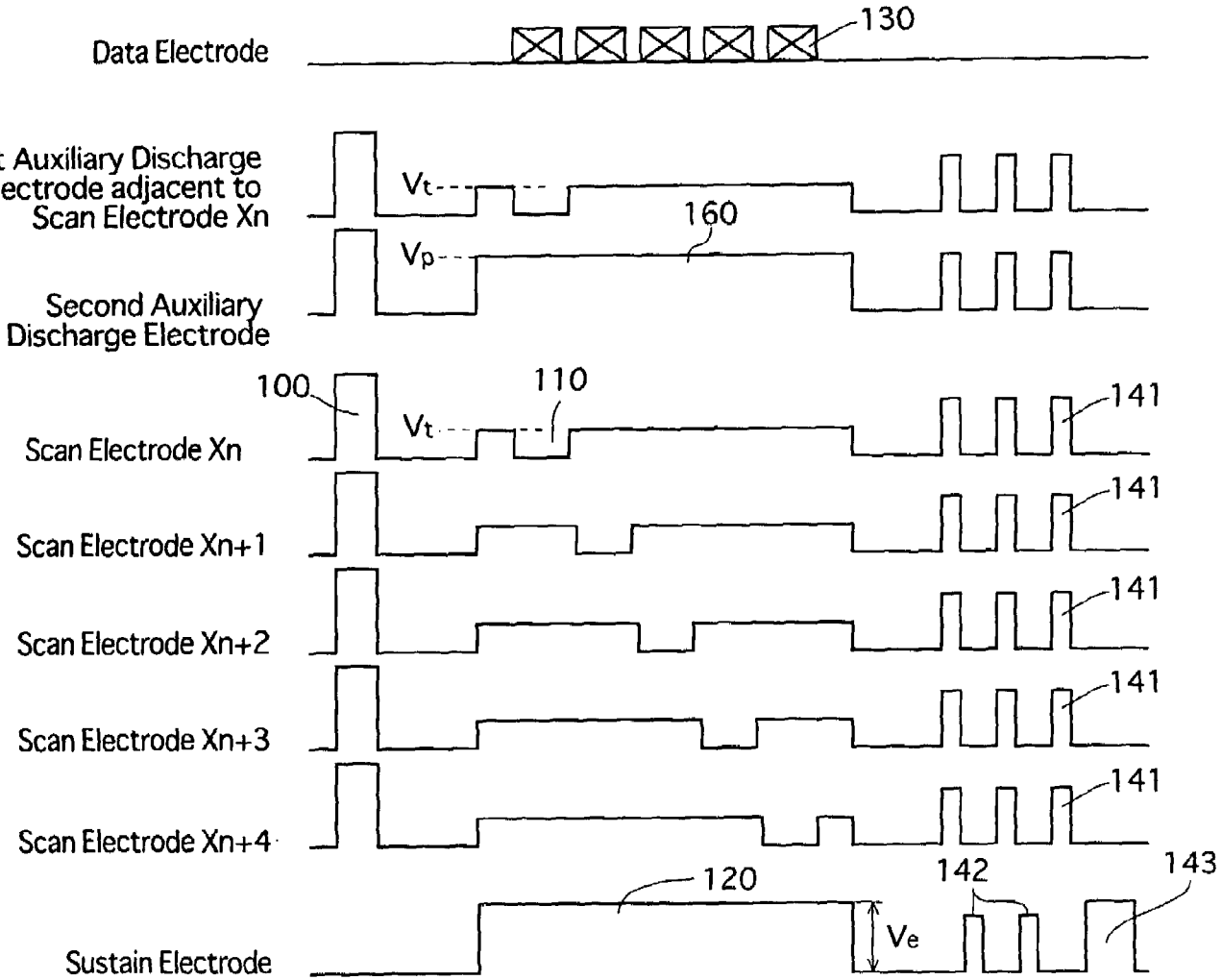
FIG. 36 shows drive waveforms of the PDP according to embodiment 4-2.

FIG. 36 shows drive waveforms applied to the electrodes in PDP 3. Although these drive waveforms are substantially the same as those shown in FIG. 31 relating to embodiment 4-1, in the present embodiment it is possible for discharge inducing pulse generation circuit 55 to adjust voltage Vp applied to second auxiliary discharge electrodes 42 in the write period independently of voltage Vt, and thus voltage Vp can be set to a high value.

The value of voltage Vp and the width of the gap between first and second auxiliary discharge electrodes 41 and 42 are set so that (i) a potential difference between a first and second auxiliary discharge electrode positioned adjacent to a scan electrode to which a scan pulse is being applied only slightly exceeds the discharge sparking voltage between electrodes 41 and 42, (ii) a discharge is not generated between electrodes 41 and 42 when the potential difference between these electrodes is (Vp−Vt), and (iii) a discharge is generated between electrodes 41 and 42 at a potential difference Vp.

Here, because voltage Vp is set at a high value in the present embodiment, it is possible to set the gap between the first and second auxiliary discharge electrodes in each pair to be wider than was possible in embodiment 4-1.

The generation of discharges and the like when the waveforms shown in FIG. 36 are applied in PDP 3 is the same as described in embodiment 4-1 with reference to FIG. 32, and thus an auxiliary discharge is generated between first and second auxiliary discharge electrodes 41 and 42 whenever a scan pulse is applied. Consequently, due to the large quantity of charged particles generated from the auxiliary discharge, a write discharge occurs only an extremely short period after application of the data pulse has been commenced, and the write discharge can be generated effectively.

Furthermore, because the auxiliary discharge is generated between the first and second auxiliary discharge electrodes, there is virtually no effect on the formation of wall charge on the dielectric layer over scan electrodes 11. There is also no deterioration of the properties of dielectric layer 15 due to ion sputtering, and reductions in contrast caused by the auxiliary discharge are suppressed by shading film 43. Moreover, because the sustain pulse generation circuit is used to apply pulses to both the scan electrodes and the first auxiliary discharge electrodes, costs related to the circuitry can be reduced. These effects are the same as those described in embodiment 4-1.

Embodiment 4-3

Figure 37:
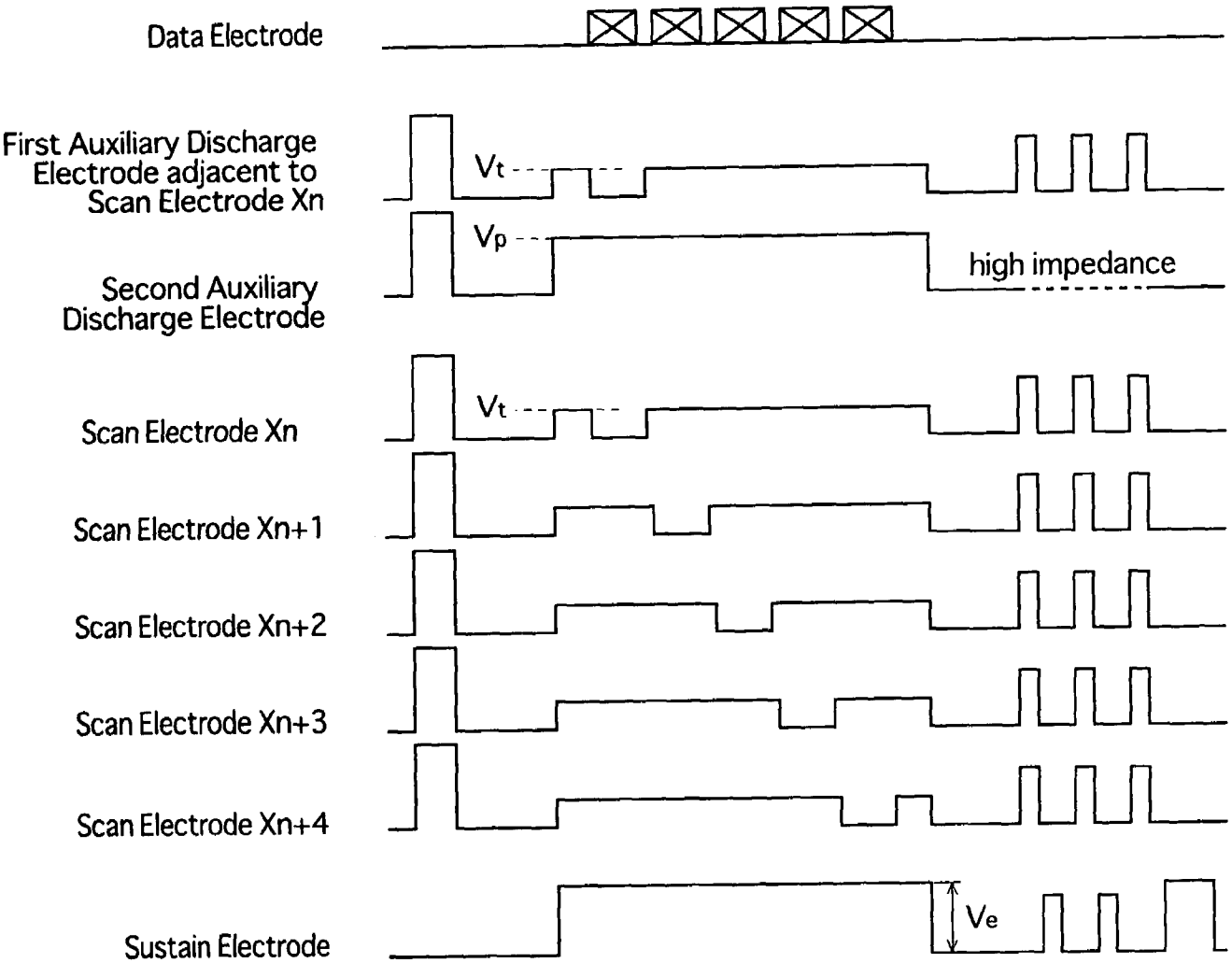
FIG. 37 shows drive waveforms of a PDP according to an embodiment 4-3.
Figure 38:
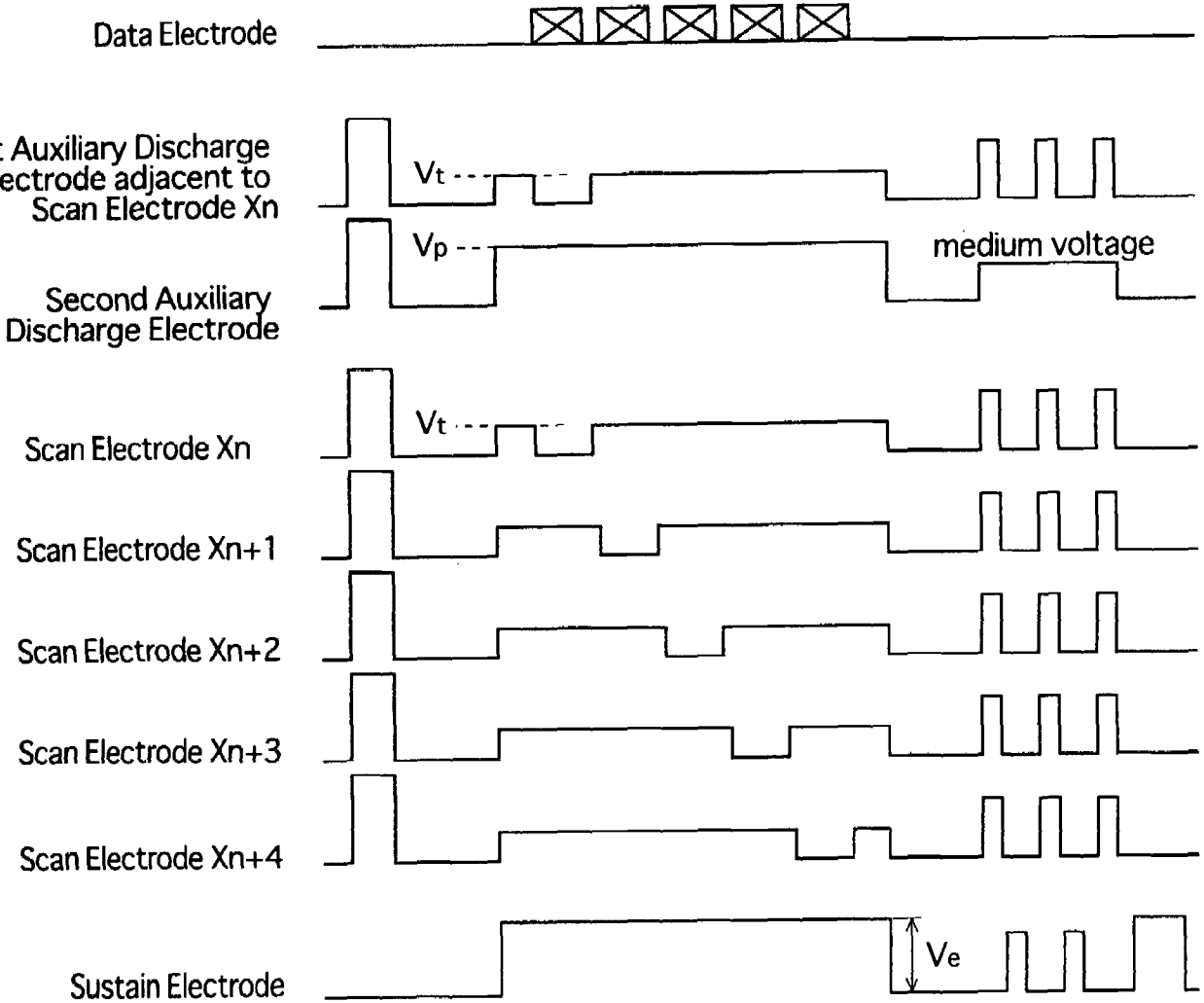
FIG. 38 shows drive waveforms of the PDP according to embodiment 4-3.

The present embodiment is basically the same as embodiment 4-2, although the present embodiment differs in that, as shown in FIG. 37, the second auxiliary discharge electrodes are maintained in a high impedance state in the sustain period, or as shown in FIG. 38, the output of discharge inducing pulse generation circuit 55 is maintained at approximately ½ the sustain pulse amplitude in order to maintain the second auxiliary discharge electrodes at a potential that is intermediate with respect to the potential of scan electrodes 11 and sustain electrodes 12.

The method of maintaining second auxiliary discharge electrodes 42 in a high impedance state is the same as that described in embodiment 3-3 above.

The effects are also the same as those described in embodiment 3-3. Thus, in comparison to embodiment 4-1 in which the large potential difference between second auxiliary discharge electrodes 42 and sustain electrodes 12 in the sustain period may cause an unnecessary discharge between these electrodes and thus a weakening or terminating of the sustain discharge between scan electrodes 11 and sustain electrodes 12, in the present embodiment these detrimental effects can be prevented.

Here, the structure of the circuits when second auxiliary discharge electrodes 42 are kept at a medium potential may be simplified by connecting electrodes 42 to one another and driving them collectively.

Embodiment 4-4

Figure 39:
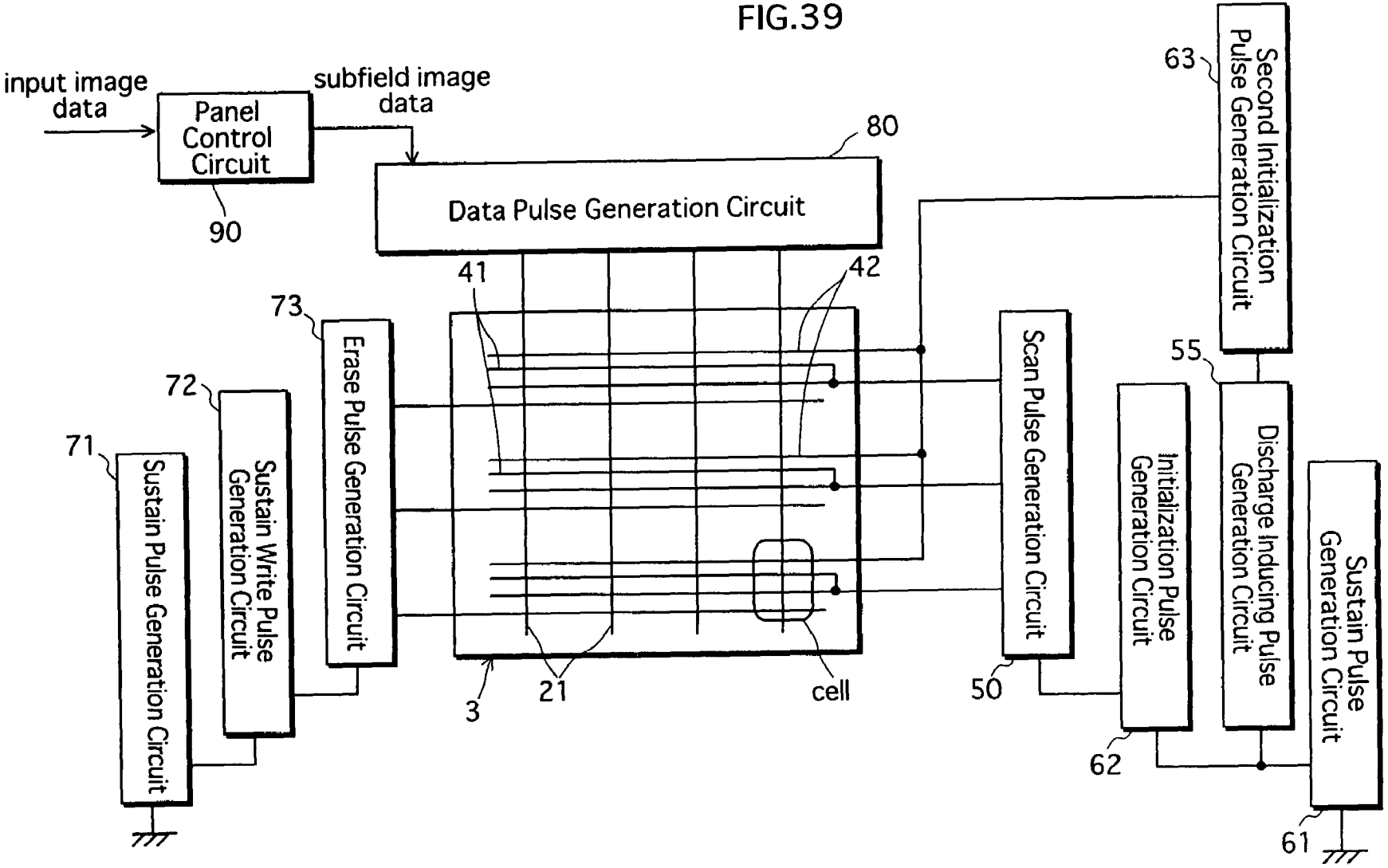
FIG. 39 shows a structure of a PDP display device according to an embodiment 4-4.

FIG. 39 shows a structure of a PDP display device according to the present embodiment. The structure of a PDP 3 in the PDP display device is the same as that described in embodiment 4-1.

The circuitry structure of PDP 3 is the same as that shown in FIG. 23 relating to embodiment 3-4. That is, a drive circuit of the present embodiment is the same as that shown in FIG. 35, although a second initialization pulse generation circuit is included for applying a pulse having a regular voltage Vs to second auxiliary discharge electrodes 42 in the initialization period.

Figure 40:
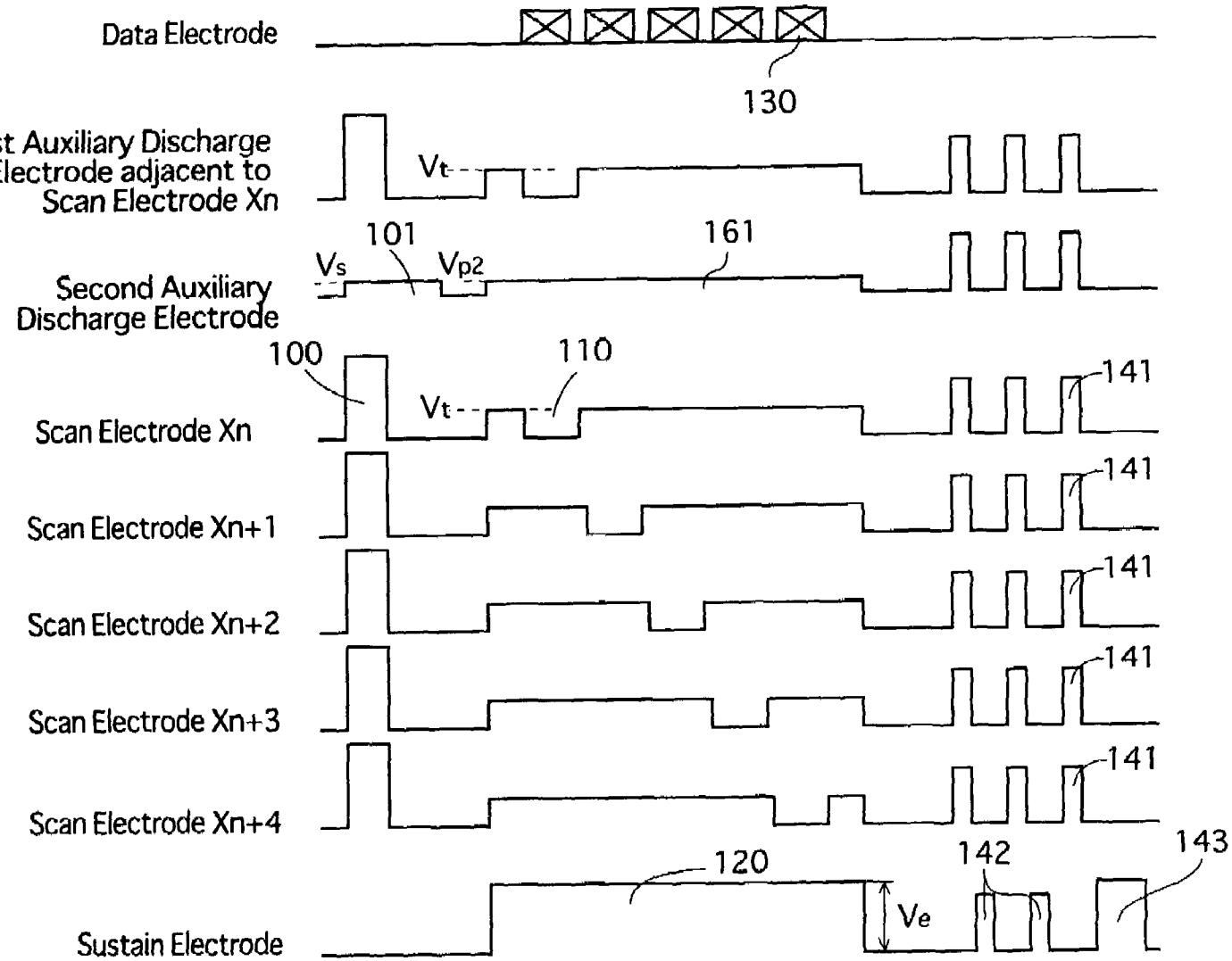
FIG. 40 shows drive waveforms of the PDP according to embodiment 4-4.

The drive waveforms applied to the electrodes are the same as those shown in FIG. 40, and thus the drive waveforms applied to scan electrodes 11, sustain electrodes 12 and data electrodes 21 are the same as the drive waveforms for a prior art three electrode AC-type surface discharge PDP.

In the initialization period, a second initialization pulse (voltage Vs) having an amplitude Vs (i.e. having an amplitude set lower than an amplitude of the initialization pulse applied to scan electrodes 11) is applied to second auxiliary discharge electrodes 42, and in the write period a discharge inducing pulse (voltage Vp2) having an amplitude Vp2 is applied to electrodes 42.

The generation of discharges and the like when the drive waveforms shown in FIG. 40 are applied in the panel will now be described.

The drive waveforms applied to scan electrodes 11, sustain electrodes 12 and data electrodes 21 are the same as those shown in FIG. 36, and the basic operation is also the same as that of embodiment 4-2. However, in the present embodiment, a second initialization pulse having an amplitude Vs (i.e. lower than an amplitude of initialization pulse) is applied to second auxiliary discharge electrodes 42 in the initialization period, and this results in a discharge 903 being generated between the second auxiliary discharge electrodes and the first auxiliary discharge electrodes (FIG. 41A).

As a result of this discharge, positive charge is stored on the dielectric layer above second auxiliary discharge electrodes 42, and negative charge is stored on the dielectric layer above first auxiliary discharge electrodes 41 (FIG. 41B).

Next, when in the write period a discharge inducing pulse is applied to second auxiliary discharge electrodes 42 without a scan pulse being applied to scan electrodes 11, a potential difference Vd3=(potential difference resulting from charge stored in initialization period)+(Vp2−Vt) occurs between the first and second auxiliary discharge electrodes.

Furthermore, when in the write period a scan pulse is applied to scan electrodes 11 together with the application of the discharge inducing pulse to second auxiliary discharge electrodes 42, a potential difference Vd4=(potential difference resulting from charge stored in initialization period)+Vp2 occurs between the first and second auxiliary discharge electrodes.

Here, an auxiliary discharge is generated between the first and second auxiliary discharge electrodes whenever the scan pulse is applied. Space charge is generated in the discharge space following this auxiliary discharge (FIG. 41D) Consequently, the time required for a write discharge to generate (FIG. 41E) in the on-cell after application of the data pulse is commenced can be greatly reduced in comparison to the prior art, and the write discharge can be generated effectively.

In the present embodiment, the value of voltage Vp2 and the width of the gap between a first and second auxiliary discharge electrodes in each pair is set so that a discharge is not generated between the first and second auxiliary discharge electrodes when the potential difference between these electrodes is Vd3, and so that a discharge is generated between the first and second auxiliary discharge electrodes when the potential difference between these electrodes is Vd4.

Here, a comparison of potential difference Vd4 in the present embodiment with potential difference Vd2 in embodiment 4-2 shows that because both Vd2 and Vd4 result in a voltage that slightly exceeds the discharge sparking voltage between the first and second auxiliary discharge electrodes, it is possible to set voltage Vp2 to a lower value than voltage Vp. Thus circuitry costs can be reduced as a result of being able to lower the resistance voltage of circuit elements in discharge inducing pulse generation circuit 55.

Variations of the Present Embodiment

Even if the second initialization pulse is not applied to second auxiliary discharge electrodes 42, the same effects can be achieved by setting second auxiliary discharge electrodes 42 to a ground potential in the initialization period. This structure allows for second initialization pulse generation circuit 63 to be omitted, and thus for circuitry costs to be further reduced.

Also, the second initialization pulse (amplitude Vs) applied to second auxiliary discharge electrodes 42 need not be of positive polarity. For example, if the second initialization pulse is of negative polarity, then the amount of positive charge stored over second auxiliary discharge electrodes 42 is further increased, and this allows for further reductions in amplitude Vp2 of the discharge inducing pulse applied to second auxiliary discharge electrodes 42.

As described in embodiment 4-3 above, by maintaining the output of second initialization pulse generation circuit 63 or discharge inducing pulse generation circuit 55 (see drive circuit block in FIG. 39) either in a high impedance state in the sustain period or at approximately ½ the sustain pulse amplitude in the sustain period, it is possible to prevent the weakening or terminating of the sustain discharge generated between the scan electrodes and sustain electrodes required for image display.

Here, in the example shown in FIG. 39, all of the second auxiliary discharge electrodes are connected to one another, although even if they are not all connected, the same effects can be achieved by applying the same drive waveforms to all of the second auxiliary discharge electrodes.

Embodiment 4-5

Figure 42:
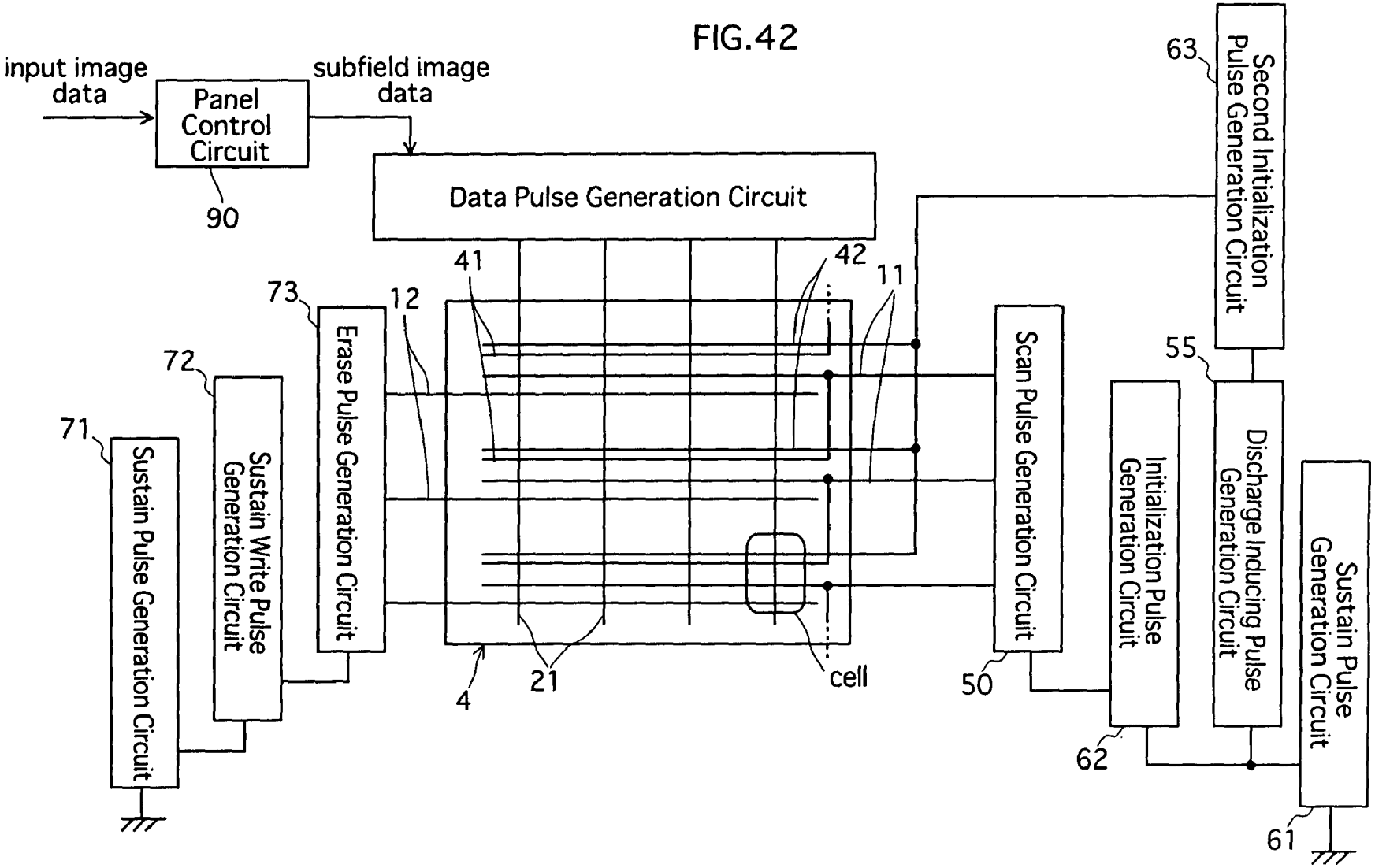
FIG. 42 shows a structure of a PDP display device according to an embodiment 4-5.
Figure 43B:
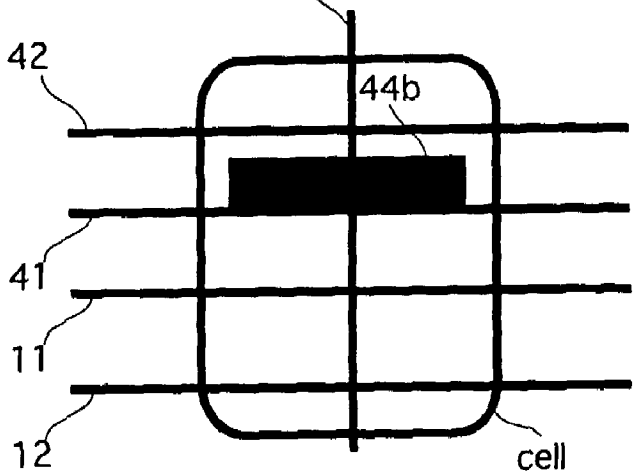
FIGS. 43A~43H show an electrode structure of a PDP according to an embodiment 4-6.
Figure 43D:
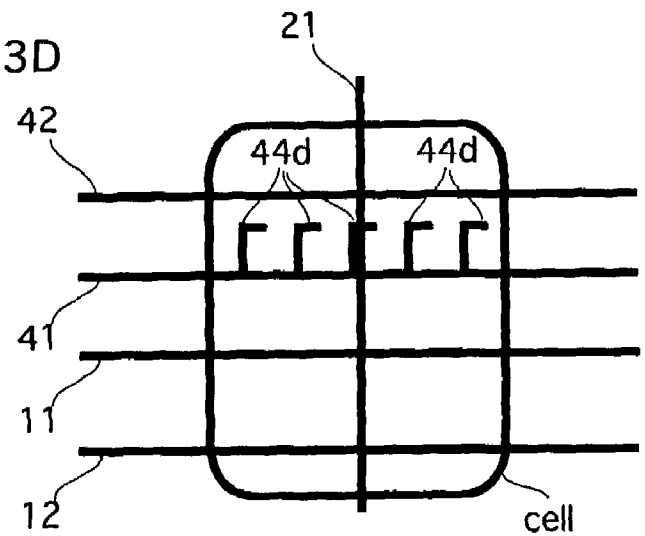
Figure 43A:
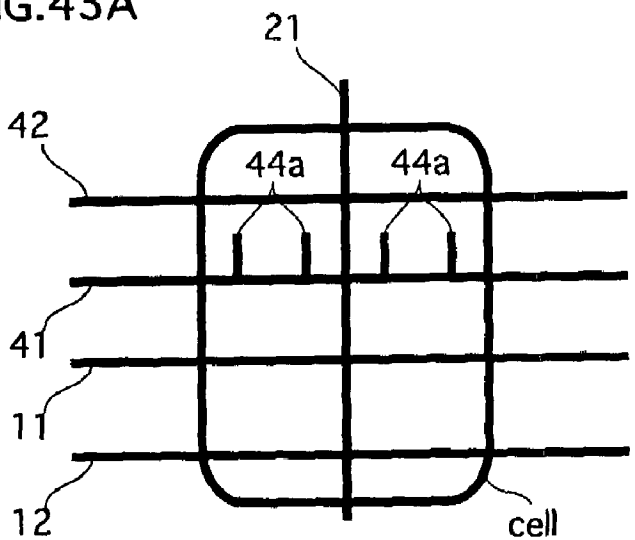
Figure 43C:
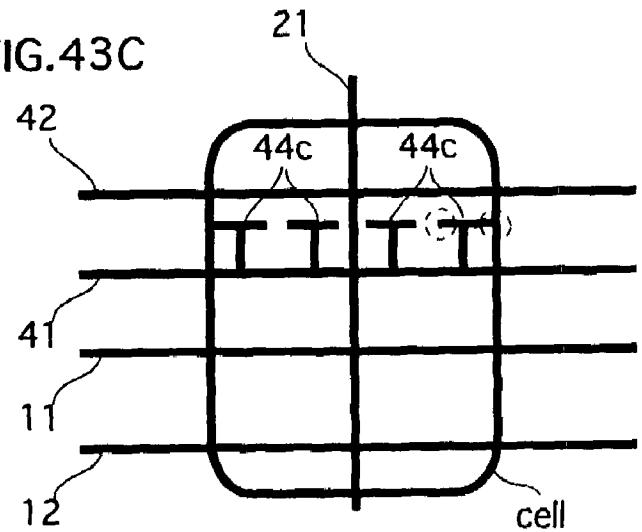
Figure 43F:
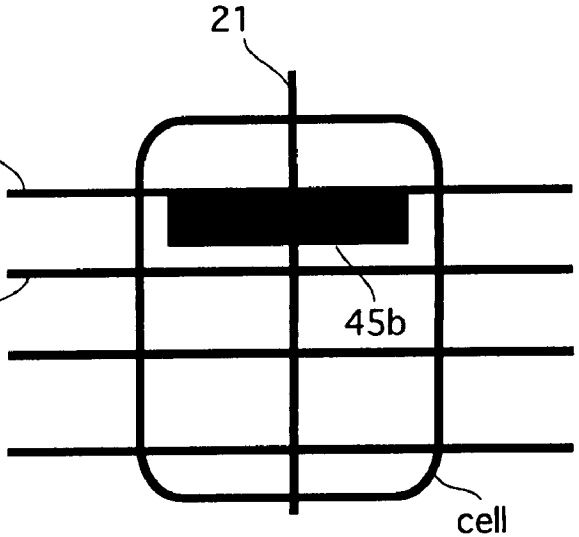
Figure 43E:
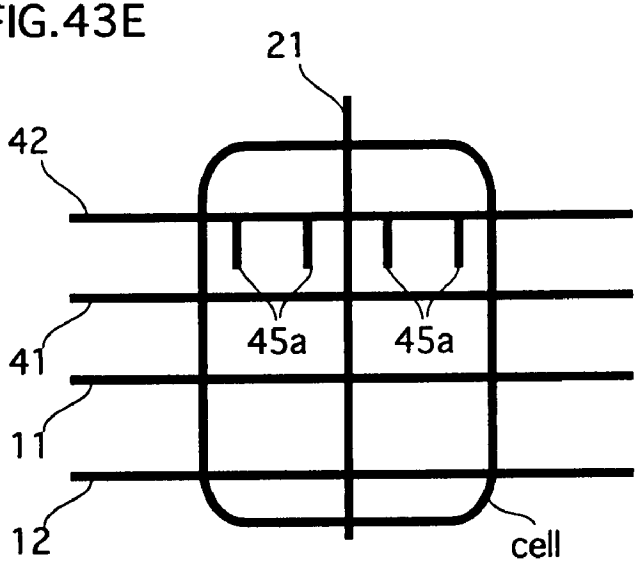
Figure 43H:
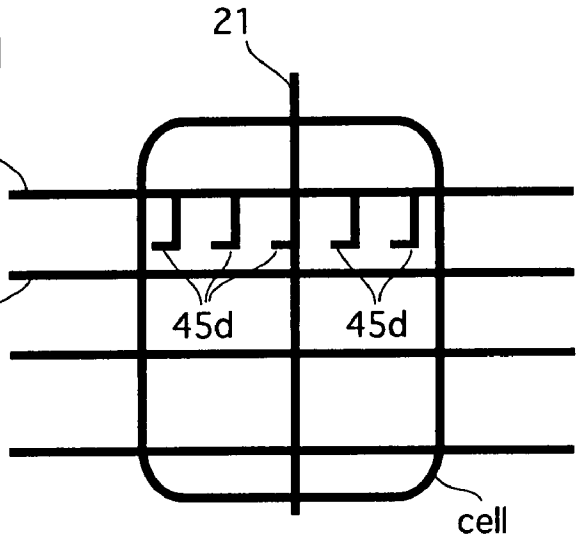
Figure 43G:
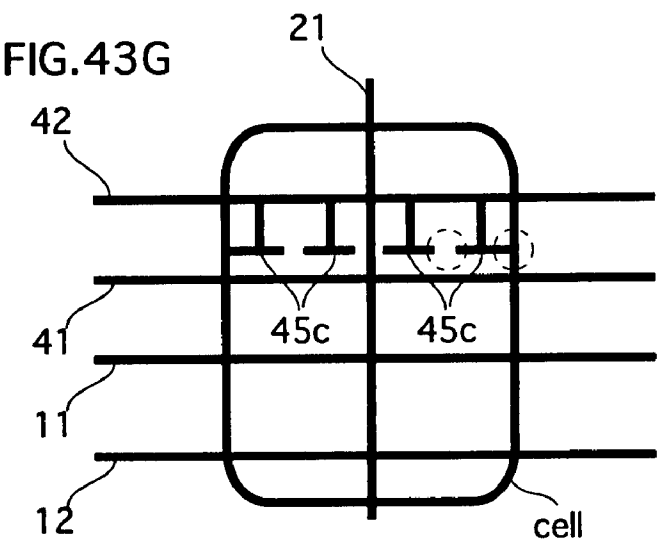

FIG. 42 shows a structure of a PDP display device according to the present embodiment.

The structure of a PDP 4 in the PDP display device is the same as that of PDP 3 in embodiment 4-2 above, although in comparison to PDP 3 of embodiment 4-2 in which each first auxiliary discharge electrode 41 is connected to an adjacent scan electrode 11, in PDP 4 of the present embodiment as shown in FIG. 42, each first auxiliary discharge electrode is connected to the scan electrode positioned in the next line.

Furthermore, the structure of the drive circuits is as described in embodiment 4-2, and the drive waveforms applied to electrodes 11, 12, 21 and 41 are the same as those shown in FIG. 36.

In the present embodiment, when a scan pulse is applied to scan electrode Xn, the same pulse is applied to a first auxiliary discharge electrode positioned adjacent to scan electrode Xn+1 (i.e. the scan electrode subsequent to scan electrode Xn), and an auxiliary discharge is generated between this first auxiliary discharge electrode and a second auxiliary discharge electrode positioned adjacent thereto. In other words, at the same time that the scan pulse is applied to scan electrode Xn, an auxiliary discharge is generated in the on-cell during a period equivalent to one line of writing prior to the data pulse being applied to data electrode Zm in the on-cell.

Consequently, the application of scan and data pulses in order to write the on-cell is conducted with space charge from the auxiliary discharge (i.e. generated one line of writing earlier) having been sufficiently dispersed throughout the discharge space of the on-cell. Thus it is possible to further enhance the reductions in time required for a discharge to be sparked from the auxiliary discharge.

Here, the descriptions given in embodiment 4-3 in relation to maintaining a high impedance state (FIG. 37) and a medium potential (FIG. 38), and the description given in embodiment 4-4 in relation to a potential of the pulse applied to second auxiliary discharge electrodes 42 in the initialization period (FIG. 40, etc) can be applied equally to the PDP display device of the present embodiment.

Embodiment 4-6

As shown in FIGS. 43A to 43H, the generation of the auxiliary discharge can be facilitated by providing protrusions 44*a* to 44*d* on first auxiliary discharge electrodes 41 or by providing protrusions 45*a* to 45*d* on second auxiliary discharge electrodes 42 in the PDP display devices described in embodiments 4-1 to 4-5 above.

Here, the shape of protrusions 44*a* to 44*d* and protrusions 45*a* to 45*d* shown in FIGS. 43A to 43H have the same characteristics as protrusions 33*a* to 33*d* and protrusions 13*a* to 13*d* shown in FIGS. 28A to 43H, respectively, and the effects of these configurations is also respectively the same.

Related Matters

The setting of delay period Td as described in embodiment 3-5 can be applied equally to embodiments 4-1, 4-2, 4-3 and 4-4, and as described above, it is possible to further enhance the reductions in time required for a discharge to be sparked from the auxiliary discharge.

Although the above embodiments are described in terms of each subfield being provided with an initialization period in which an initialization pulse is applied, it is not necessary to provide an initialization period in each subfield. For example, the present invention may be realized by only providing an initialization period at the head of each field.

Furthermore, the initialization period is not always required, and the present invention may be realized by structuring each subfield from only a write period and a sustain period.

Furthermore, although the erase pulse is applied to sustain electrodes 12 in the above embodiments, the erase pulse may be applied to scan electrodes 11.

INDUSTRIAL APPLICABILITY

The PDP of the present invention is applicable in display devices of computers, televisions, and the like, and is particularly applicable in large-screen display devices that conduct high definition image display.

The invention claimed is:

1. A drive method for driving a plasma display panel that has a plurality of pairs of first and second electrodes parallel to each other, and a plurality of third electrodes orthogonal to the pairs of first and second electrodes, cells being formed where the electrodes intersect, the drive method comprising:

applying a scan pulse sequentially to the first electrodes;

applying an auxiliary pulse to the third electrodes to generate a write auxiliary discharge of smaller magnitude than a write discharge in a cell selected for writing or in a cell adjacent to the selected cell; and applying a data pulse selectively to the third electrodes during a write period to generate a write discharge in selected cells of the plurality of cells and illuminate the written cell during a sustain period that succeeds the write period.

2. The drive method of claim 1, wherein in the plasma display panel, an auxiliary discharge electrode is provided adjacent to each first electrode, and in the write period, the write auxiliary discharge is generated between a first electrode to which the scan pulse is being applied and the auxiliary discharge electrode positioned adjacent to the first electrode.

3. The drive method of claim 2, wherein when the scan pulse is being applied to the first electrode in the write period, a pulse is applied to the third electrode, a voltage applied to the auxiliary discharge electrode positioned adjacent to the first electrode is adjusted such that a voltage between the first electrode and the auxiliary discharge electrode exceeds a discharge sparking voltage.

4. The drive method of claim 2, wherein in the sustain period, sustain pulses having the same waveform are applied to the first electrodes and the auxiliary discharge electrodes.

5. The drive method of claim 2, wherein in an initialization period that precedes the write period, initialization pulses having the same waveform are applied to the first electrodes and the auxiliary discharge electrodes.

6. The drive method of claim 2, wherein in an initialization period that precedes the write period, a potential of the auxiliary discharge electrodes is adjusted to be lower than a potential of the first electrodes.

7. The drive method of claim 6, wherein in the initialization period, a positive initialization pulse is applied to the first electrodes, and the auxiliary discharge electrodes are maintained at a ground potential.

8. The drive method of claim 6, wherein in the initialization period, a positive initialization pulse is applied to the first electrodes, and a negative pulse is applied to the auxiliary discharge electrodes.

9. The drive method of claim 2, wherein in the sustain period, the auxiliary discharge electrodes are maintained in a high impedance state.

10. The drive method of claim 2, wherein in the sustain period, a potential of the auxiliary discharge electrodes is maintained in a range within which a potential of the first electrodes and second electrodes fluctuates.

11. The drive method of claim 2, wherein in the write period, the write auxiliary discharge is generated between the auxiliary discharge electrode and the first electrode at the same time or prior to application of the data pulse to the third electrodes being commenced.

12. The drive method of claim 11, wherein in the write period, application of the data pulse to the third electrodes is commenced approximately 500 ns or less after application of the scan pulse to the first electrodes is commenced in order to generate the write auxiliary discharge.

13. A plasma display device, comprising:

a plasma display panel having a plurality of pairs of first and second electrodes parallel to each other, a plurality of third electrodes orthogonal to the pairs of first and second electrodes, cells being formed where the electrodes intersect; and a drive circuit for driving the plasma display panel by applying a scan pulse sequentially to the first electrodes, applying an auxiliary pulse to the third electrodes to generate a write auxiliary discharge of smaller magnitude than a write discharge in a cell selected for writing or in a cell adjacent to the selected cell, and applying a data pulse selectively to the third electrodes during a write period, to generate a write discharge in selected cells of the plurality of cells and illuminate the written cells in a sustain period that succeeds the write period.

14. The plasma display device of claim 13, wherein in the plasma display panel, an auxiliary discharge electrode is provided adjacent to each first electrode, and the drive circuit includes:

an auxiliary discharge generation unit operable to, in the write period, apply a pulse to data electrodes before a write pulse is applied to each cell, and generate the write auxiliary discharge between a first electrode to which the scan pulse is being applied and an auxiliary discharge electrode positioned adjacent to the first electrode.

15. The plasma display device of claim 14, wherein when the scan pulse is being applied to the first electrode in the write period, the auxiliary discharge generation unit applies a pulse to the third electrodes, and adjusts a voltage applied to an auxiliary discharge electrode positioned adjacent to the first electrode such that a voltage between the first electrode and the auxiliary discharge electrode exceeds a discharge sparking voltage.

16. The plasma display device of claim 14, wherein in the write period, the drive circuit generates the write auxiliary discharge between the first electrode and the auxiliary discharge electrode at the same time or prior to application of the data pulse to the third electrodes being commenced.

17. The plasma display device of claim 16, wherein in the write period, the drive circuit commences application of the data pulse to the third electrodes approximately 500ns or less after application of the scan pulse to the first electrodes is commenced in order to generate the write auxiliary discharge.

18. The plasma display device of claim 14, wherein the drive circuit includes:

a sustain pulse generation circuit for generating a sustain pulse to be applied to the first electrodes in the sustain period;

an initialization pulse generation circuit that operates using an output voltage of the sustain pulse generation circuit as a reference potential, and applies an initialization pulse to the first electrodes in an initialization period that precedes the write pulse in the write period;

a scan pulse generation circuit that operates using an output voltage of the initialization pulse generation circuit as a reference potential, and applies a scan pulse sequentially to the, first electrodes; and a discharge inducing pulse generation circuit that operates using an output voltage of one of the initialization pulse generation circuit and the sustain pulse generation circuit as a reference potential, and applies a discharge inducing pulse to the auxiliary discharge electrodes so as to generate an auxiliary discharge between the first electrodes and the auxiliary discharge electrodes.

19. The plasma display device of claim 14, wherein the drive circuit includes:

a sustain pulse generation circuit for generating a sustain pulse to be applied to the first electrodes in the sustain period;

an initialization pulse generation circuit that operates using an output voltage of the sustain pulse generation circuit as a reference potential, and applies an initialization pulse to the first electrodes in an initialization period that precedes the write period;

a scan pulse generation circuit that operates using an output voltage of the initialization pulse generation circuit as a reference potential, and applies a scan pulse sequentially to the first electrodes;

a second initialization pulse generation circuit that operates using the output voltage of the sustain pulse generation circuit as a reference potential, and applies to the auxiliary discharge electrodes a second initialization pulse that has a lower voltage than the initialization pulse applied to the first electrodes; and a discharge inducing pulse generation circuit that operates using an output voltage of the second initialization pulse generation circuit as a reference potential, and applies a discharge inducing pulse to the auxiliary discharge electrodes so as to generate an auxiliary discharge between the first electrodes and the auxiliary discharge electrodes.

20. The plasma display device as in claim 18, wherein the discharge inducing pulse generation circuit is structured so as to be able to maintain, in the sustain period, the auxiliary discharge electrodes in a high impedance state.

21. The plasma display device as in claim 18, wherein the discharge inducing pulse generation circuit is structured so as to be able to maintain, in the sustain period, a potential of the auxiliary discharge electrodes in a range within which a potential of the first electrodes and second electrodes fluctuates.

22. The plasma display device of claim 14, wherein the drive circuit includes:

a sustain pulse generation circuit for generating a sustain pulse to be applied to the first electrodes in the sustain period;

an initialization pulse generation circuit that operates using an output voltage of the sustain pulse generation circuit as a reference potential, and applies an initialization pulse to the first electrodes in an initialization period that precedes the write period;

a scan pulse generation circuit that operates using an output voltage of the initialization pulse generation circuit as a reference potential, and applies a scan pulse sequentially to the first electrodes;

a discharge inducing pulse generation circuit that operates using an output voltage of the sustain pulse generation circuit as a reference potential, and applies a discharge inducing pulse to the auxiliary discharge electrodes so as to generate an auxiliary discharge between the first electrodes and the auxiliary discharge electrodes; and a second initialization pulse generation circuit that operates using the output voltage of the discharge inducing pulse generation circuit as a reference potential, and applies to the auxiliary discharge electrodes a second initialization pulse that has a lower voltage than the initialization pulse applied to the first electrodes.

23. The plasma display device of claim 22, wherein:

the second initialization pulse generation circuit is structured so as to be able to maintain, in the sustain period, the auxiliary discharge electrodes in a high impedance state.

24. The plasma display device of claim 22, wherein the second initialization pulse generation circuit is structured so as to be able to maintain, in the sustain period, a potential of the auxiliary discharge electrodes in a range within which a potential of the first electrodes and second electrodes fluctuates.

25. A plasma display panel, comprising:

a plurality of pairs of first and second electrodes on a front panel parallel to each other;

a plurality of third electrodes on a back panel orthogonal to the pairs of first and second electrodes, cells being formed where the electrodes intersect;

an auxiliary discharge electrode adjacent to each first electrode on the front panel for enabling a write auxiliary discharge of smaller magnitude than a write discharge to be generated between a first electrode and the adjacent auxiliary discharge electrode when a scan pulse is being applied to the first electrode, wherein the display panel is driven by applying a scan pulse sequentially to the first electrode and a data pulse selectively to the third electrode during a write period to generate a write discharge in selected cells of the plurality of cells and illuminate the written cell during a sustain period that succeeds the write period.

26. The plasma display panel of claim 25, wherein a gap width between each first electrode and an auxiliary discharge electrode positioned adjacent thereto is set so that when a voltage equivalent to an amplitude of the scan pulse is applied between the first electrode and the auxiliary discharge electrode in the write period, an auxiliary discharge is generated between the first electrode and the auxiliary discharge electrode.

27. The plasma display panel of claim 25, wherein a width between each first electrode and an auxiliary discharge electrode positioned adjacent thereto is less than a gap width between the first electrode and a second electrode positioned adjacent thereto, such that when a discharge pulse is applied to the auxiliary discharge electrode, an auxiliary discharge is generated between the first electrode and the auxiliary discharge electrode and discharge is not generated with the second electrode.

28. The plasma display panel of claim 25, wherein a gap width in an electrode extension area between each first electrode and an auxiliary discharge electrode positioned adjacent thereto is set so that an auxiliary discharge occurs between the first electrode and the auxiliary discharge electrode when the discharge pulse is applied to the auxiliary electrode, and a discharge is not generated in the electrode extension area between the first electrode and the auxiliary discharge electrode when a voltage equivalent to an amplitude of the scan pulse is applied between the first electrode and the auxiliary discharge electrode.

29. The plasma display panel of claim 25, wherein in a vicinity of the auxiliary discharge electrodes, a shading film is formed that prevents light generated following the auxiliary discharge from reaching a panel surface.

30. The plasma display panel of claim 25, wherein in each cell, at least one of the first electrode and the auxiliary discharge electrode has a projection that extends toward the other electrode.

* * * * *

UNITED STATES PATENT AND TRADEMARK OFFICE

CERTIFICATE OF CORRECTION

PATENT NO. : 7,116,289 B2
APPLICATION NO. : 10/362693
DATED : October 3, 2006
INVENTOR(S) : Yamada It is certified that error appears in the above-identified patent and that said Letters Patent is hereby corrected as shown below:

In the Claims:
In Claim 25, Column 40, line 67, after “intersect;” insert --and--.
In Claim 27, Column 41, line 22, after “a” insert --gap--.

Signed and Sealed this

First Day of May, 2007

JON W. DUDAS
*Director of the United States Patent and Trademark Office*